US005674058A

United States Patent [19]

Matsuda et al.

[11] Patent Number: 5,674,058

[45] Date of Patent: Oct. 7, 1997

[54] SCROLL-TYPE REFRIGERANT COMPRESSOR

[75] Inventors: Mikio Matsuda; Mitsuo Inagaki, both of Okazaki; Hiroshi Ogawa, Nukata-gun; Kazuhide Uchida, Hamamatsu; Motohiko Ueda, Okazaki; Takeshi Sakai, Chiryu, all of Japan

[73] Assignees: Nippondenso Co., Ltd., Kariya; Nippon Soken Inc., Aichi, both of Japan

[21] Appl. No.: 724,854

[22] Filed: Oct. 3, 1996

Related U.S. Application Data

[63] Continuation of Ser. No. 471,959, Jun. 6, 1995, abandoned.

[30] Foreign Application Priority Data

Jun. 8, 1994 [JP] Japan ..... 6-126410
Nov. 24, 1994 [JP] Japan ..... 6-290205

[51] Int. Cl.[6] ..... F04B 49/02; F04C 29/08

[52] U.S. Cl. ..... 417/440; 418/15; 418/55.1

[58] Field of Search ..... 418/15, 55.1; 417/440

[56] References Cited

U.S. PATENT DOCUMENTS

| | | | |
|---|---|---|---|
| 4,505,651 | 3/1985 | Terauchi et al. | 417/440 |
| 4,818,195 | 4/1989 | Murayama et al. | 418/55.1 X |
| 5,055,012 | 10/1991 | Sakashita et al. | 418/55.1 X |
| 5,074,760 | 12/1991 | Hirooka et al. | 418/55.1 X |
| 5,090,880 | 2/1992 | Mashimo | 418/55.1 X |

FOREIGN PATENT DOCUMENTS

| | | | |
|---|---|---|---|
| 61-72889 | 4/1986 | Japan . | |
| 152592 | 11/1989 | Japan . | |
| 2-81988 | 3/1990 | Japan | 418/55.1 |
| 2204694 | 8/1990 | Japan . | |
| 3-138480 | 6/1991 | Japan | 418/55.1 |
| 3-145587 | 6/1991 | Japan | 418/55.1 |
| 65069 | 1/1994 | Japan . | |
| 6147117 | 5/1994 | Japan . | |

*Primary Examiner*—Richard E. Gluck
*Attorney, Agent, or Firm*—Cushman, Darby & Cushman IP Group of Pillsbury Madison & Sutro LLP

[57] ABSTRACT

A scroll-type refrigerant compressor having a movable scroll unit and a stationary scroll unit which has a fixed stationary end plate in which a plurality of bypass ports and a discharge port are formed through which the refrigerant compressed in the pockets formed between the movable and stationary scroll units is discharged via check valves covering the bypass ports and the discharge port and preventing a reverse flow of the discharged refrigerant into the pockets. The compressor further having a suction port fluidly connected to an evaporator of an air-conditioning system, a delivery port fluidly connected to a condenser of the air-conditioning system, and a fluid channel for providing a fluid communication between the suction and delivery ports via a solenoid-operated valve for blocking and unblocking the fluid channel. The compressor can be switched from the ordinary 100% capacity to 0% capacity and vice versa.

9 Claims, 43 Drawing Sheets

$\Delta\theta_0 > \Delta\theta_1 > \Delta\theta_2 > \Delta\theta_3 > \Delta\theta_4 > \Delta\theta_5$ $\Delta\theta_0 > \Delta\theta_1 > \Delta\theta_2 > \Delta\theta_3 > \Delta\theta_4 > \Delta\theta_5$ (0% CAPACITY)

(100% CAPACITY)

SCROLL-TYPE REFRIGERANT COMPRESSOR

This is a continuation of application Ser. No. 08/471,959, filed on Jun. 6, 1995, which was abandoned upon the filing hereof.

BACKGROUND OF THE INVENTION

1. Field of the Invention

The present invention relates to a scroll-type compressor which is not exclusively, but is particularly suitable for incorporation into an automobile air-conditioning system to compress the refrigerant.

2. Description of the Related Art

In an automobile air-conditioning system incorporating therein a refrigerant compressor such as a scroll-type compressor, the refrigerant is circulated through a refrigerating circuit including the refrigerant compressor, a condenser, a liquid receiver, an expansion valve, an evaporator, and refrigerant conduits which run so as to connect these units. The compressor which compresses a refrigerant gas and delivers the compressed refrigerant gas toward the condenser is arranged so as to be driven by an automobile engine via a power transmitting unit and a solenoid clutch.

The power transmitting unit includes a drive pulley connected to the automobile engine, a driven pulley mounted on the drive shaft of the refrigerant compressor, and a belt wound around the drive and driven pulleys so as to transmit the torque of the automobile engine from the drive to driven pulley. The solenoid clutch is provided so as to engage the driven pulley of the power transmitting unit with the drive shaft of the refrigerant compressor when the latter is to be driven and to disengage the driven pulley from the drive shaft of the compressor when the latter is to be stopped. The solenoid clutch generally includes solenoid coils capable of being electrically excited in response to the application of command signals, frictional discs, springs and other parts which are housed in the driven pulley of the power transmitting unit which is mounted on the drive shaft of the compressor when the power is transmitted from the automobile engine via the above-mentioned drive pulley and the belt. Since the driven pulley mounted on the drive shaft of the compressor accommodates therein the solenoid clutch, the outer diameter of the driven pulley cannot be small, and the construction of the driven pulley cannot be simple. Thus, the overall size and the manufacturing cost of the refrigerant compressor including the driven pulley and the solenoid clutch can be larger.

Further, when the refrigerant compressor is started and stopped by the operation of the solenoid clutch, a change in a load applied to the automobile engine occurs, which can disturb the driver of the automobile during the operation of the of the automobile due to a sudden change in the automobile speed and a shock applied to the driver.

Moreover, it is usually understood that when the refrigerant compressor incorporated in an automobile air-conditioning system is a scroll-type refrigerant compressor, the operation thereof can be quiet compared with the conventional reciprocating piston type compressors such as a swash plate type compressor or a wobble plate type compressor.

In this regard, Japanese Examined Patent Publication No.1-52592, Japanese Examined Patent Publication No. 6-5069 and Japanese Unexamined Patent Publication No. 61-72889 disclose examples of technical measures for reducing an unpleasant shock perceived by an automobile driver when the scroll-type compressor incorporated in the automobile air-conditioning system starts to operate. Nevertheless, the disclosed measures are directed to a shock reduction of the scroll-type compressor only at the time of initial start of the compressor, and accordingly, cannot obviate, from the power transmitting line from the automobile engine to the scroll-type compressor, the conventional solenoid clutch which is used for starting and stopping the compressor. Therefore, the above-described publications do not disclose technical measures for solving the problems of the conventional refrigerant compressors for automobile air-conditioning systems, such as minimizing the physical size, lowering the manufacturing costs, and eliminating the unpleasant shock applied to the automobile driver and passengers during the operation of the automobile.

SUMMARY OF THE INVENTION

Therefore, an object of the present invention is to provide a scroll-type compressor suitable for incorporation in an automobile air-conditioning system and capable of varying the amount of the compressed refrigerant to substantially zero, as required, without stopping the operation thereof.

Another object of the present invention is to provide a scroll-type refrigerant compressor for an automobile air-conditioning system capable of being continuously driven by an automobile engine while eliminating the problem of applying a sudden change in a load to the engine which often disturbs the automobile driver and passengers.

A further object of the present invention is to provide a simple internal construction of a scroll-type compressor, which allows a zero-capacity operation thereof, as required, when the compressor is being continuously operated for compressing a refrigerant of an automobile air-conditioning system.

In accordance with the present invention, there is provided a scroll-type refrigerant compressor which includes a housing unit provided with a suction port for introducing a refrigerant into the housing unit and a delivery port for delivering the refrigerant after compression; a suction chamber defined in the housing unit and fluidly communicated with the suction port; a discharge chamber defined in the housing unit and fluidly communicated with the delivery port; a stationary scroll unit fixed to the housing unit, and provided with an end plate and a spiral member formed on the end plate; a movable scroll unit arranged so as to be eccentrically engaged with the stationary scroll unit, and provided with an end plate and a spiral member formed on the end plate; a drive shaft rotatably supported by the housing unit and providing the movable scroll unit with an orbital motion relative to the stationary scroll unit; a rotation preventing unit arranged for preventing the movable scroll unit from rotating during the orbital motion thereof; and a plurality of compression chambers provided as a plurality of pockets which are defined between the stationary and movable scroll units and moved toward the center of the spiral members in response to an orbital motion of the movable scroll unit to thereby compress the refrigerant sucked into the pockets, characterized in that the scroll-type refrigerant compressor further comprises:

a plurality of by-passing ports formed in the end plate of the stationary scroll unit so as to provide a fluid communication between the plurality of pockets and the discharge chamber;

a discharge port formed in the end plate of the stationary scroll unit so as to provide a fluid communication between the plurality of pockets and the discharge chamber;

an arrangement in which the plurality of by-passing ports and the discharge port are provided in such a manner that all of the plurality of pockets are constantly communicated with the plurality of by-passing ports or the discharge port;

check valve units arranged in the discharge chamber at positions adjacent to the plurality of by-passing ports and to the discharge port so as to prevent the refrigerant after compression from returning from the discharge chamber toward the plurality of pockets;

a fluid channel unit arranged so as to be extended between the suction chamber and the discharge chamber, for providing a fluid communication therebetween; and a fluid passage control unit arranged in the fluid channel unit and defining open and closed positions of the fluid channel unit to thereby regulate the passage of the refrigerant through the fluid channel unit.

According to the above-mentioned scroll-type compressor, when the fluid channel unit between the suction and discharge chambers is closed by the fluid passage control unit, the compressor performs an ordinary compressing operation to deliver the compressed refrigerant to the air-conditioning system of an automobile.

When the fluid channel unit is opened by the fluid passage control unit so as to provide a fluid communication between the suction and discharge chambers of the compressor, pressures prevailing in both chambers are brought into an equilibrium and, accordingly, compression of the refrigerant does not occur in the respective pockets during the moving of the pockets towards the center of the spiral elements of the stationary and movable scroll units, and the refrigerant flows, through the by-passing ports and the discharge port, from the respective pockets towards the discharge chamber. Namely, the refrigerant circulates through suction chamber, the pockets, the discharge chamber of the compressor, and the fluid passageway. As a result, the scroll-type compressor can be operated at zero capacity (substantially no compressed refrigerant gas is delivered by the compressor).

It should be understood from the foregoing that the scroll-type refrigerant compressor can be switched from its ordinary compressing operation to a zero capacity operation, as required, due to the provision of the by-passing ports and the fluid passageway. Thus, it is possible to omit a solenoid clutch conventionally arranged in the power transmitting line from the drive source, i.e., an automobile engine, to the refrigerant compressor. Accordingly, the scroll-type compressor can have no solenoid clutch, can be small in size, and the manufacturing cost thereof can be reduced.

Further, since the scroll-type refrigerant compressor according to the present invention can be continuously operated during the operation of the automobile engine, when the compressor is switched from the zero capacity operation to the ordinary compressing operation thereof, a change in a load applied from the air-conditioning system to the automobile engine can be small and, accordingly, the driver or passengers need not suffer from an unpleasant shock which might occur due to a sudden change in the load applied to the automobile engine.

Preferably, the fluid channel is provided as a passageway formed so as to extend through the housing unit of the scroll-type compressor.

Preferably, the check valve unit includes a plurality of individual check valve elements arranged for each of the plurality of bypass ports and the discharge port.

Preferably, the fluid passage control unit includes a solenoid valve unit defining the open and closed positions thereof and movable from the open to closed position and vice versa in response to electric control signals.

Preferably, the plurality of bypass ports and the discharge port are provided in the end plate of the stationary scroll member in such a manner that they are arranged side by side along a straight line. Nevertheless, the plurality of bypass ports and the discharge port are provided in the end plate of the stationary scroll unit in a crossing arrangement.

Preferably, the plurality of by-passing ports and the discharge port have respective predetermined open areas, and these ports are arranged so that when the respective pockets are moved to gradually compress the refrigerant, the entire area due to an addition of respective predetermined areas of the by-passing ports and the discharge port which communicates between the respective pockets and the discharge chamber increases. Therefore, the plurality of by-passing ports and the discharge port are preferably arranged in a manner such that an angle of a line passing through respective two adjacent ports of the plurality of bypass ports and the discharge port measured with respect to the center of the stationary scroll unit decreases when respective two adjacent ports are closes to the center of the stationary scroll unit.

BRIEF DESCRIPTION OF THE DRAWINGS

The above and other objects, features, and advantages of the present invention will be made more apparent from the ensuing description of the embodiments thereof, with reference to the accompanying drawings, wherein.

DESCRIPTION OF THE PREFERRED EMBODIMENTS

Figure 1:
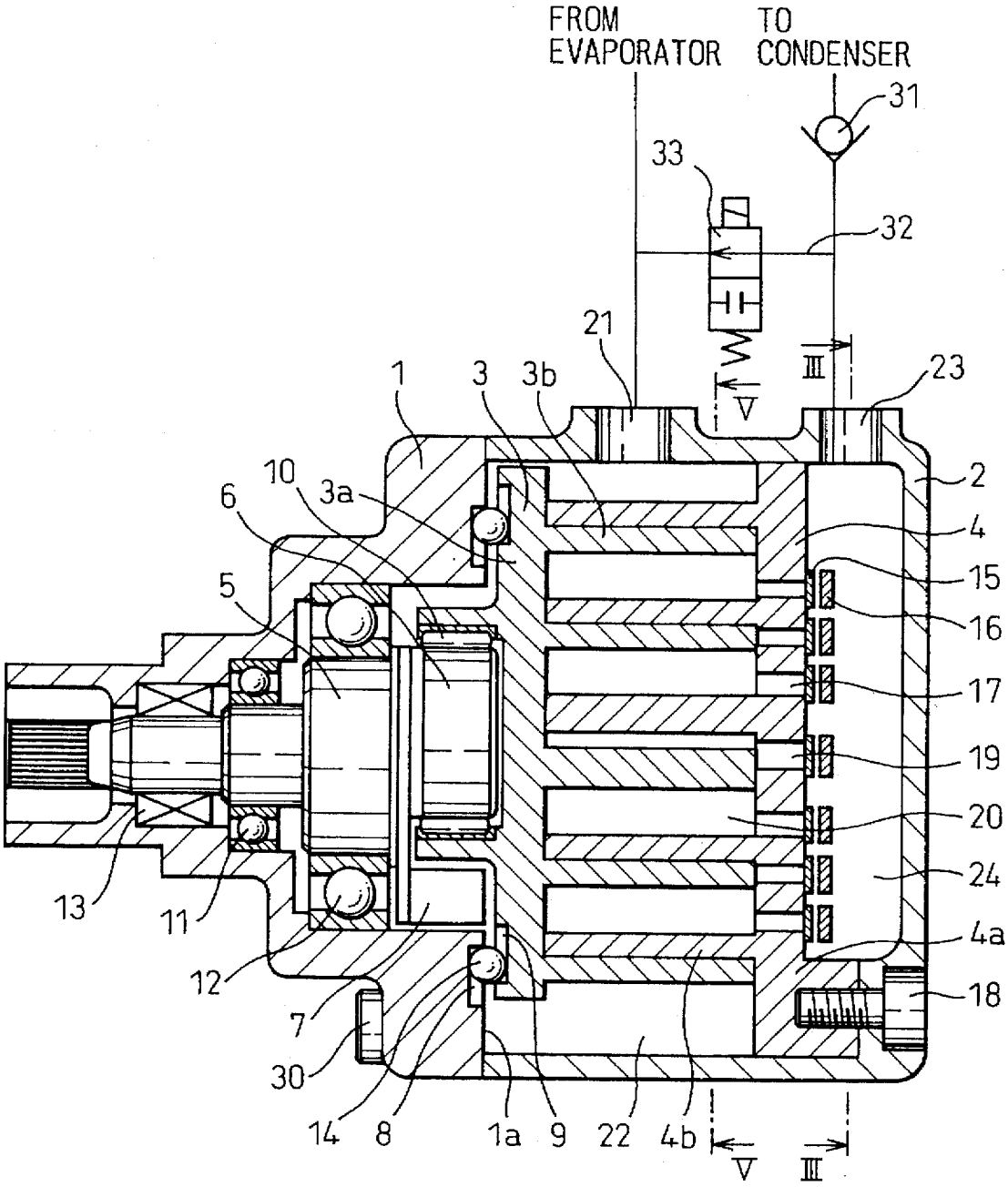
FIG. 1 is a cross-sectional view of a scroll-type refrigerant compressor according to a first embodiment of the present invention, illustrating a condition where a fluid communication between the suction and discharge chambers are provided.

Referring to FIGS. 1 through 4, the scroll-type refrigerant compressor for an automobile air-conditioning system includes a front housing 1, a rear housing 2, a movable scroll unit 3, a stationary scroll unit 4, and a crank shaft (drive shaft) 5. The crank shaft 5 is supported by anti-friction bearings 11 and 12, coaxially held by the front housing 1, and rotates about an axis of rotation thereof which is coaxial with the central axis of the two bearings 11 and 12. The crank shaft 5 is provided with a crank portion 6 formed at one end thereof, and arranged eccentrically from the axis of rotation of the crank shaft 5. The crank portion 6 supports thereon the movable scroll unit 3 via an anti-friction bearing 10, and accordingly, the rotation of the crank shaft 5 causes an orbiting motion of the movable scroll unit 3. The movable scroll unit 3 is provided with an end plate 3*a* and a spiral element 3*b* on one face of the end plate 3*a*. The other face of the end plate 3*a* is provided with an annular recess 9 formed therein so as to confront an annular recess 8 formed in an inner end face la of the housing 1. The annular recesses 8 and 9 receive therein a plurality of balls 14 which constitute a self-rotation preventing mechanism for the movable scroll unit 3.

A balance weight 7 is attached to the crank shaft 5 so as to balance the movable scroll unit 3 and the crank portion 6 which are arranged to be eccentric with respect to the axis of rotation of the crank shaft 5. A shaft seal unit 13 is mounted on a front portion of the crank shaft 5, and arranged between the front housing 1 and the crank shaft 5 so as to prevent refrigerant and lubricating oil from leaking from the interior of the compressor toward the exterior of the compressor.

The rear housing 2 of the compressor is combined with the front housing 1 by means of a plurality of male threaded bolts 30, and cooperates with the front housing to define an internal chamber for receiving a compressing mechanism therein. Namely, the stationary scroll unit 4 is fixed, in the internal chamber, to the rear housing 2 by a plurality of male threaded bolts 18, and is provided with an end plate 4*a* and a spiral element 4*b* arranged on one face of the end plate 4*a*. The spiral element 4*b* of the stationary scroll unit 4 and the spiral element 3*b* of the movable scroll unit 3 are engaged with one another and cooperate so as to define a plurality of pockets 20 therebetween functioning as compressing chambers of the scroll-type compressor.

The rear housing 2 is provided with a suction port 21 through which the gas-phase refrigerant is sucked into the compressor, and a delivery port 23 through which the gas-phase refrigerant after compression is delivered towards the air-conditioning system, and the suction and delivery ports 21 and 23 are separated by the end plate 4*a* of the stationary scroll unit 4. The suction port 21 is fluidly connected to a suction chamber 22 arranged on the front side of the end plate 4*a* of the stationary scroll unit 4, and the delivery port 23 is fluidly connected to a discharge port 24 arranged on the rear side of the end plate 4*a*.

Figure 3:
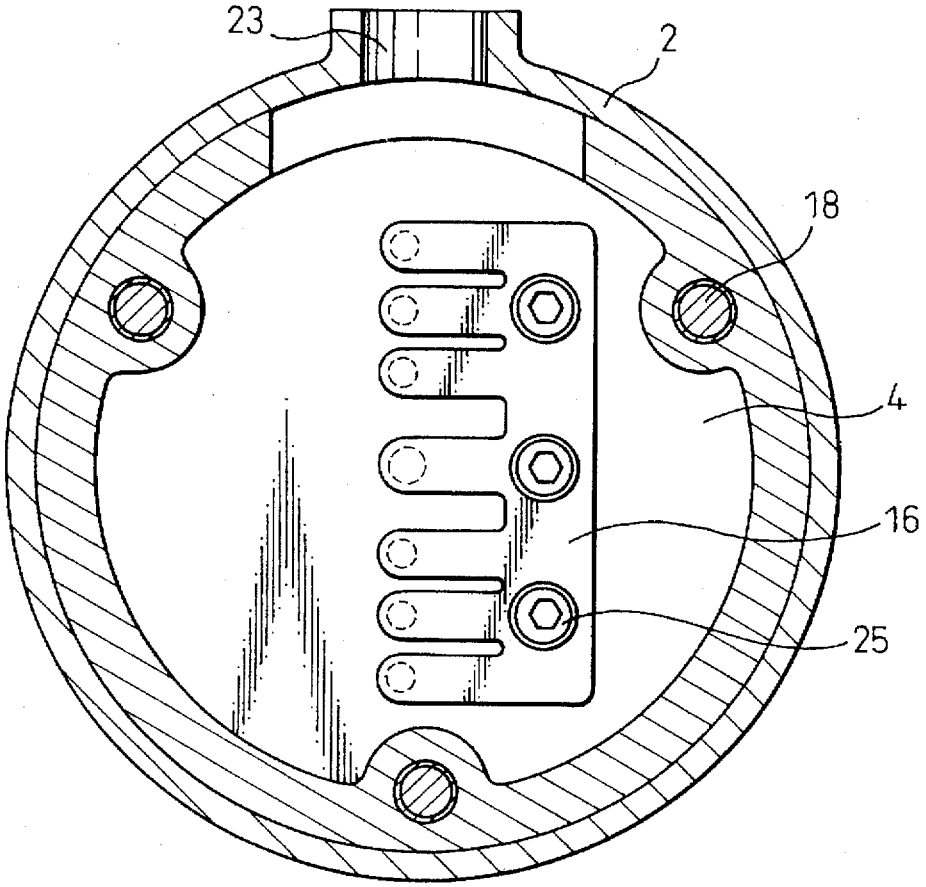
FIG. 3 is a cross-sectional view taken along the line III—III of FIGS. 1 and 2.
Figure 4:
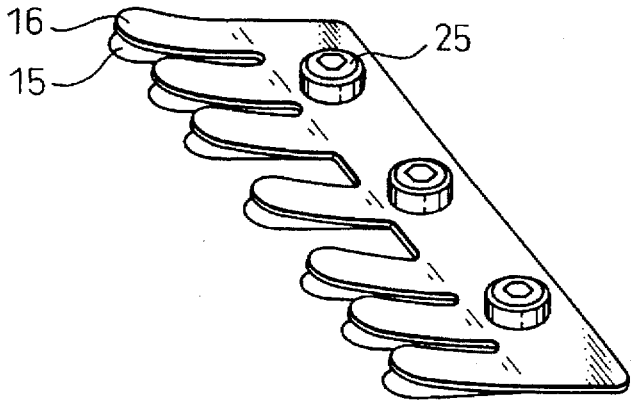
FIG. 4 is a perspective view of an assembly of check valves and a retainer plate.
Figure 5A:
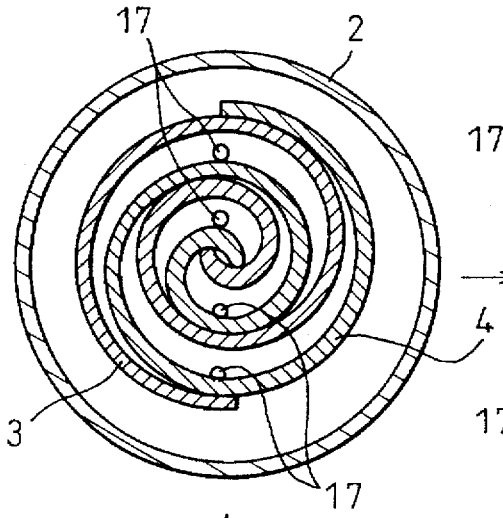
FIGS. 5A through 5D are cross-sectional views, taken along the line V—V of FIG. 1 respectively, illustrating the operation of the stationary and movable scroll units of the compressor according to the first embodiment.
Figure 5B:
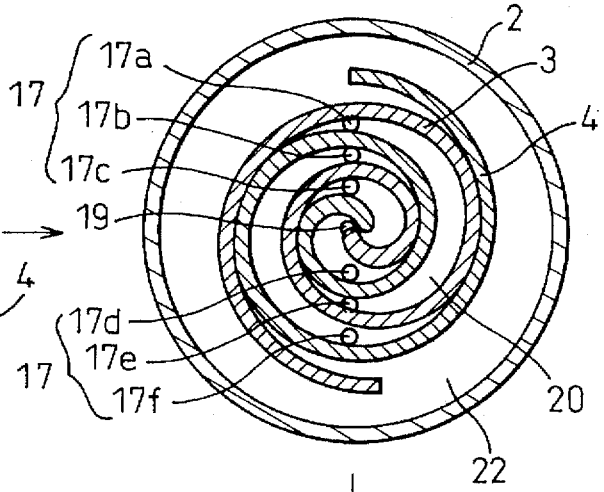
Figure 5D:
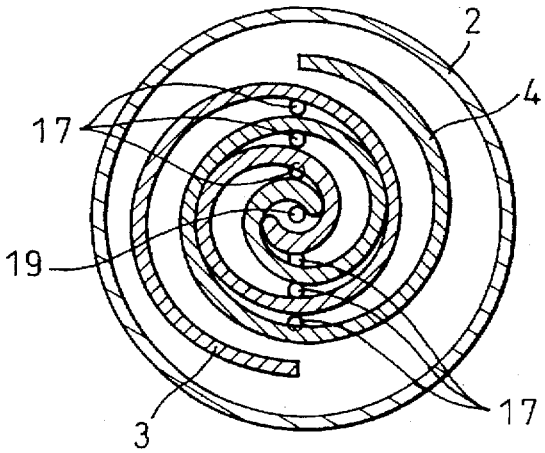
Figure 5C:
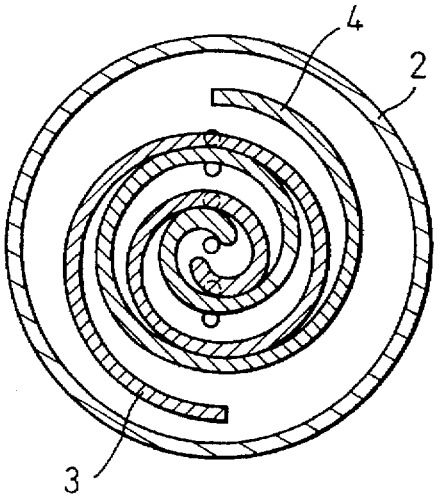
Figure 6A:
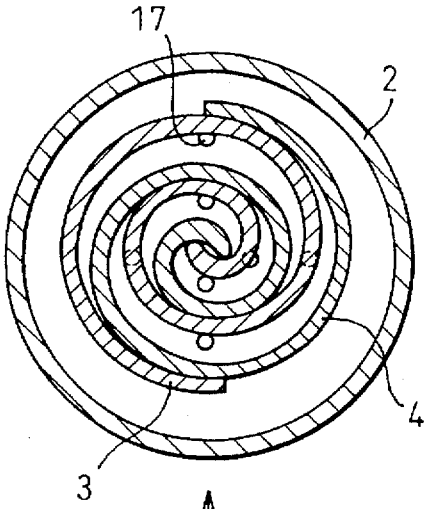
FIGS. 6A through 6D are the same cross-sectional views as FIGS. 5A through 5D, illustrating the operation of the stationary and movable scroll units of the compressor according to a second embodiment of the present invention.
Figure 6B:
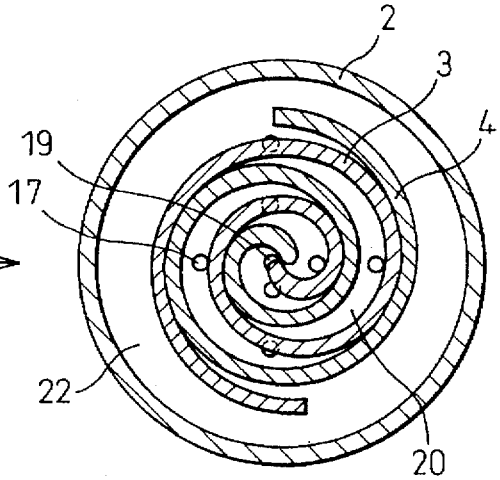
Figure 6D:
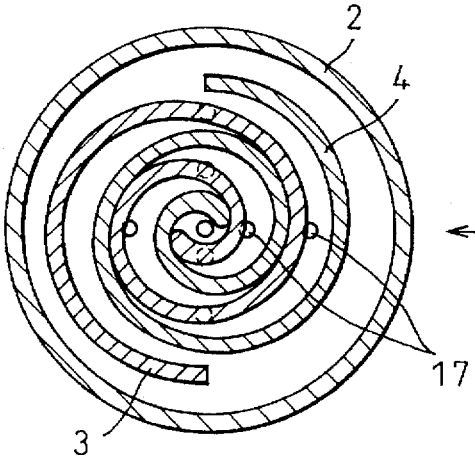
Figure 6C:
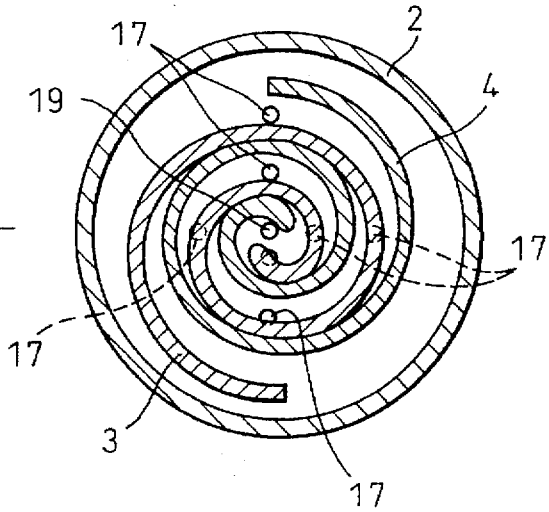

The end plate 4*a* of the stationary scroll unit 4 is provided with a discharge port 19 and a plurality of bypass ports 17 bored therein which are arranged so as to provide a fluid communication between the compressing chambers (pockets) 20 and the discharge chamber 24, and the openings of the by-pass and discharge ports 17 and 19 located on the side of the discharge chamber 24 are openably closed by check valves 15 which are backed by retainers 16. The check valves 15 and the retainers 16 are formed in an unitary assembly as shown in FIG. 4, and are fixed to the end plate 4*a* of the stationary scroll unit 4 by male threaded bolts 25 as shown in FIG. 3. As required, separate units, each having a check valve 15 and a retainer 16, may be used instead of the above-mentioned unitary assembly.

FIGS. 5A through 5D illustrate a change in a positional relationship between the movable and stationary scroll units 3 and 4 during one complete orbiting motion of the movable scroll unit 3 after completion of suction of the gas-phase refrigerant into the compressor, at four different positions of the movable scroll unit 3, orbiting from one to the next position, separated by approximately 90 degrees. As shown in FIGS. 5A through 5D, the bypass ports 17 are arranged so that each of the plurality of pockets 20 is constantly communicated with one of the bypass ports 17 or the discharge port 19. Namely, the bypass ports 17 enable each of the pockets 20 to be constantly by-passed to the discharge chamber 24.

The delivery port 23 is fluidly connected, via the check valve 31, to a condenser (not shown) of the air-conditioning system, and the suction port 21 is fluidly connected to an evaporator of the air-conditioning system. The suction and discharge ports 21 and 23 are fluidly connected to one another by a fluid channel 32 in which a solenoid valve 33 is arranged so as to regulate the passage of the refrigerant through the fluid channel 32.

Figure 2:
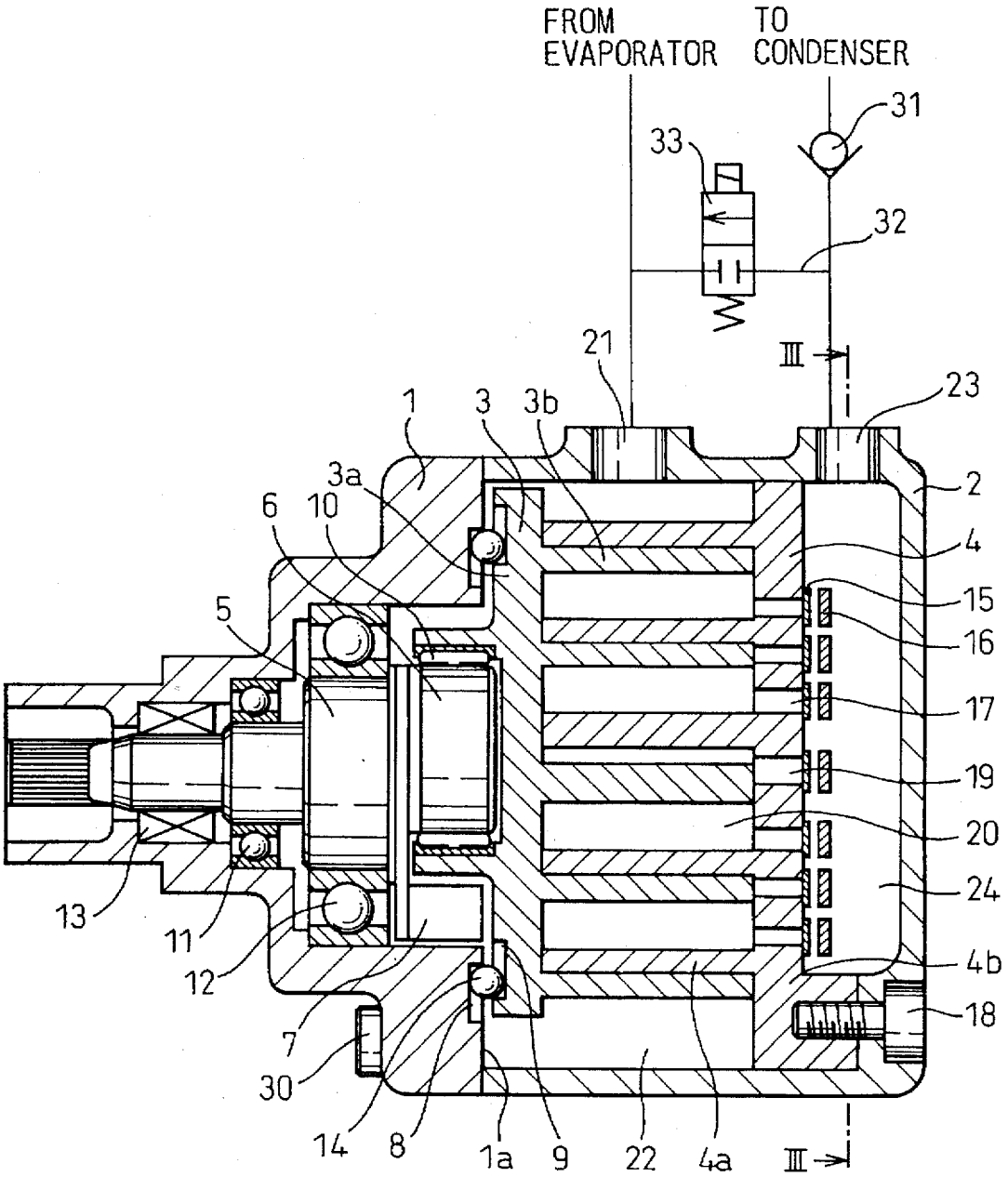
FIG. 2 is a cross-sectional view of the compressor of FIG. 1, illustrating a condition where a fluid communication is interrupted.

As shown in FIG. 2, when the solenoid valve 33 is not energized, the solenoid valve 33 is moved to its closed position to interrupt the fluid channel 32 and, accordingly, the fluid communication between the suction and discharge ports 21 and 23 is stopped. When the solenoid valve 33 is energized, it is moved to its open position, as shown in FIG. 1, and the fluid channel 32 permits the refrigerant to flow from the delivery port 23 towards the suction port 21.

The operation of the scroll-type compressor according to the first embodiment will be provided below with reference to FIGS. 1, 2 and 5.

When the solenoid valve 33 is not energized as shown in FIG. 2, the suction port 21 is connected to the evaporator, and the delivery port 23 is connected to the condenser. Thus, the compressor performs an ordinary compressing operation, and a discharge pressure prevails in the discharge chamber 24 so as to apply the discharge pressure to the back of the respective check valves 15. Thus, the bypass ports 17 are closed by the check valves 15 under the discharge pressure, and therefore, the refrigerant sucked in the respective pockets 20 is gradually compressed according to the orbiting motion of the movable scroll unit 3 and, when the pressure of the compressed refrigerant increases to the discharge pressure, it is discharged from the pockets 20 into the discharge chamber 24 through either the bypass ports 17 or the discharge port 19. The discharged refrigerant gas after compression is delivered from the discharge chamber 24 towards the condenser of the air-conditioning system.

Since the respective check valves 15 is urged toward or away from the bypass ports 17 and the discharge port 19 due to a pressure differential between a pressure prevailing in the discharge chamber 24 and that prevailing in the pockets 20, at the start of the operation of the compressor, the discharge pressure in the discharge chamber 24 is not sufficiently increased. Thus, the refrigerant tends to be discharged from some of the pockets 20 which are located at positions radially far from the center of the discharge chamber 24. During continuing of the compressing operation of the compressor, the discharge pressure of the compressed gas-phase refrigerant in the discharge chamber 24 is gradually increased. Thus, those bypass ports 17 which are located at positions radially away from the center of the discharge chamber 24 are relatively tightly closed by the check valves 15, and only the bypass ports 17 which are located at positions relatively close to the center of the discharge chamber 24 and the discharge port 19 permit the refrigerant to be discharged from the pockets 20 toward the discharge chamber 24, and finally, when the discharge pressure in the discharge chamber 24 is further increased so as to apply a high pressure of the back of the check valves 15 closing the bypass ports 17, the compressed refrigerant is discharged through only the central discharge port 19 into the discharge chamber 24. Thereafter, the ordinary compressing operation of the compressor continues.

The compressed gas-phase refrigerant in the discharge chamber 24 is delivered towards the condenser and circulates through the refrigerating circuit of the air-conditioning system until the refrigerant returns to the suction port 21 of the compressor.

When the solenoid valve 33 is energized and is moved to its open position shown in FIG. 1, the delivery port 23 is communicated with the suction port 21 through the fluid channel 32. Further, the pressure of the condenser is prevented by a check valve 31 (FIG. 1) to act on the delivery port 23 and, therefore, the pressure in the discharge chamber 24 is placed into in equilibrium with that in the suction chamber 22. Accordingly, in the discharge chamber 24, the backs of the respective check valves 17 are acted on by a pressure equal to the suction pressure. Namely, no differential pressure acts on each of the check valves 15, and the refrigerant in the respective pockets 20 is discharged from the pockets 20 toward the discharge chamber 24 without being subjected to compression in the pockets 20, through the bypass ports 17 or the discharge port 19. The refrigerant is then directly delivered from the discharge chamber 24 towards the suction chamber 22 via the discharge port 23, the fluid channel 32, the solenoid valve 33, and the suction port 21. Thus, the refrigerant is merely circulated without being compressed, and accordingly, the operation of the compressor is brought to zero capacity. The circulating refrigerant is accompanied by a lubricating oil suspended therein, and therefore, the shaft seal 13 and the anti-friction bearings 11 and 12 can be adequately lubricated by the circulating lubricating oil.

From the foregoing description, it will be understood that in the scroll-type refrigerant compressor according the first embodiment, the zero capacity operation of the compressor can be realized by provision of the bypass ports 17, the check valves 15, and the solenoid valve 33 in the fluid channel 32. Accordingly, it is possible to omit a solenoid clutch from the power transmitting line from a drive source such as an automobile engine to the crank shaft 5 of the compressor. As a result, the entire size of the scroll-type refrigerant compressor mounted in an engine compartment of an automobile, and the manufacturing cost thereof, can be reduced. Further, since the compressor can be continuously operated due to the possibility of a zero capacity operation, it is possible to reduce a change in a load applied to the drive source, i.e., the automobile engine, when the operation of the compressor is switched from the zero capacity to an ordinary compressing operation delivering the required amount of compressed gas-phase refrigerant. Thus, an unpleasant shock is not applied to a driver or other persons riding in the automobile.

It should be understood that the arrangement of the bypass ports 17 closed by respective check valves 15 and retainers 16 may be modified as required.

FIGS. 6A through 6D illustrate a modified arrangement of the bypass ports provided in a scroll-type refrigerant compressor. In the afore-mentioned arrangement of the bypass ports of the first embodiment, the plurality of bypass ports 17 are arranged on a substantially straight line substantially extending along a diameter of the end plate 4*a* of the stationary scroll unit 4. Nevertheless, in the arrangement of FIG. 2 according to a second embodiment, a plurality of bypass ports 17 are arranged on two rectangularly crossing lines which cross one another at approximately the center of the discharge port 19. In this arrangement, all of the compressing chambers or pockets 20 are communicated with one of the bypass ports 17 or the discharge port 19, and accordingly, the refrigerant in respective pockets 20 can be by-passed from the pockets 20 to the discharge chamber 24 through the bypass ports 17 or the discharge ports 19. The arrangement of the bypass ports is not limited to those shown in FIGS. 5A through 5D or 6A through 6D.

In the afore-described arrangements of the bypass ports 17, the opening area of the bypass ports provided for each of the plurality of pockets 20 is set constant, irrespective of the movement of respective pockets 20 from the outer portion towards the central portion of the stationary scroll unit 4. Accordingly, in response to the compressing operation in each of the pockets 20 which are moved by the orbital motion of the movable scroll unit 3 from the outer portion towards the central portion of the stationary scroll unit 4 while the respective volumes thereof are reduced, the pressure of the compressed refrigerant within respective pockets 20 increases, and the refrigerant must be subjected to an increased pressure loss while passing through the bypass ports 17. In order to eliminate the above-mentioned defect, an arrangement of the bypass ports 17 shown in FIG. 7 is improved so that the opening area of the bypass ports 17 for each of the plurality of pockets 20 formed between the movable and stationary scroll units 3 and 4 is increased in response to a movement of respective pockets 20 from the outer portion towards the central portion of the stationary scroll unit 4.

FIGS. 7 through 12 illustrate the third embodiment of the present invention.

Figure 7:
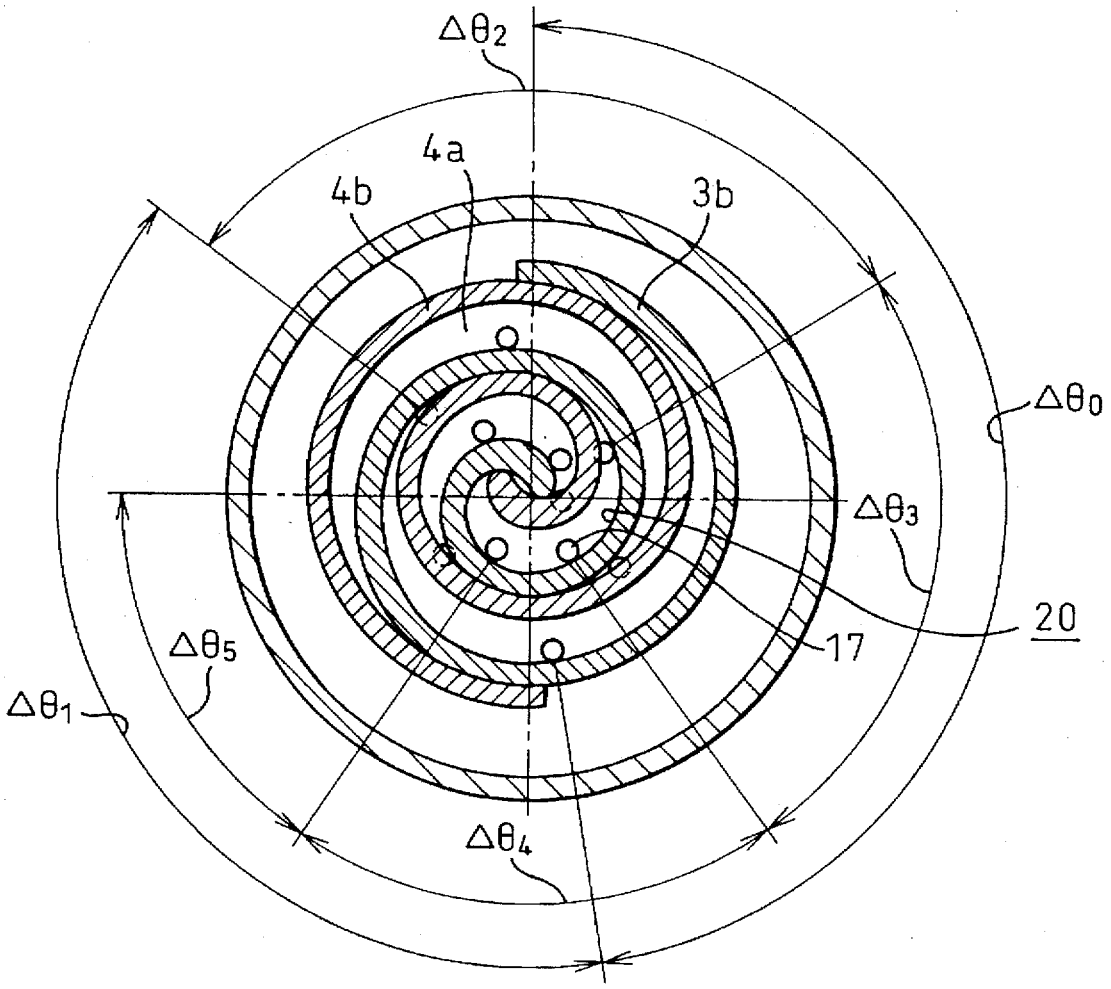
FIG. 7 is a cross-sectional view of the stationary and movable scroll units according to a third embodiment of the present invention, illustrating an arrangement of by-passing ports and a discharge port.
Figure 8:
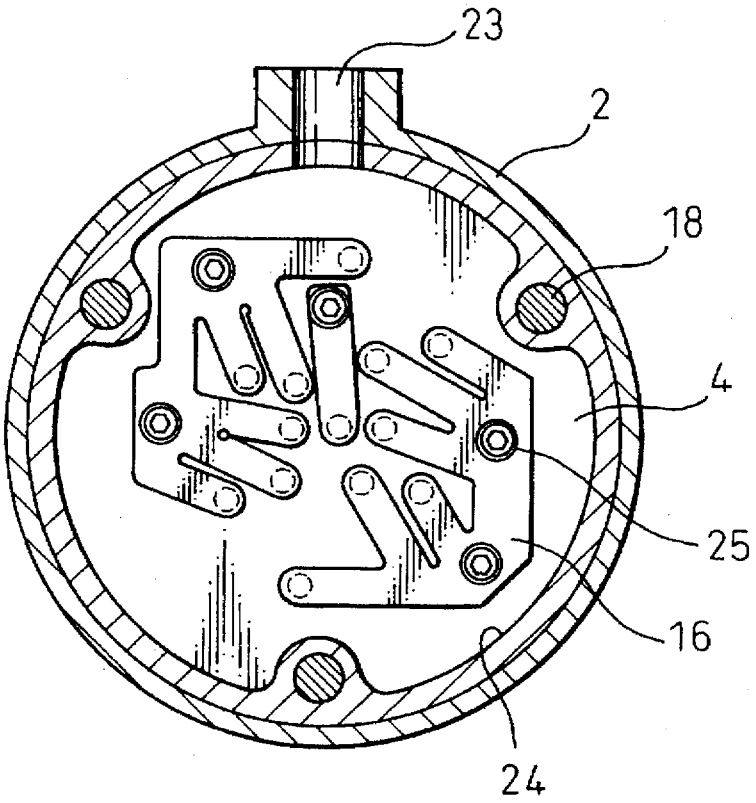
FIG. 8 is a partly cross-sectional view similar to FIG. 3, illustrating assemblies of check valves and retainers of the third embodiment.
Figure 9:
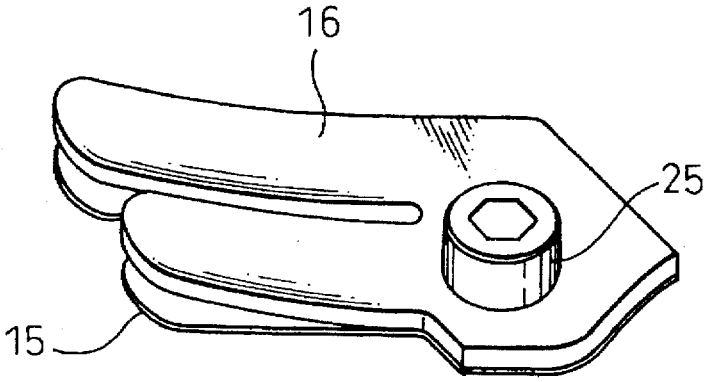
FIG. 9 is a perspective view of one of the assemblies of check valves and retainers of the third embodiment.
Figure 11:
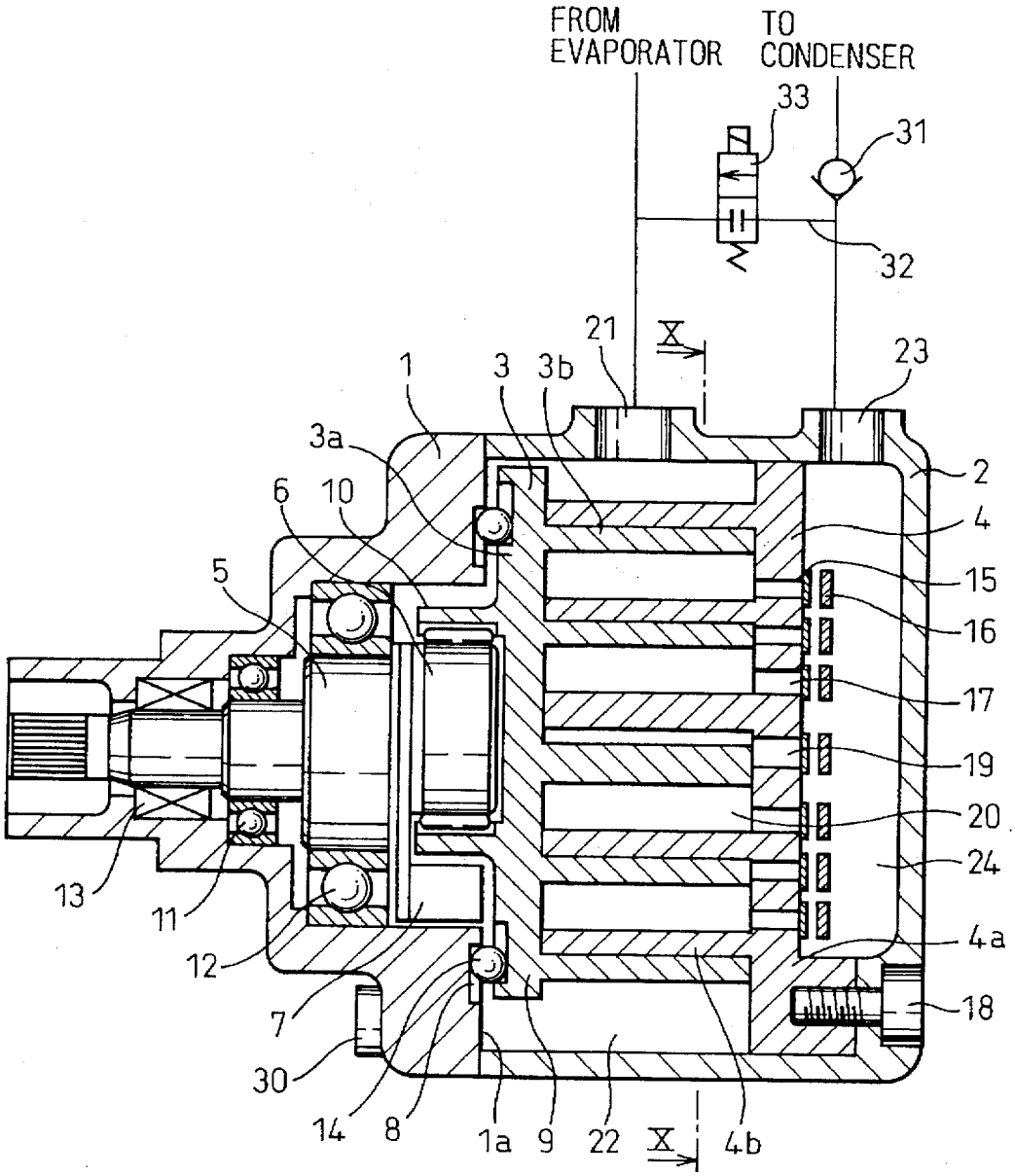
FIG. 11 is a longitudinal cross-sectional view of a scroll-type compressor according to the third embodiment.

As best shown in FIG. 7, the plurality of bypass ports 17 and a central discharge port 19 (FIG. 11) are arranged in the end plate 4*a* of the stationary scroll unit 4 as through-bores formed therein, to provide fluid communication between the respective pockets 20 and the discharge chamber 24 (FIG. 11). The bypass ports 17 and the discharge port 19 are covered by check valves 15 supported by retainer plates 16. The check valves 15 and the retainer plates 16 are assembled together and fixed to the end plate 4*a* by female threaded bolts 25 as shown in FIGS. 8 and 9.

FIGS. 10A through 10D illustrate the relationship between the movable scroll unit 3 and the stationary scroll unit 4 of the scroll-type refrigerant compressor of the third embodiment with respect to four different positions angularly spaced apart from one another by approximately a quarter of one complete orbiting motion of the movable scroll unit 3. It should be understood that, the pockets 20 formed between the movable and stationary scroll units during the orbiting of the movable scroll unit 3 are gradually moved toward the center of the two scroll units 3 and 4 while the volume thereof is reduced. Nevertheless, according to the arrangement of the bypass ports 17 and the discharge port 19 of the third embodiment, each of the plurality of pockets 20 can constantly have at least one by-passing port 17 or the discharge port 19. Thus, the pockets 20 can constantly communicate with the discharge chamber 24 during the movement thereof. The bypass ports 17 are arranged along the spiral element 4*b* of the stationary scroll unit 4, and if an angle between the neighboring two bypass ports 17 with respect to the center of the spiral element 4*b* of the stationary scroll unit 4 is defined as $\Delta\theta$, the angle $\Delta\theta$ of any two neighboring bypass ports 17 is smaller than that of two different neighboring bypass ports 17 so long as the former two ports 17 are located far from the center of the spiral element 4*b* compared with the latter two neighboring ports 17. This angular arrangement of the bypass ports 17 is best illustrated in FIG. 7.

Figure 10A:
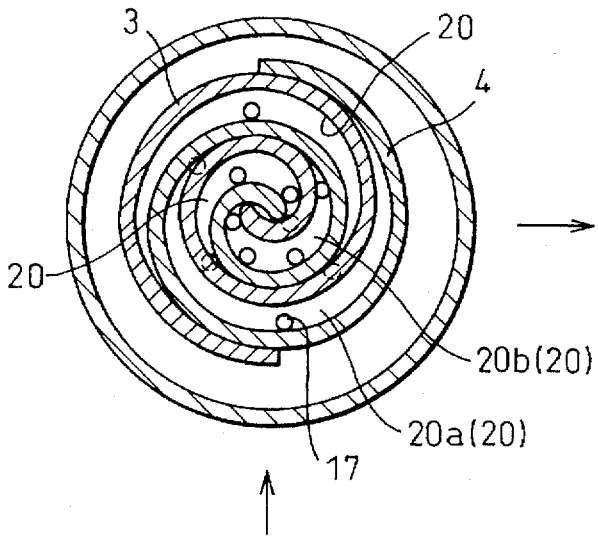
FIGS. 10A through 10D are cross-sectional views taken along the line XI—XI of FIG. 11, illustrating the operation of the stationary and movable scroll units of the compressor according to the third embodiment.
Figure 10B:
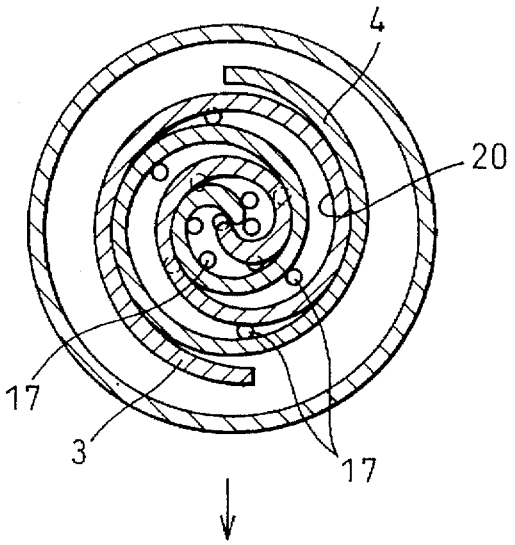
Figure 10D:
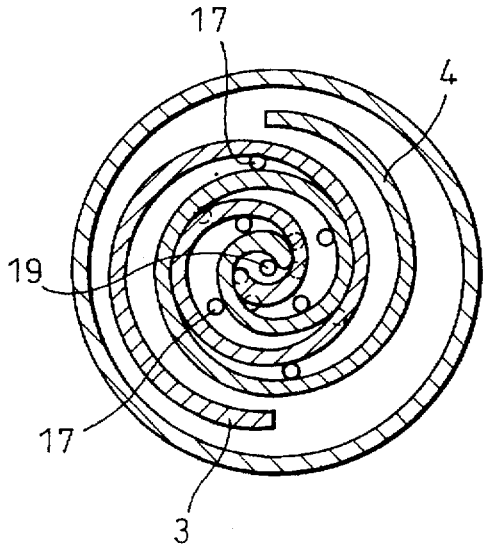
Figure 10C:
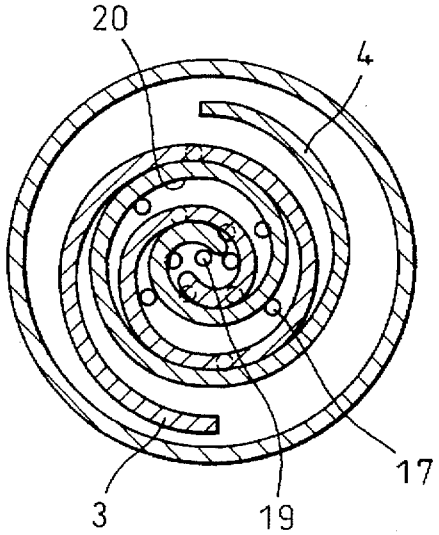

For example, in FIG. 10A, the pocket designated by "20*a*" has the two bypass ports 17, and the pocket designated by "20*b*" and located closer to the center of the spiral element 4*b* of the stationary scroll unit 4 has the four bypass ports 17. Thus, it should be understood that, in response to the movement of the respective pockets 20 toward the center of the stationary scroll unit 4, the entire opening area of the bypass ports 17 for each pocket 20 becomes larger.

Referring to FIG. 11, the scroll-type compressor of the third embodiment is similar to that of the first embodiment shown in FIG. 1 in that the discharge chamber 24 is communicated with a condenser (not shown) of an automobile air-conditioning system via the delivery port 23 and the check valve 31. The suction port 21 opening in the suction chamber 22 is communicated with an evaporator (not shown) of the air-conditioning system. The suction port 21 is also fluidly connected to the delivery port 23 via the fluid channel 32 having a solenoid-operated ON-OFF valve 33. When the solenoid-operated ON-OFF valve 33 is not energized, the suction and discharge ports 21 and 23 are fluidly interrupted by the valve 33 as shown in FIG. 11, and when the solenoid-operated ON-OFF valve 33 is energized, the suction and discharge ports 21 and 23 are fluidly communicated with one another via the open solenoid-operated ON-OFF valve 33.

The operation of the scroll-type refrigerant compressor of the third embodiment is described below.

When the solenoid-operated ON-OFF valve 33 is not energized, the communication between the suction and discharge ports 21 and 23 is interrupted, and an ordinary compressing operation of the compressor is performed by the rotation of the crank shaft 5. Thus, an ordinary discharge pressure prevails in the discharge chamber 24 so as to act on the backs of the respective check valves 15. Therefore, the refrigerant in respective pockets 20 is gradually compressed due to the orbital motion of the movable scroll unit 3 with respect to the stationary scroll unit 4 so that the pressure of the refrigerant reaches a given high pressure level, and then, the refrigerant is discharged from the pocket 20 toward the discharge chamber 24 through the discharge port 19. The refrigerant entering the discharge chamber 24 is subsequently delivered from the discharge chamber 24 toward the condenser of the air-conditioning system via the discharge port 23.

When the solenoid-operated ON-OFF valve 33 is energized so as to provide a fluid communication between the suction and discharge ports 21 and 23, the pressure prevailing in the discharge chamber 24 is equal to the suction pressure prevailing in the suction port 21 and the suction chamber 22. Thus, the suction pressure acts on the back of the respective check valves 15 in the discharge chamber 24. Therefore, the refrigerant in respective pockets 20 is easily discharged from the pockets 20 toward the discharge chamber 24 through the bypass ports 17 or the discharge port 19. The refrigerant discharged toward the discharge chamber 24 is then circulated through the fluid channel 32 and the open solenoid-operated ON-OFF valve 33 toward the suction chamber 22 of the compressor via the suction port 21. Namely, the refrigerant does not circulate through the refrigerating circuit of the air-conditioning system, and the scroll-type refrigerant compressor performs a zero capacity operation.

It should, however, be noted that, during the zero capacity operation of the compressor, the pressure in the respective pockets 20 is slightly increased due to existence of a pressure loss caused by the refrigerant flowing through the bypass ports 17 and the fluid channel 32. As a result, the operation of the compressor should be supplied with a given amount of torque from the drive source, i.e., an automobile engine.

In this respect, in the compressor of the third embodiment of the present invention, the arrangement of the bypass ports 17 is designed in such a manner that the entire opening area of the bypass ports 17 is increased in response to the movement of respective pockets 20 from the outer portion of the stationary scroll unit 4 toward the center thereof, as described before with reference to FIGS. 7 and 10A through 10D.

At this stage, the afore-mentioned angle (angular pitch) $\Delta\theta$ between two neighboring bypass ports 17 is designed so as to be defined by an equation of geometric progression (1) below, $$\Delta\theta_{(n-1)}=\theta_0\times k^{(n-1)} \quad (1)$$

where k is a constant, $\theta_0$ is a given initial value, and n is the number of the bypass ports 17.

Figure 12:
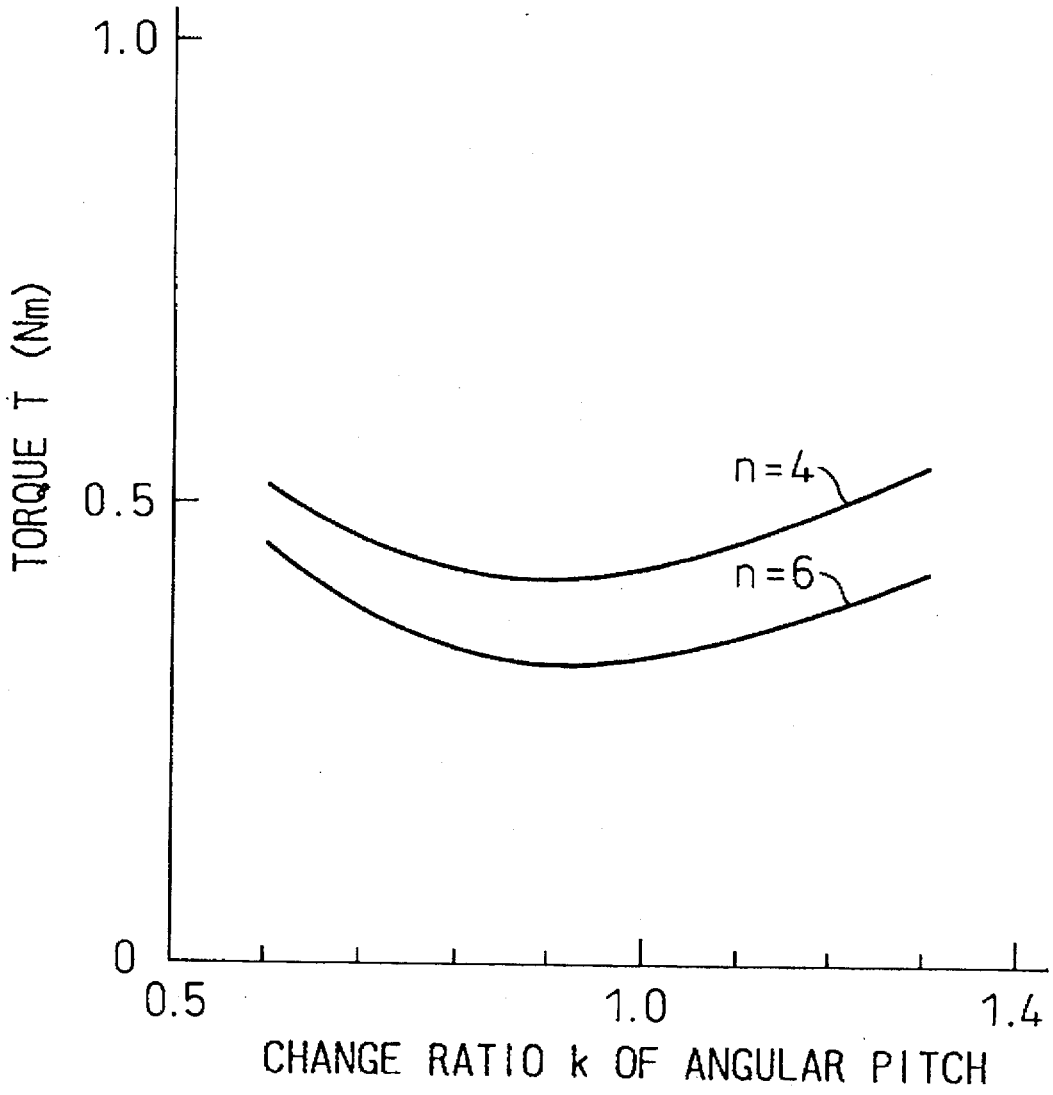
FIG. 12 is a graph illustrating the operation property of the scroll-type compressor according to the third embodiment of the present invention.

When a required torque T(Nm) for driving the compressor of the present embodiment is calculated by choosing k as a parameter, the result of the calculation can be represented by a curve having an extreme point, as shown in FIG. 12. This means that it is possible to select one optimum arrangement of the bypass ports 17, which can minimize the pressure loss during the zero capacity operation of the compressor. As a result, it is possible to operate the compressor without a solenoid clutch between the automobile engine and the compressor.

Figure 13:
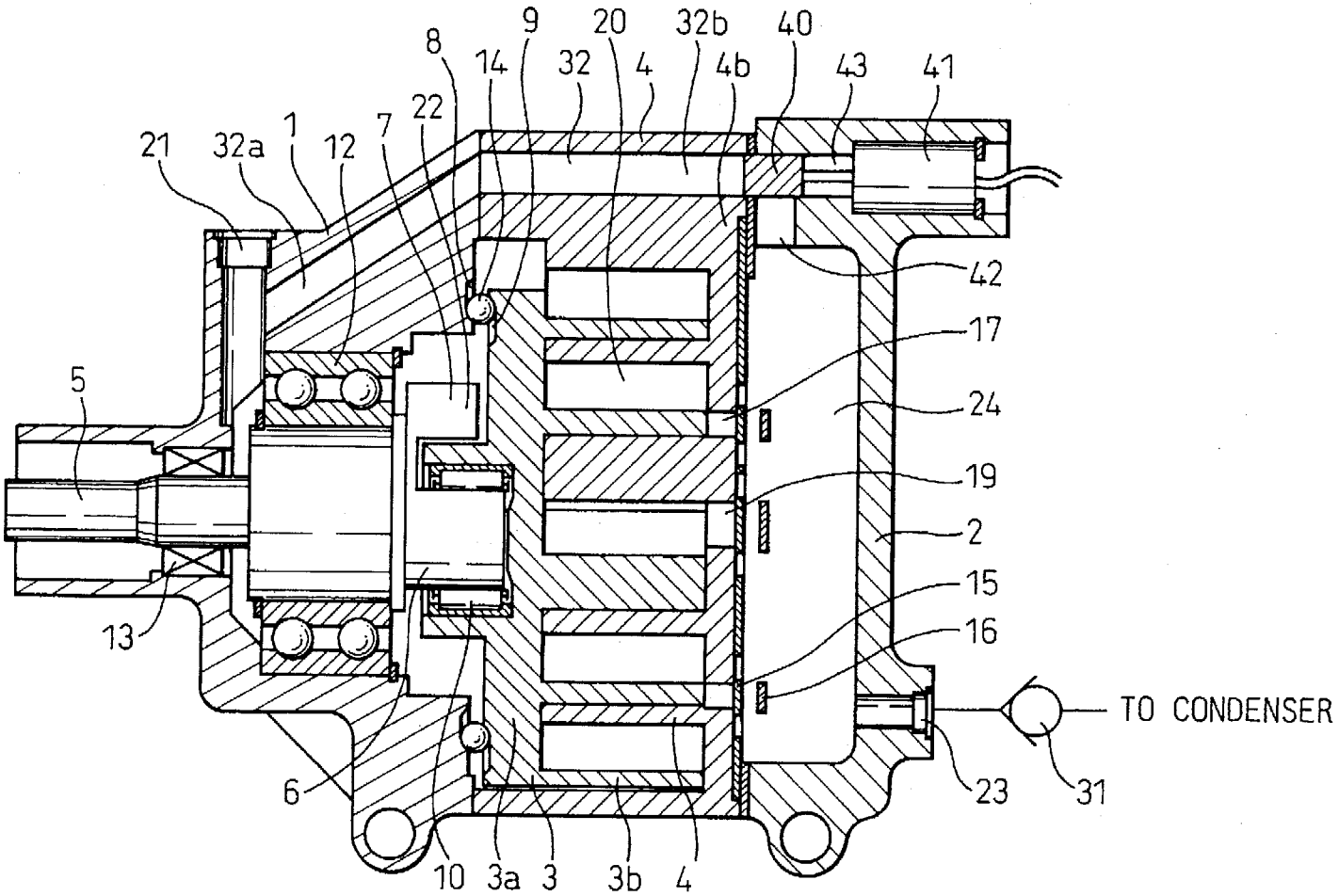
FIG. 13 is a longitudinal cross-sectional view of a scroll-type compressor according to a fourth embodiment of the present invention.

FIG. 13 illustrates a scroll-type refrigerant compressor according to a fourth embodiment of the present invention.

The compressor of the fourth embodiment is characterized in that a fluid channel substantially corresponding to the fluid channel 32 of the third embodiment is arranged in a body of the compressor so as to cooperate with a spool valve unit and a valve actuator.

It should be understood that, in FIG. 13, many portions of the scroll-type compressor which are similar to those of the compressors of the afore-mentioned first embodiment are designated by the same reference numerals as those of the compressor of FIGS. 1 and 2.

In the compressor of the fourth embodiment shown in FIG. 13, the stationary scroll unit 4 is tightly and sealingly sandwiched between the front and rear housings 1 and 2, and combined together by appropriate male threaded bolts (not shown). The stationary scroll unit 4 has an end plate 4*a* in which a plurality of bypass ports 17 and a discharge port 19 are bored to provide a fluid communication between a plurality of pockets 20 and a discharge chamber 24 defined by a rear housing 2. A plurality of check valves 15 and valve retainer plates 16 are arranged in the discharge chamber 24, and are fixed to the end plate 4*a* of the stationary scroll unit 4 by male threaded bolts (not shown). The rear housing 2 having the discharge chamber 24 is provided with a delivery port 23 to fluidly connect the discharge chamber 24 to a condenser (not shown) of an automobile air-conditioning system via a check valve 31. The rear housing is further provided with a radial by-passing port 42 and a valve receiving chamber 43 formed therein, and the radial by-passing port 42 is communicated with the valve receiving chamber 43. The valve receiving chamber 43 receives therein a spool valve 40 which is moved linearly by a valve actuator 41 in a direction for closing and opening an end of the by-passing port 42. Further, the valve receiving chamber 43 has an end thereof fluidly connected to the suction port 21 via a linear channel portion 32*b* of the fluid channel 32 which is formed in the stationary scroll unit 4, and via a different inclined channel portion 32*a* of the fluid channel 32 which is formed in the front housing 1.

The operation of the scroll-type refrigerant compressor of the fourth embodiment will be described below with reference to FIGS. 14A, 14B and 15.

Figure 14B:
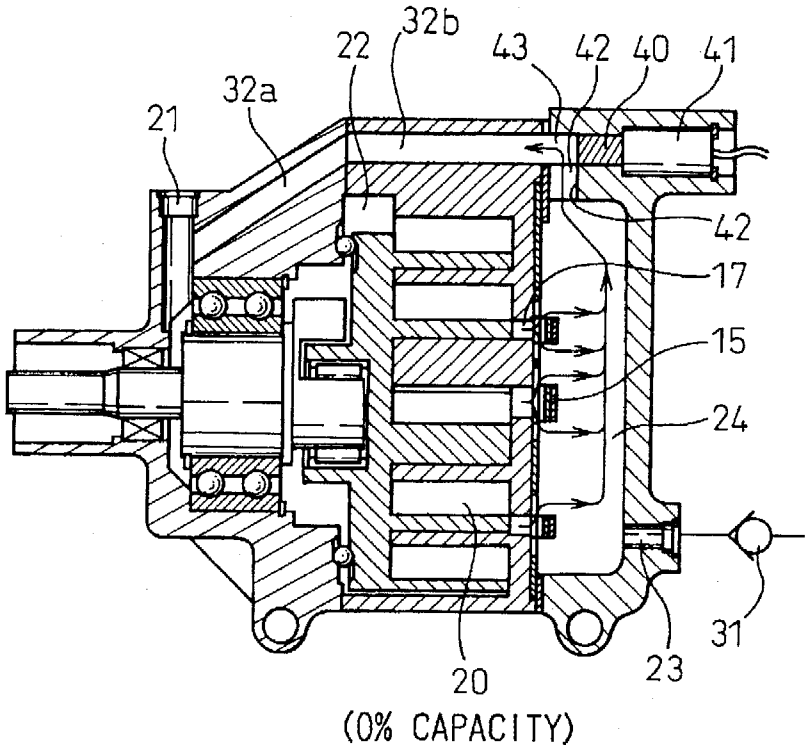
FIGS. 14A and 14B are cross-sectional views of the compressor of FIG. 13, illustrating a 100% capacity operation and a zero capacity operation thereof, respectively.
Figure 14A:
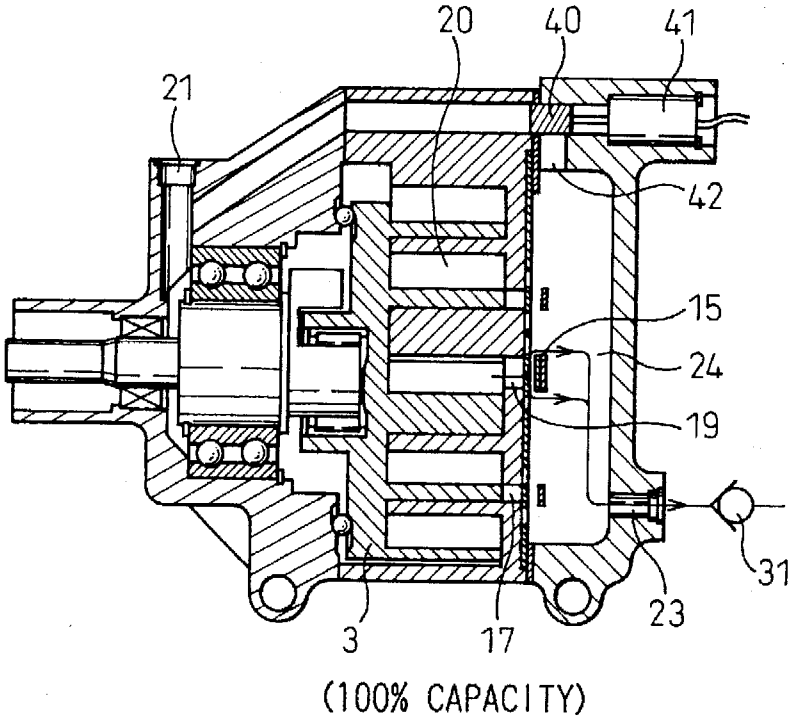

As shown in FIG. 14A, when the spool valve 40 is moved to a position closing the radial by-passing port 42, the compressor is connected to a condenser of the automobile air-conditioning system via the delivery port 23 of the rear housing 2, and to an evaporator of the air-conditioning system. Thus, the compressor carries out an ordinary compressing operation. Accordingly, a high discharge pressure prevails in the discharge chamber 24 and, acts on the back of the respective check valves 15 so as to press the valves 15 against the bypass ports 17 and the discharge port 19. Therefore, the refrigerant sucked into the respective pockets 20 is gradually compressed therein in response to the orbital movement of the movable scroll unit 3 until the compressed refrigerant has a high discharge pressure, and is discharged from the pockets 20 into the discharge chamber 24 via the bypass ports 17 or the discharge port 19. The compressed refrigerant in the discharge chamber 24 is subsequently delivered toward the condenser of the air-conditioning system via the discharge port 23. Then, the refrigerant flows through the refrigerating circuit of the air-conditioning system, including the evaporator from which the refrigerant gas returns to the suction port 21 of the compressor.

When the spool valve 40 is moved by the valve actuator 41 to its open position the radial by-passing port 42 is opened as shown in FIG. 14B, the discharge chamber 24 is fluidly communicated with the suction port 21, via the open radial by-passing port 42, and the fluid channel portions **32*b* and 32*a* of the fluid channel 32. At this stage, due to an arrangement of the check valve 31 between the delivery port 23 and the condenser, the refrigerant in the discharge chamber 24 goes through the radial by-passing port 42, and the fluid channel 32 to the suction port 21 where it is sucked into the suction chamber 22. Since the pressure prevailing in the discharge chamber 24 is substantially equal to that prevailing in the suction chamber 22, the back of the check valves 15 is acted by the pressure substantially equal to the suction pressure. Thus, the check valves 15 are moved toward and away from the bypass ports 17 or the discharge port 19 due to their own elasticity. Therefore, when the refrigerant in the respective pockets 20 has a pressure sufficient for overcoming the elastic pressure of respective check valves 15, these valves 15 are easily opened so as to permit the refrigerant to be discharged from the pockets 20 toward the discharge chamber 24 through the bypass ports 17 or the discharge port 19, and is not compressed. The refrigerant in the discharge chamber 24 is subsequently permitted to flow toward the suction port 21 via the radial by-passing port 42 and the fluid channel 32 (the channel portions 32*a* and 32*b*), and is then sucked into the suction chamber 22. Namely, the refrigerant is not delivered toward the refrigerating circuit of the air-conditioning system from the compressor. Thus, the scroll-type refrigerant compressor performs the zero capacity operation. Thus, the compressor can be switched from the ordinary compressing operation to the zero capacity operation and vice versa by the operation of the spool valve 40**.

The scroll-type refrigerant compressor according to the fourth embodiment of the present is further characterized in that the capacity of the compressor, i.e., the amount of the compressed refrigerant delivered by the compressor can be continuously changed between the zero capacity operation and a 100% capacity operation. The continuous change of the capacity of the compressor is described hereinbelow with reference to FIG. 15.

Figure 15:
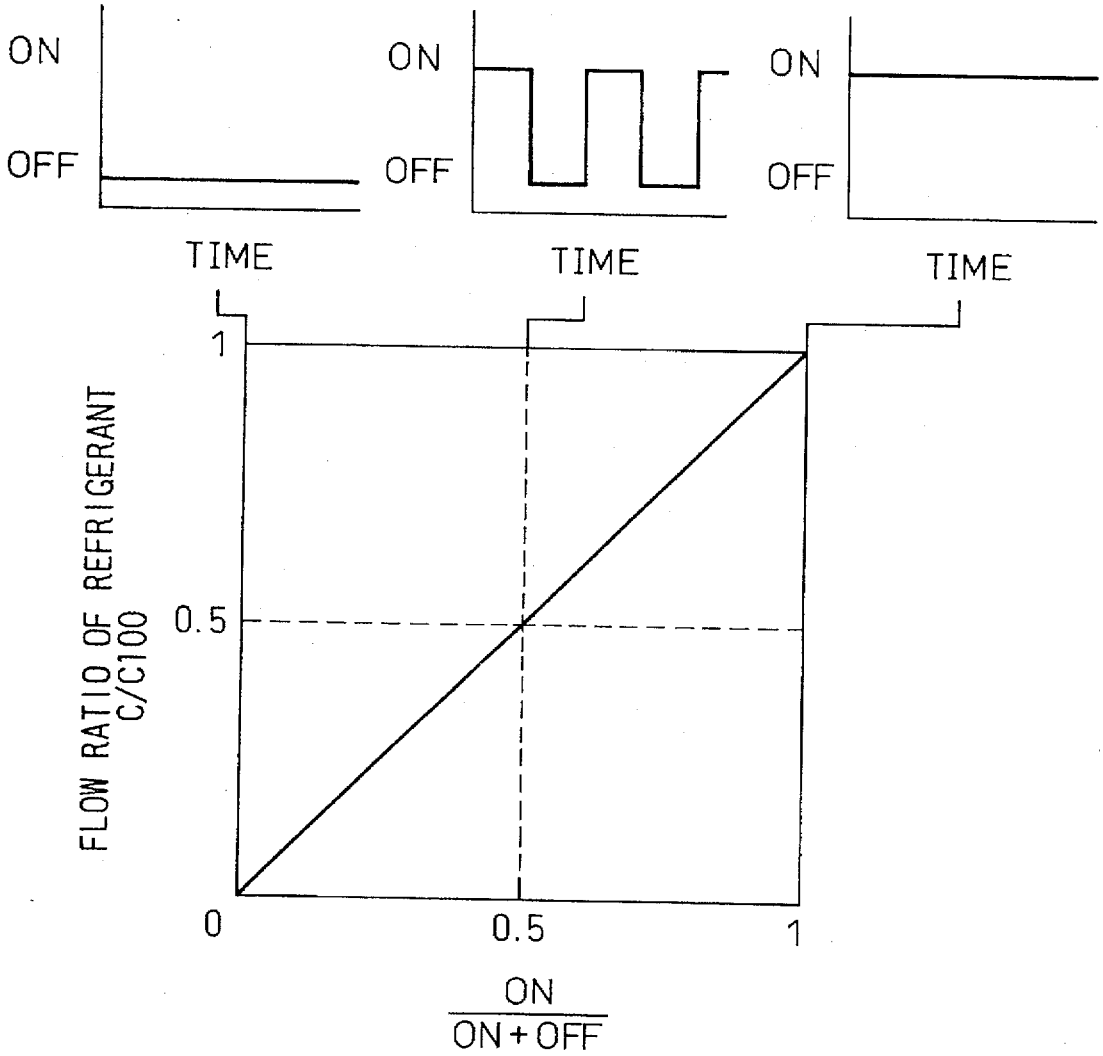
FIG. 15 is a graph and diagram, illustrating an operation for controlling the capacity of the compressor according to the fourth embodiment of the present invention.

In the graph shown in FIG. 15, the coordinate indicates a ratio of an amount of flow of the refrigerant which flows through the refrigerating circuit of the air-conditioning system during the operation of the compressor, with respect to the amount of flow of the refrigerant during the 100% capacity operation of the compressor. Namely, when the compressor is operated at the 100% capacity, the flow amount of the refrigerant is considered as "1", and when the compressor is operated at 0% capacity, the flow amount of the refrigerant is considered as "0".

The abscissa of the graph of FIG. 15 indicates a ratio between a time duration wherein the spool valve 40 closes the radial by-passing port 42 due to the ON of the valve actuator 41 and a time duration wherein the spool valve 40 opens the radial by-passing port 42 due to the OFF of the valve actuator 41.

When the spool valve 40 constantly closes the radial by-passing port 42 due to a constant energization (ON) of the valve actuator 41, the compressor is operated at the 100% capacity, and when the spool valve 40 constantly opens the radial by-passing 42 due to a constant de-energization (OFF) of the valve actuator 41, the compressor is operated at the 0% capacity. Further, when the ratio of the time duration of the ON and OFF of the valve actuator 41 is 1 by 1, i.e., when the ratio of (ON/ON+OFF) is equal to ½, the compressor is operated at a 50% capacity. Therefore, it should be understood from the graph of FIG. 15 that, since the ratio of the time duration of the ON and OFF of the valve actuator 41 is adjustably changed, the operation of the compressor can be adjustably and continuously changed from the 0% capacity to the 100% capacity.

In the capacity change of conventional refrigerant compressors by using a conventional solenoid-operated clutch, the ON-OFF controlling of the solenoid-operated clutch results in a reduction in the operating durability of the clutch, and the response characteristic in the operation of the solenoid-operated clutch is slow relative to the combination of the spool valve 40 and the valve actuator 41 used by the compressor of the fourth embodiment of the present invention. Namely, according to the fourth embodiment, the capacity of the compressor can be easily changed through a sliding movement of the spool valve 40 provided by the valve actuator 41.

In the conventional compressor, a complicated capacity changing mechanism must be provided in the compressor body, and accordingly, the manufacturing cost of the conventional variable capacity type refrigerant compressor for the automobile air-conditioning system is rather high, and the entire size of the conventional variable capacity compressor is large.

To the contrary, the scroll-type refrigerant compressor according to the above-mentioned fourth embodiment can omit a solenoid clutch and incorporation of the plurality of check valves 15, the check valve 31 in the refrigerant delivery circuit, and the combination of the spool valve 40 and the valve actuator 41 permits the compressor to be operated at various capacities, from 0% to 100%, as required. Therefore, a light and small variable capacity scroll-type refrigerant compressor can be obtained at a relatively low manufacturing cost.

Figure 16:
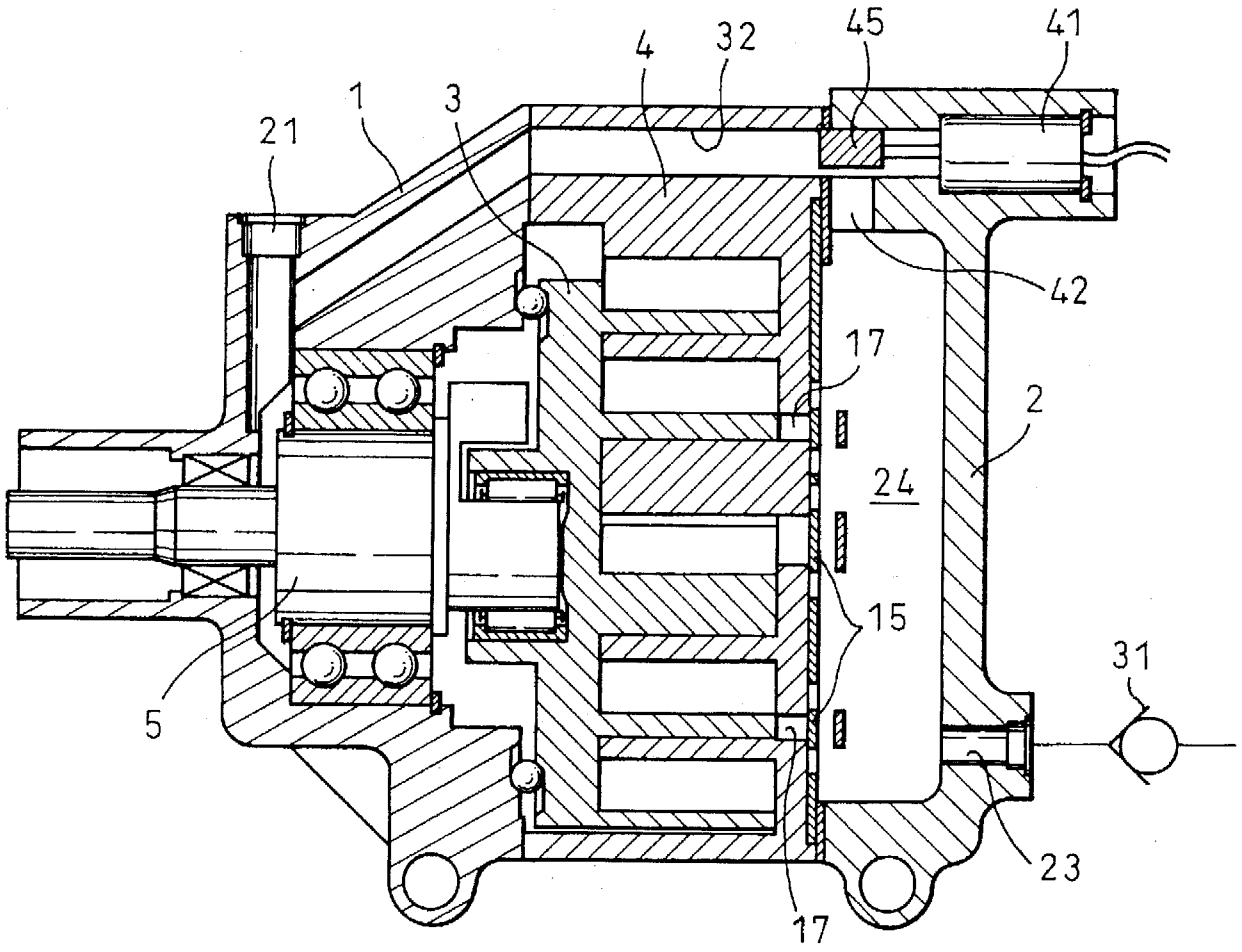
FIG. 16 is a longitudinal cross-sectional view of a scroll-type refrigerant compressor according to a fifth embodiment of the present invention.
Figure 17B:
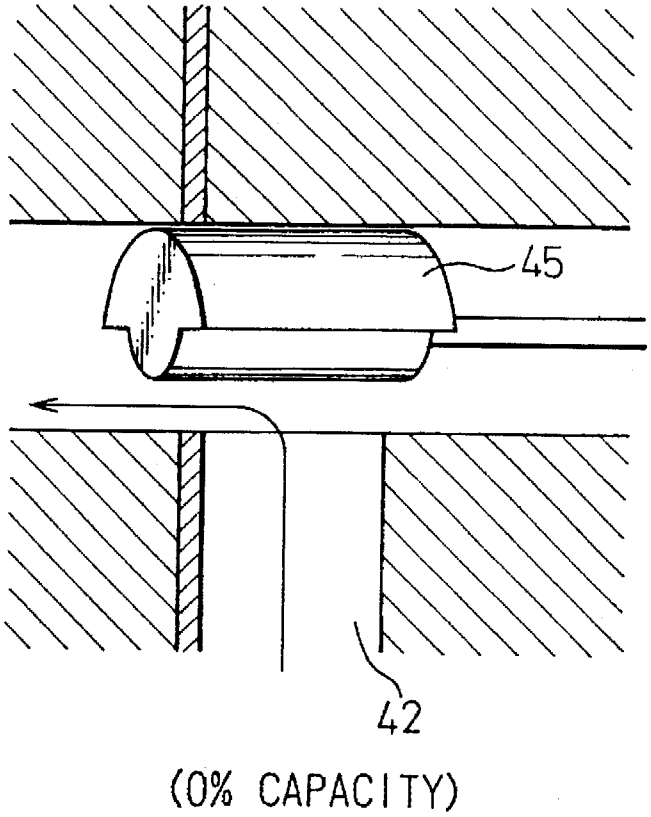
FIGS. 17A and 17B are schematic views of a rotary valve unit accommodated in the compressor of FIG. 16.
Figure 17A:
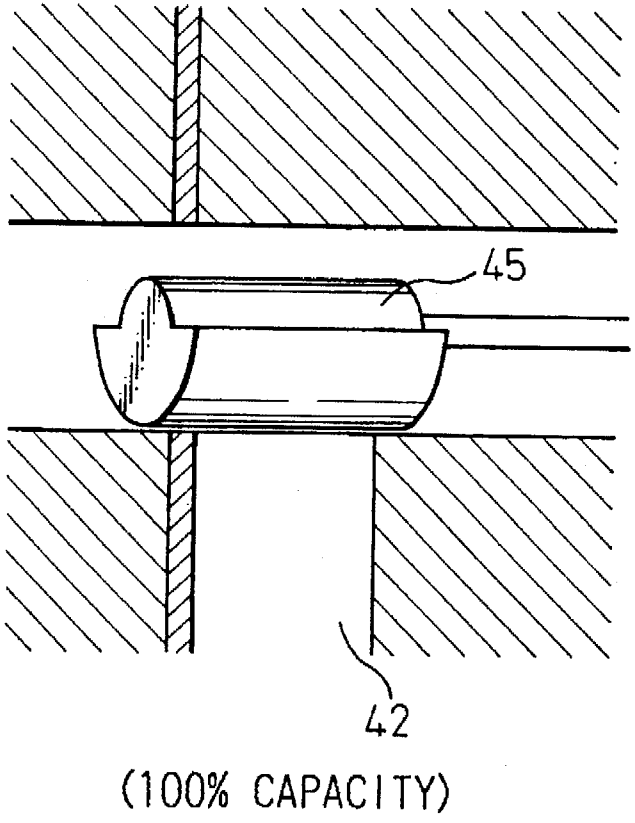

FIGS. 16, 17A, and 17B illustrate a scroll-type refrigerant compressor according to a fifth embodiment of the present invention.

The compressor of the fifth embodiment is different from the compressor of the above-mentioned fourth embodiment in that the spool valve 40 of the fourth embodiment is replaced with a cylindrical rotary valve 45 rotatably actuated by a rotary valve actuator 41. The cylindrical rotary valve 45 is provided with, around the outer circumference thereof, with a reduced diameter portion extending over an entire axial length thereof. Thus, when the cylindrical rotary valve 45 is rotated by the rotary valve actuator 41, and when the reduced diameter portion of the rotary valve 45 is out of registration with the radial by-passing port 42 as shown in FIG. 17A, the port 42 is closed by the outer circumference of the rotary valve 45. When the reduced diameter portion of the rotary valve 45 is rotated to a position in registration with the radial by-passing port 42, the port 42 is opened. Thus, the operation of the compressor of the present embodiment can be switched from 0% capacity to 100% capacity and vice versa.

It should also be understood that, since the rotation of the rotary cylindrical valve 45 to the open and close positions thereof can be controlled by the rotary valve actuator 41 in the same ON-OFF control manner as with the spool valve 40 of the fourth embodiment, the compressor of the fifth embodiment can be a continuously variable capacity scroll-type refrigerant compressor.

Figure 18:
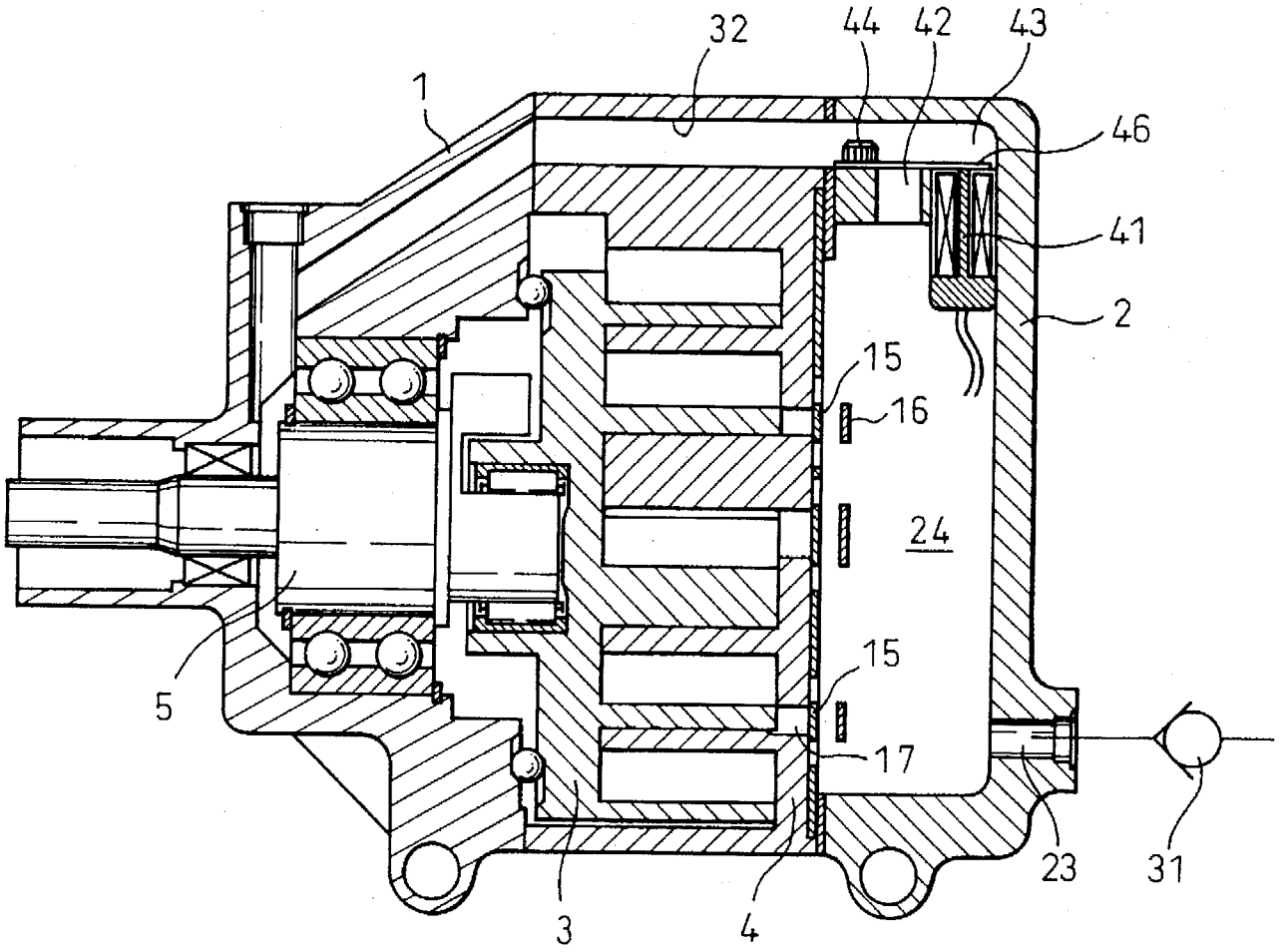
FIG. 18 is a longitudinal cross-sectional view of a scroll-type refrigerant compressor according to a sixth embodiment of the present invention.
Figure 19B:
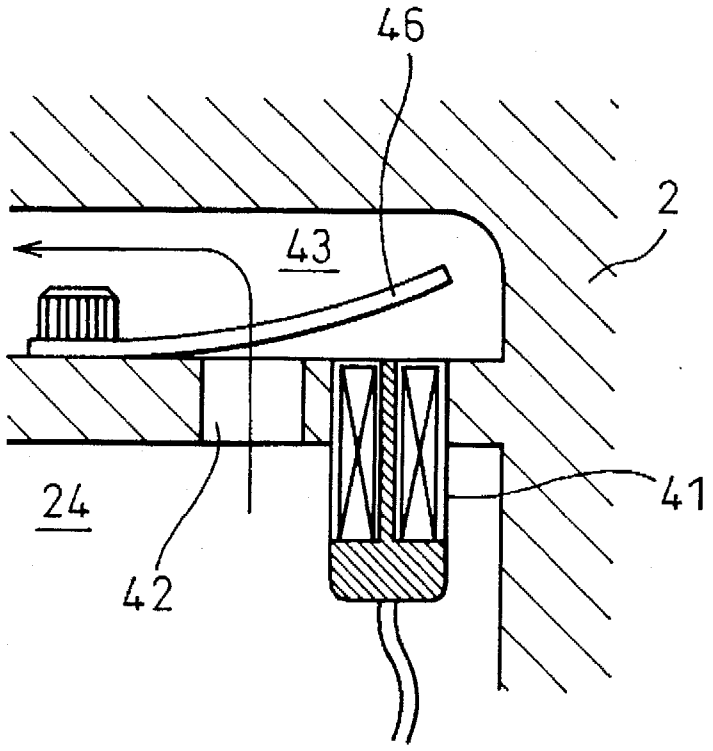
FIGS. 19A and 19B are schematic views of a reed valve unit accommodated in the compressor of FIG. 18 and, operating as a fluid passage control unit.
Figure 19A:
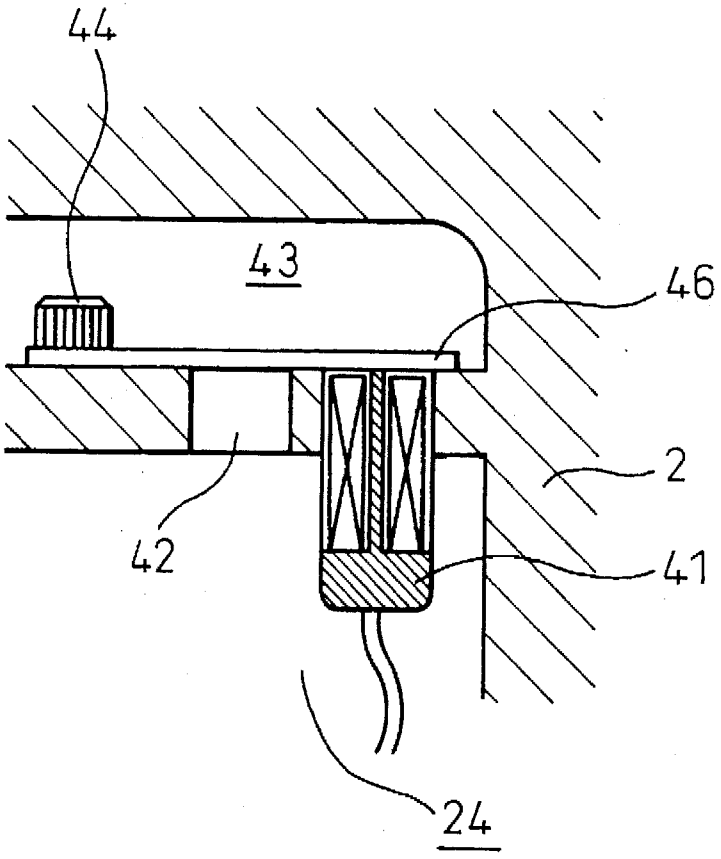

FIGS. 18, 19A, and 19B illustrate a sixth embodiment of the present invention.

The scroll-type compressor of the sixth embodiment is similar to the compressor of the fourth embodiment of FIG. 13, but is different from the latter in that the radial port 42 is opened or closed by a reed valve 46 arranged in the valve receiving chamber 43 and fixed to the rear housing 2 by a male threaded bolt 44. The reed valve 46 can move to an open position away from the radial by-passing port 42 and can be moved to a closed position, in contact with the port 42, by an electro-magnet type valve actuator 41 which is arranged at a position adjacent to a free end of the reed valve 42. Namely, when the electro-magnet is electrically energized, the reed valve 46 is magnetically attracted by the electro-magnet 41 so as to be moved to its close position to thereby interrupt a fluid communication between the suction port 21 and discharge chamber 24. Thus, the compressor can be operated at 100% capacity. When the electro-magnet 41 is de-energized, the reed valve 46 is moved to its open position under a pressure differential between pressures in the discharge chamber 24 and the valve receiving chamber 43. Thus, the compressor can, theoretically, be operated at 0% capacity.

It should be further understood that the compressor of the sixth embodiment can be a continuously variable capacity refrigerant compressor due to the ON-OFF control of the reed valve 46 by the electro-magnet 41 in the same manner as that performed by the fourth and fifth embodiments.

Figure 20B:
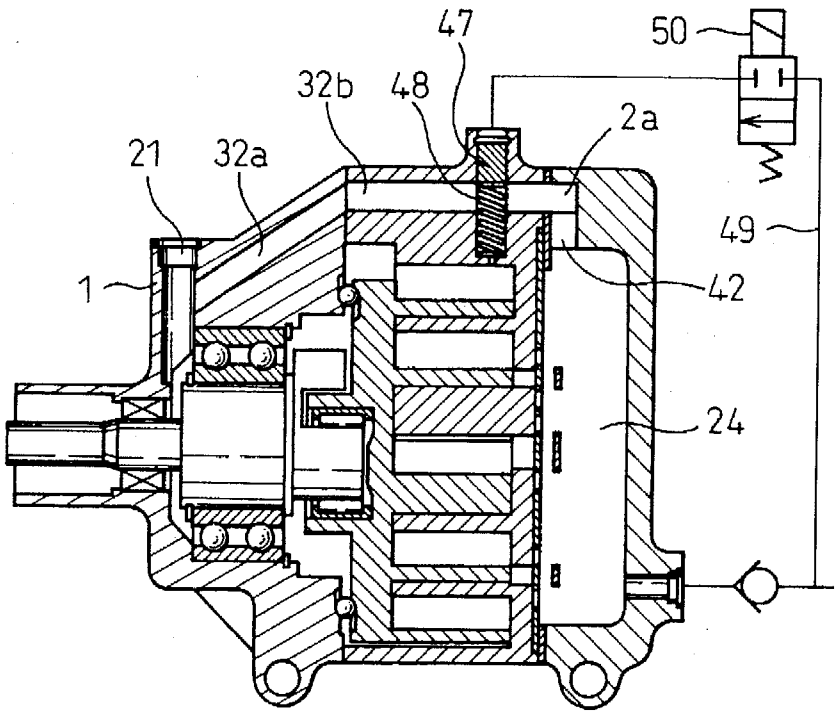
FIGS. 20A and 20B are cross-sectional views of a scroll-type compressor according to a seventh embodiment of the present invention, illustrating a 100% capacity operation and a zero capacity operation thereof, respectively.
Figure 20A:
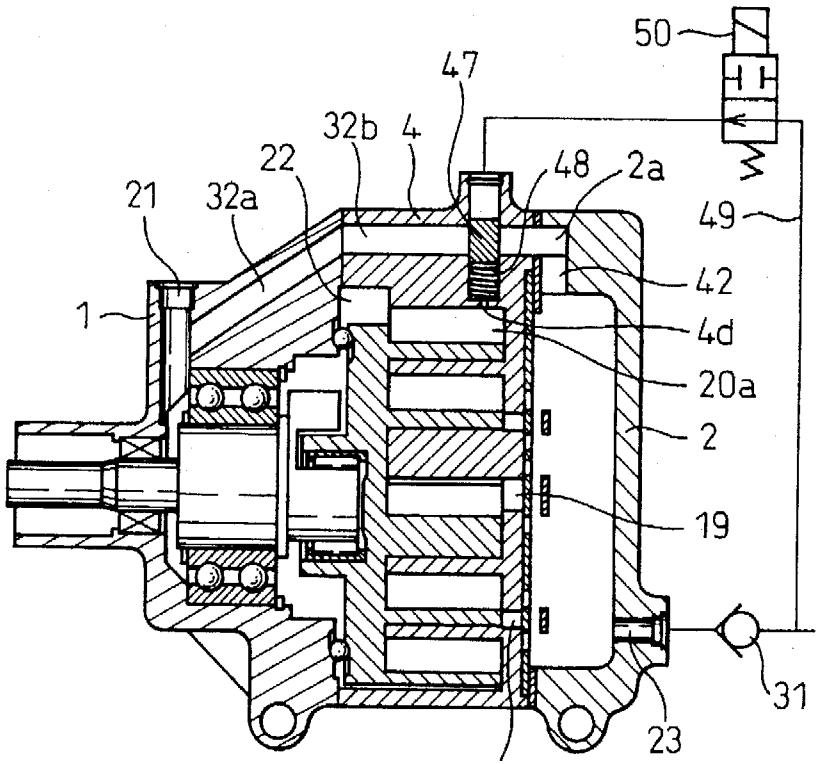

FIGS. 20A and 20B illustrate a seventh embodiment of the present invention.

In the scroll-type refrigerant compressor of the present embodiment, the rear housing 2 is provided with the radial by-passing port 42 and a chamber 2*a* fluidly communicated with the by-passing port 42. The front housing 1 and the stationary scroll unit 4 are provided with fluid channels 32*a* and 32*b* communicated with the above-mentioned chamber 2*a*, and with the suction chamber 22 via the suction port 21. A spool valve 47 is provided in the stationary scroll unit 4 so as to regulate a flow passage of the refrigerant in the fluid channel 32*b*. The spool valve 47 is constantly urged, by a compression spring 48 arranged at an end (inner end) of the spool valve 47, toward a position where the chamber 2*a* provides a fluid communication between the port 42 and the fluid channel 32*b*. The outermost portion of the spiral element 4*b* of the stationary scroll unit 4 is provided with a through-hole 4*d* bored therein, which permits an introduction of a pressure prevailing in the pocket 20*a* which is formed in the outermost portion of the spiral element 4*b*, into the inner end of the spool valve 47. Further, the other end (an outer end) of the spool valve 47 is fluidly connected to a high pressure passageway 49 which introduces a high pressure from the discharge chamber 24 into the outer end of the spool valve 47. A solenoid-operated selector valve 50 is arranged in the high pressure passageway 49 so as to selectively open and close the high pressure passageway 49.

FIG. 20A illustrates the compressor of the seventh embodiment operated at 100% capacity. The solenoid-operated selector valve 50 is moved to its open position where the high pressure passageway 49 is opened. Therefore, a high pressure is introduced so as to act on the outer end of the spool valve 47. Thus, the spool valve 47 is moved to its close position shown in FIG. 20A by overcoming the elastic force of the compression spring 48. Accordingly, the radial by-passing port 42 is fluidly disconnected from the fluid channels 32*a* and 32*b*, and the refrigerant discharged into the discharge chamber 24 via the bypass ports 17 and discharge port 19, is delivered toward the refrigerating circuit of the air-conditioning system via the delivery port 23.

On the other hand, when solenoid-operated selector valve 50 is switched to its close position shown in FIG. 20B, the compressor is operated at 0% capacity. This is because when the high pressure passageway 49 is closed, the high pressure acting on the outer end of the spool valve 47 is gradually released, and the spool valve 47 is moved by the compression spring 48 to its open position providing a fluid communication between the radial by-passing port 42 and the suction port 21 via the fluid channels 32*a* and 32*b*. Thus, the compressor can be operated at the 0% capacity.

FIGS. 21 through 24 illustrate an eighth embodiment of the present invention.

Figure 22:
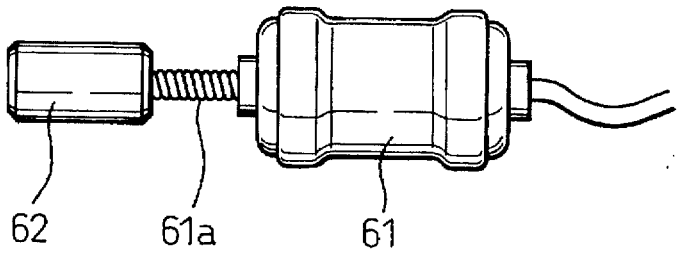
FIG. 22 is a perspective view of an assembly of a spool valve and a drive motor, accommodated in the compressor of FIG. 21.

In the eighth embodiment, the scroll-type refrigerant compressor is provided with an intermediate plate 60 arranged between the rear housing 2 and the stationary scroll unit 4. The intermediate plate 60 separates the discharge chamber 24 into a first discharge chamber 24*a* and a second discharge chamber 24*b* which are communicated with one another by a communicating port 26. A check valve 27 is arranged in the second discharge chamber 24*b*, and attached to the face of the intermediate plate 60 so as to cover the communicating port 26. The first discharge chamber 24*a* can be fluidly communicated with the suction port 21 via an end opening of the first discharge chamber 24*a* and the fluid channel 32. The above-mentioned end opening of the first discharge chamber 24*a* is opened and closed by a slidable spool valve 62 connected to a valve actuator 61 comprised of an electric motor. As shown in FIG. 22, the valve actuator 61 made of the electric motor controls the sliding motion of the spool valve 62 via a rotation-to-linear motion converting mechanism including a threaded portion 61*a*.

Figure 23:
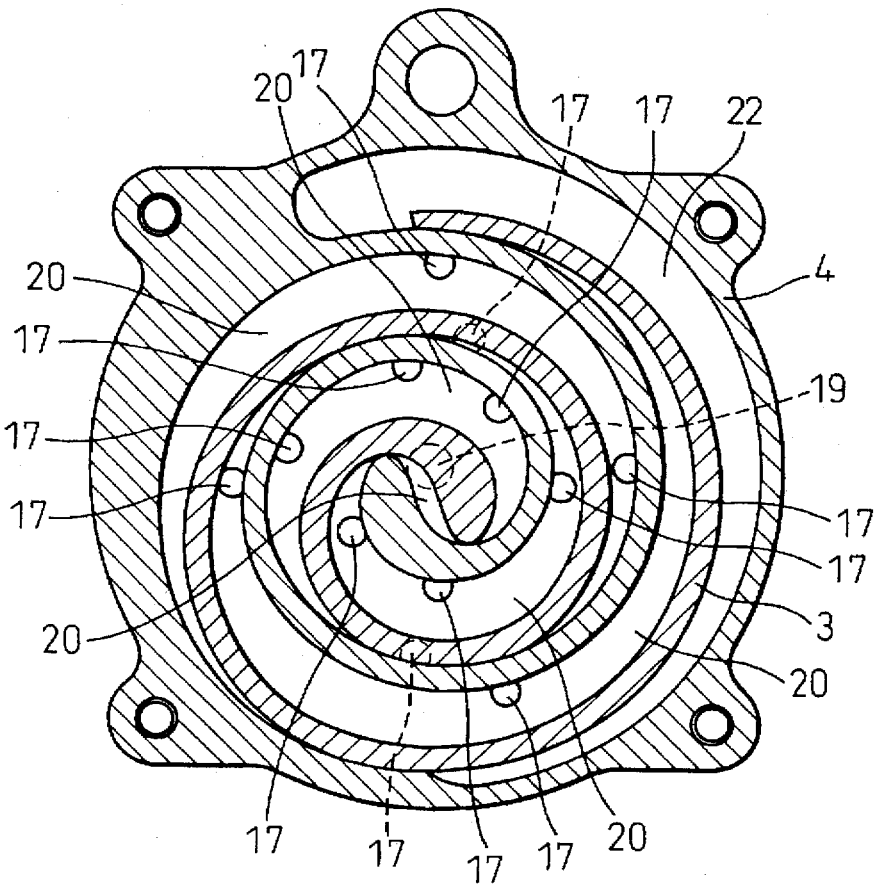
FIG. 23 is a cross-sectional view taken along the line XXIII—XXIII of FIG. 21.

FIG. 23 illustrates an arrangement of the bypass ports 17 which are formed in the end plate 4*b* of the stationary scroll unit 4 so that a plurality of pockets 20 (compression chambers) defined between the movable and stationary scroll units 3 and 4 can communicate with the first discharge chamber 24*a* of the discharge chamber 24 via the bypass ports 17 or the discharge port 19. The bypass ports 17 and the discharge port 19 are covered by the check valves 15 in the same manner as the previous first through seventh embodiments of the present invention.

The operation of the eighth embodiment will be described hereinbelow.

Figure 21:
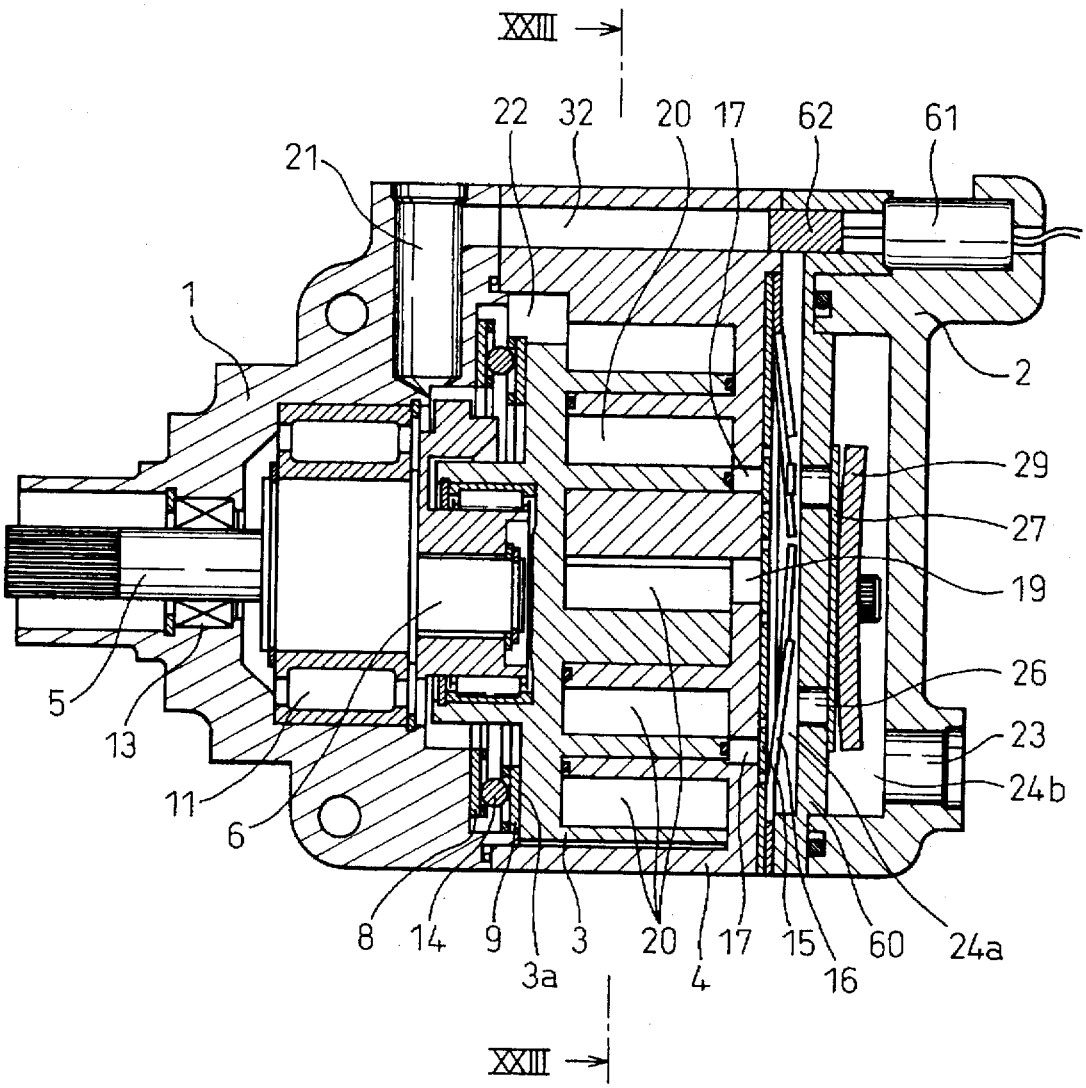
FIG. 21 is a longitudinal cross-sectional view of a scroll-type compressor according to an eighth embodiment of the present invention.

As shown in FIG. 21, when the scroll-type refrigerant compressor of the present embodiment is operated at the 100% capacity due to the disconnection of the first discharge chamber 24*a* from the suction port 21 by the operation of the spool valve 62 which is actuated by the valve actuator 61, a pressure prevailing in the second discharge chamber 24*b* is equal to a condensing pressure in the refrigerating circuit of the air-conditioning system. Further, since the first discharge chamber 24*a* is disconnected from the fluid channel 32 by the spool valve 62, a pressure prevailing in the first discharge chamber 24*a* is in equilibrium with the pressure prevailing in the second discharge chamber 24*b*, i.e., with the condensing pressure in the refrigerating circuit. Thus, the check valves 15 in the first discharge chamber 24*a* is urged against the end face of the stationary scroll unit 4 to thereby cover the bypass ports 17 and the discharge port 19. Therefore, the refrigerant in the respective pockets 20 is gradually compressed due to the orbital motion of the movable scroll unit 3, and is discharged from the pockets 20 toward the first discharge chamber 24*a* via the bypass ports 17 or the discharge port 19. The compressed refrigerant is further discharged from the first discharge chamber 24*a* toward the second discharge chamber 24*b* via the communicating port 26, and is further delivered toward a condenser of the air-conditioning system. The refrigerant is further circulates through the refrigerating circuit of the air-conditioning system and returns the suction port 21 of the compressor.

Figure 24:
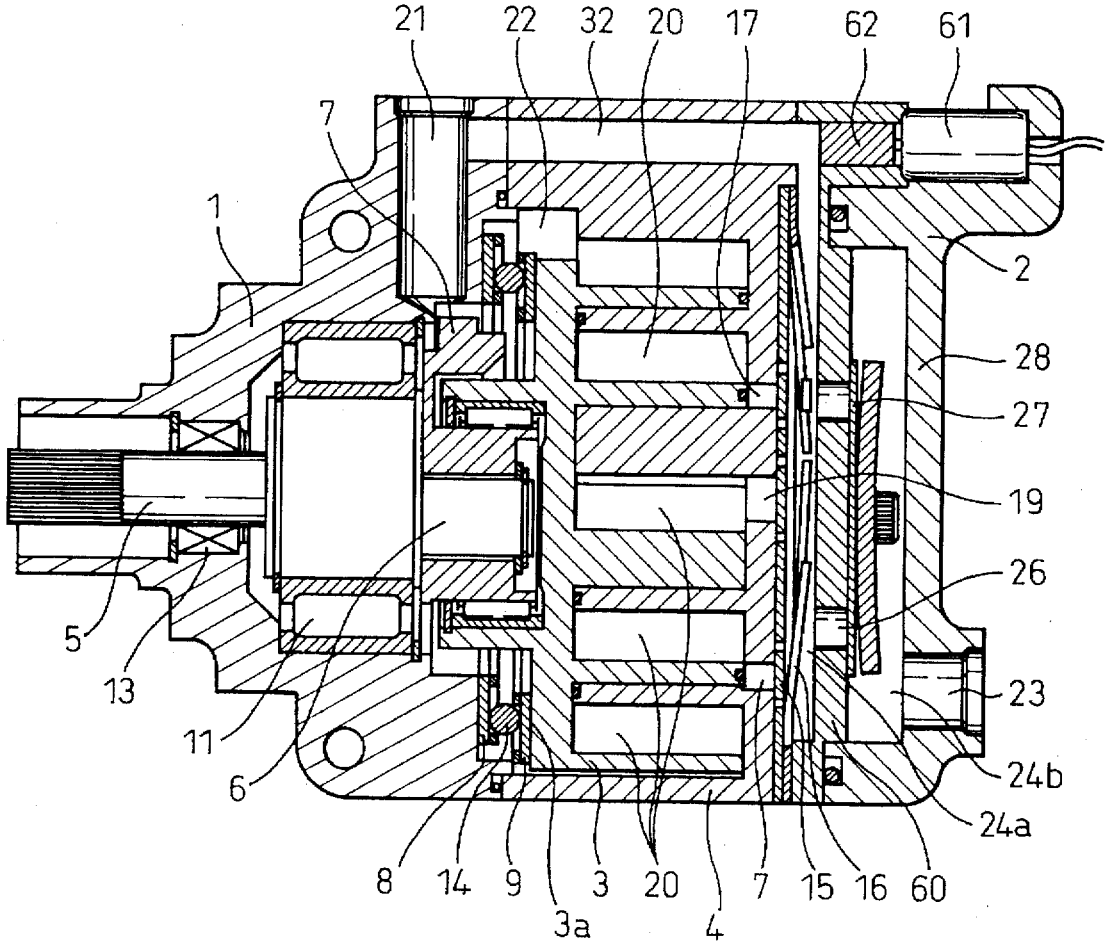
FIG. 24 is a cross-sectional view of the compressor of FIG. 21, illustrating a different operating condition thereof.

As shown in FIG. 24, when the spool valve 62 is moved by the valve actuator 61 to its open position to provide a fluid communication from the first discharge chamber 24*a* to the fluid channel 32, a pressure prevailing in the first discharge chamber 24*a* is in equilibrium with the suction pressure in the suction chamber 22 and the suction port 21. The pressure in the second discharge chamber 24*b* is kept equal to the condensing pressure of the refrigerating circuit, and accordingly, the check valve 27 arranged in the second discharge chamber 24*b* is held at its close position. Thus, the refrigerant in the respective pockets 20 is discharged into the first discharge chamber 24*a*, and is directly delivered toward the fluid channel 32. The refrigerant in the fluid channel 32 then flows toward the suction port 21 through which the refrigerant returns the suction chamber 22. Thus, the compressor is operated at 0% capacity. Since the check valves 15 are not subjected to a high pressure, the refrigerant in the respective pockets 20 cannot be compressed, and accordingly, the refrigerant under a low pressure is discharged from the respective pockets 20 toward the first discharge chamber 24*a* via the by-passing and discharge ports 17 and 19.

In the eighth embodiment, when the operation of the compressor is switched from the ordinary 100% capacity to the 0% capacity, return of the refrigerant under a high pressure from the first discharge chamber 24*a* to the suction port 21 should be preferably prevented. Thus, the first discharge chamber 24*a* is designed to have the smallest possible volume.

Figure 25:
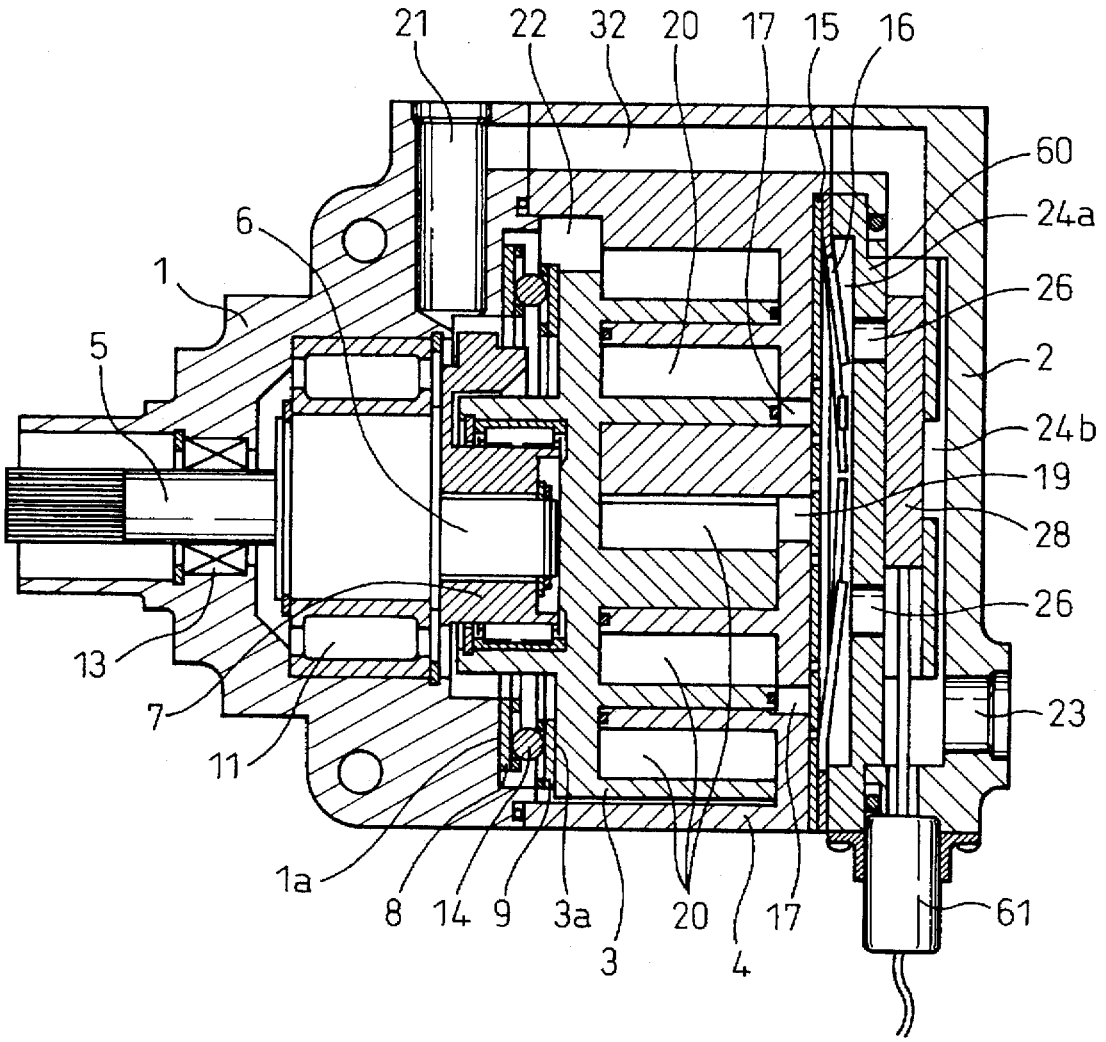
FIG. 25 is a longitudinal cross-sectional view of a scroll-type refrigerant compressor according to a ninth embodiment of the present invention, illustrating the 100% capacity operation of the compressor.
Figure 26:
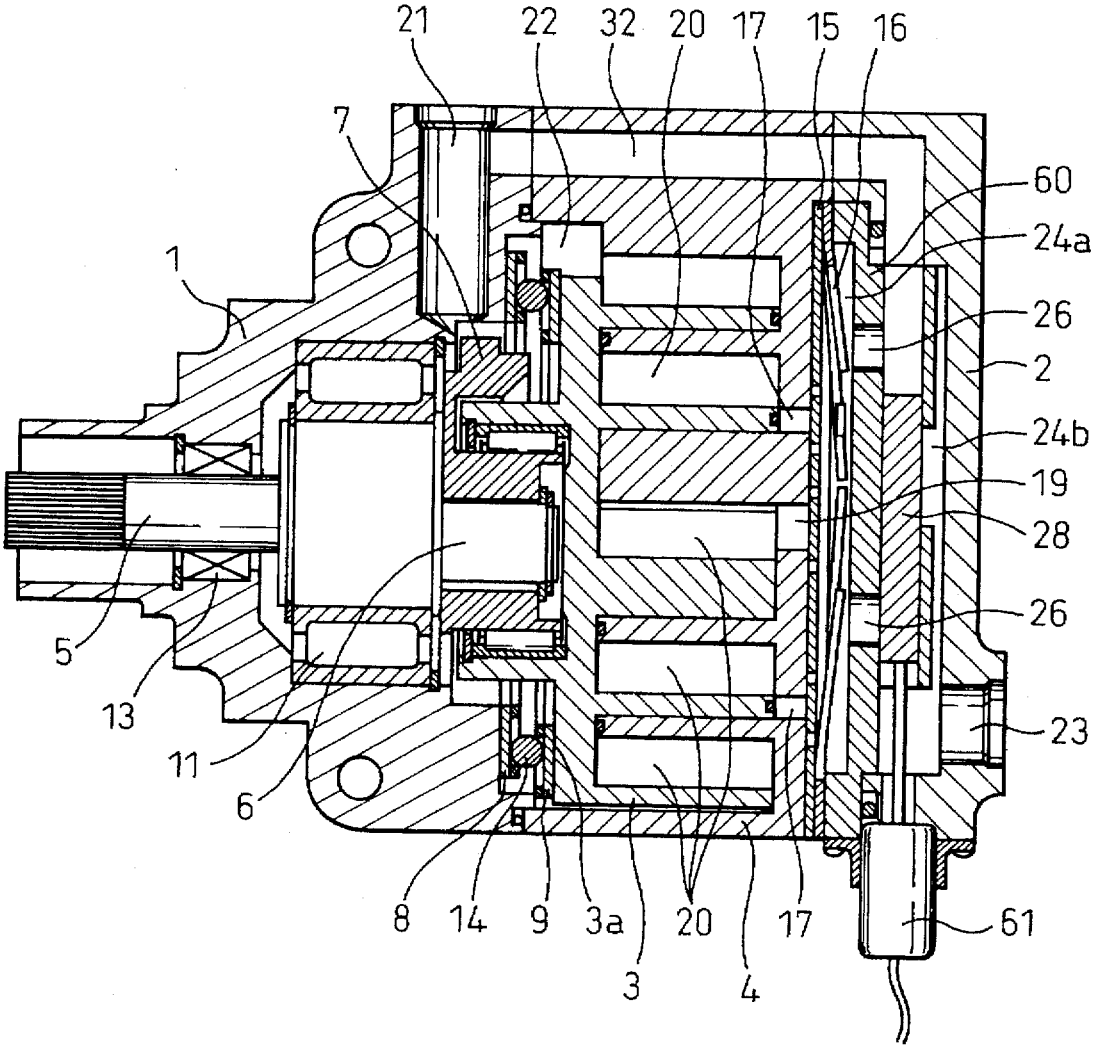
FIG. 26 is the same cross-sectional view as FIG. 25, illustrating the 0% capacity operation of the compressor of the ninth embodiment.
Figure 27:
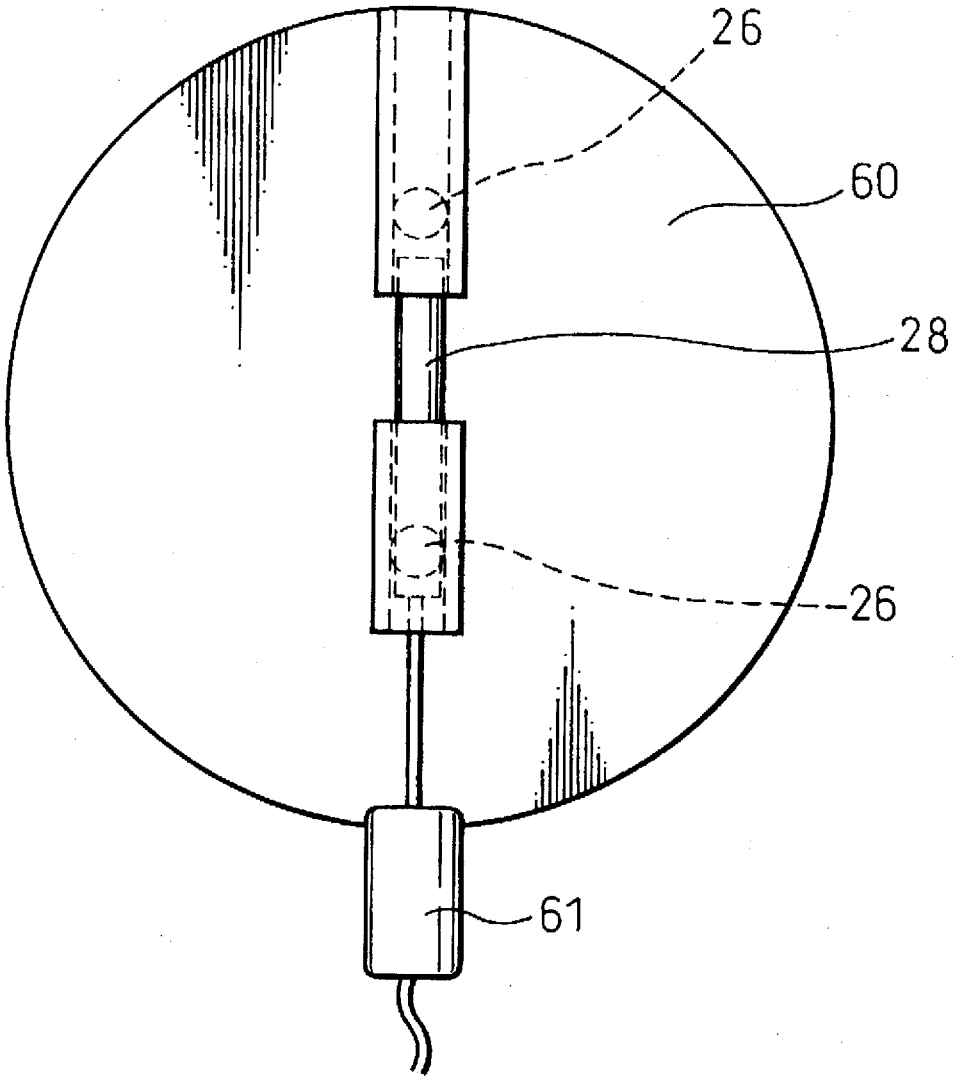
FIG. 27 is a side view illustrating an assembly of a spool valve and a drive motor, accommodated in the compressor of the ninth embodiment of the present invention.

FIGS. 25 through 27 illustrate a ninth embodiment of the present invention.

In the above-mentioned scroll-type refrigerant compressor of the eighth embodiment, the first and second discharge chambers 24*a* and 24*b* are separated from one another by the intermediate plate 60 and the check valve 27 arranged in the second discharge chamber 24*b*. At this stage, the check valve 27 is provided for preventing the high pressure refrigerant from flowing from the second discharge chamber 24*b* toward the first discharge chamber 24*a* during the 0% capacity operation of the compressor. Therefore, the check valve 27 of the eighth embodiment can be replaced with a spool valve 28 as shown in FIG. 25.

In the compressor of the ninth embodiment, shown in FIGS. 25 through 27, when the spool valve 28 is moved upward by an actuator 61 so as to provide a fluid communication between the first and second discharge chambers 24*a* and 24*b* via one of a pair of intermediate ports 26, i.e., the lower intermediate port 26, and to interrupt a fluid communication between the first discharge chamber 24*a* and the suction chamber 22 by the closing of the upper one of the pair of intermediate ports 26. Thus, the compressor can be operated at 100% capacity.

When the spool valve 28 is moved downward as shown in FIGS. 26 and 27, the compressor is switched from the 100% capacity to the 0% capacity. Namely, the first and second discharge chambers 24*a* and 24*b* are fluidly disconnected from one another, and the first discharge chamber 24*a* is fluidly connected to the suction chamber 22 via the upper intermediate port 26, the fluid channel 32, and the suction port 21.

It should be understood that the spool valve 28 and the valve actuator 61 are received in a chamber formed in the intermediate plate 60.

Figure 28:
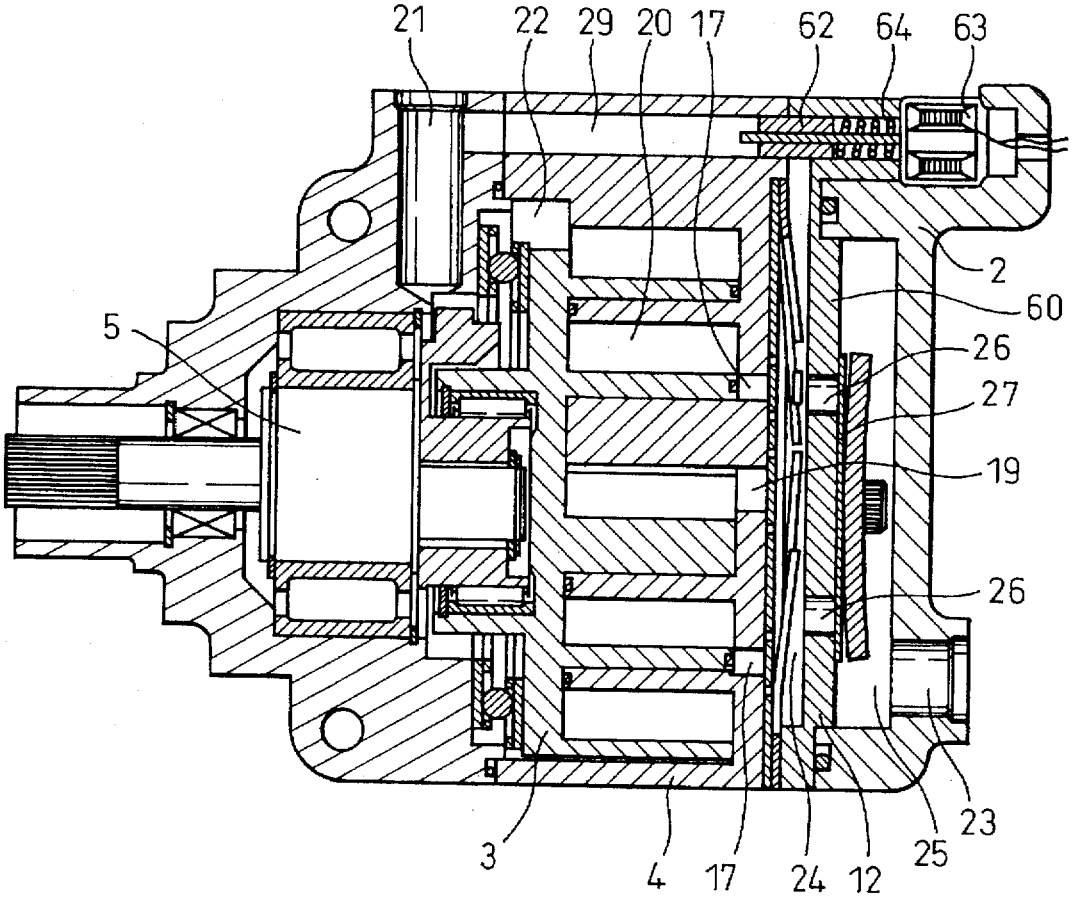
FIG. 28 is a longitudinal cross-sectional view of a scroll-type refrigerant compressor according to a tenth embodiment of the present invention.
Figure 29:
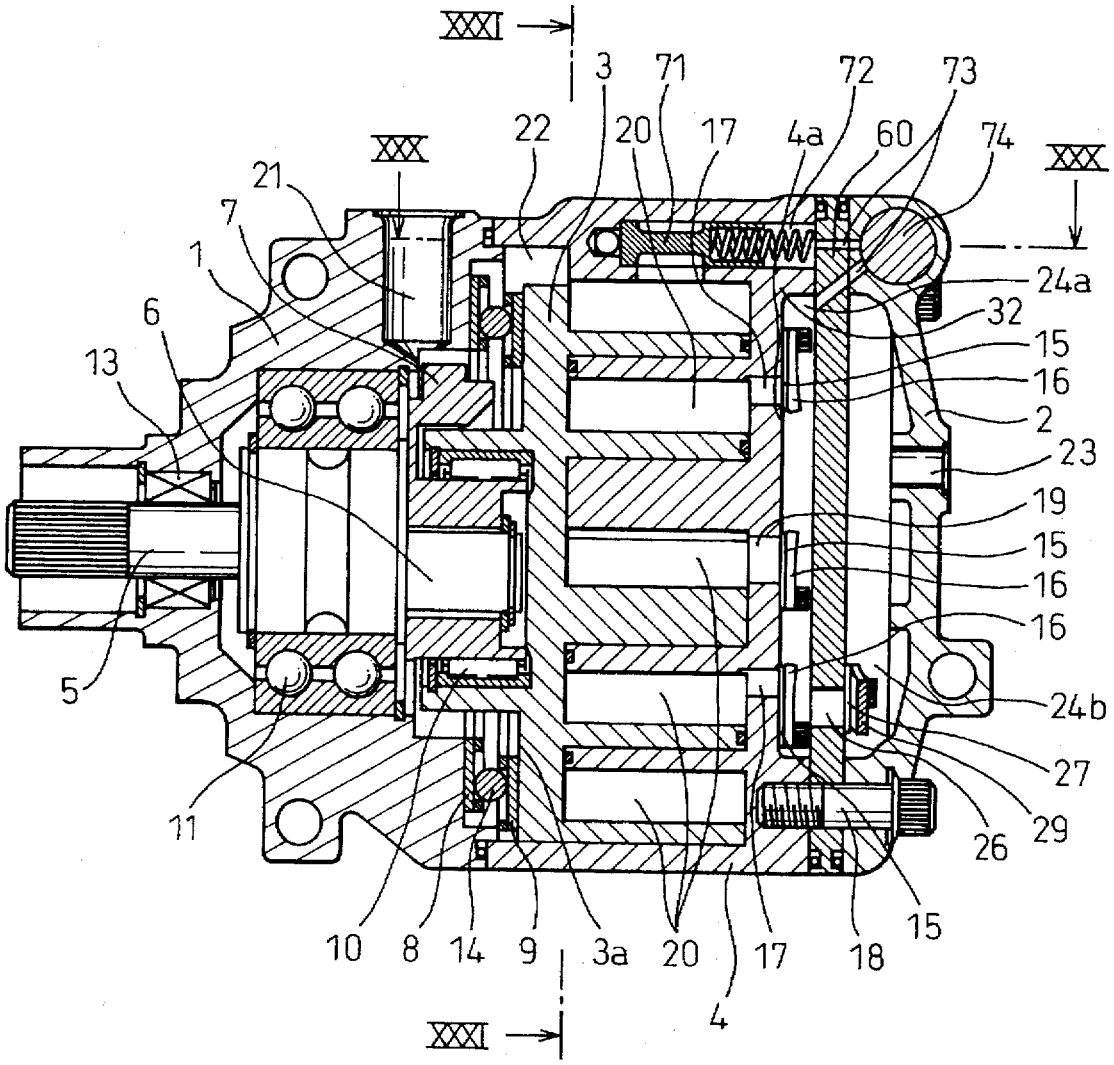
FIG. 29 is a longitudinal cross-sectional view of an eleventh embodiment of the present invention, illustrating a detailed internal construction thereof.

FIG. 28 illustrates a tenth embodiment of the present invention.

The scroll-type refrigerant compressor of the present embodiment is different from that of the eighth and ninth embodiments in that a spool valve 62 is arranged to be actuated by a valve actuator consisting of an electro-magnet 63 and a compression spring 64.

Further, the compressor of the present embodiment is improved over the compressor of the first embodiment shown in FIGS. 1 through 5B. Namely, in the first embodiment, the solenoid valve 33 is used for switching from the 100% capacity operation of the compressor to the 0% capacity operation and vice versa. Thus, when the solenoid valve 33 is moved to its open position, the entire amount of the high pressure refrigerant in the discharge chamber 24 is by-passed toward the suction chamber 22 through the solenoid valve 33. Thus, it is necessary that the solenoid valve 33 has a large flow capacity. Accordingly, the solenoid valve 33 is necessarily large and heavy. Moreover, when the compressor is operated at a high speed during 0% capacity operation thereof, the amount of refrigerant flowing through the solenoid valve 33 is large, and accordingly, a pressure loss in the solenoid valve 33 is large, and in turn a pressure loss of the refrigerant in the fluid channel 32 is large. As a result, a pressure prevailing in the discharge chamber 24 is larger than that prevailing in the suction chamber 22. Thus, the operation of the compressor applies an unfavorable load to a drive source of the compressor, i.e., an automobile engine.

The scroll-type refrigerant compressor according to the tenth embodiment is constructed so as to eliminate the above-mentioned unfavorable problem encountered by the scroll-type compressor of the first embodiment.

The compressor of the eleventh embodiment will be described in detail with reference to FIGS. 29 through 33.

The compressor is provided with an intermediate plate 60 arranged between the stationary scroll unit 4 and the rear housing 2, and a first discharge chamber 24*a* and a second discharge chamber 24*b* are defined by the intermediate plate 60 in the same manner as the eighth embodiment of FIGS. 21 and 22. The intermediate plate 60 is provided with intermediate ports 26 bored therein to provide a communication between the first and second discharge chambers 24*a* and 24*b*. The intermediate ports 26 are covered by check valves 27 and valve retainers 29. The check valves 27 and the valve retainers 29 are arranged in the second discharge chamber 24*b* and are fixed to the intermediate plate 60 by appropriate male threaded bolts.

Figure 30:
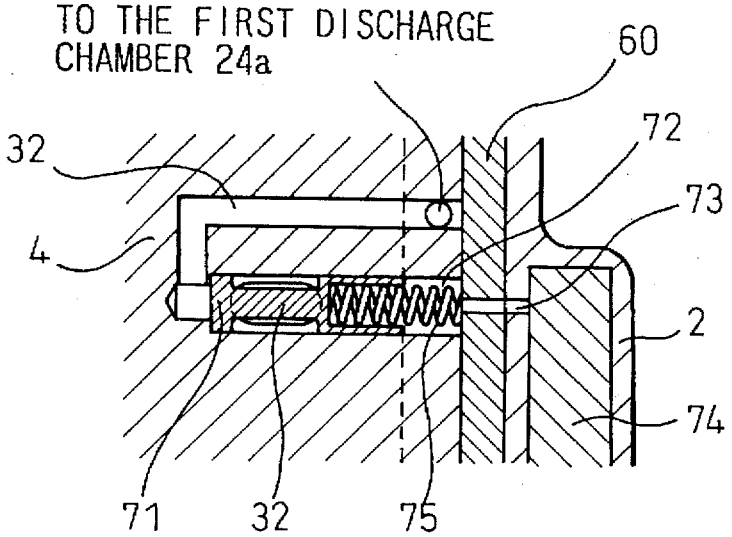
FIG. 30 is a cross-sectional view of a control unit accommodated in the scroll-type refrigerant compressor of the eleventh embodiment of the present invention.

As shown in FIG. 30, the first discharge chamber 24*a* is fluidly communicated with the suction chamber 22 via the fluid channel 32 which can be blocked and unblocked by a linearly movable spool valve 71. A control chamber 72 is arranged at the rear side of the spool valve 71, and is fluidly connected to the first discharge chamber 24*a* via a control-pressure passageway 73. The control-pressure passageway 73 is blocked and unblocked by solenoid valve 74 received in the rear housing 2. A compression spring 75 is arranged in the control chamber 72 so as to apply an elastic pressure to a rear end of the spool valve 71.

The rear housing 2 is provided with a delivery port 23 fluidly connected to a condenser in the refrigerating circuit of an automobile air-conditioning system.

Figure 31:
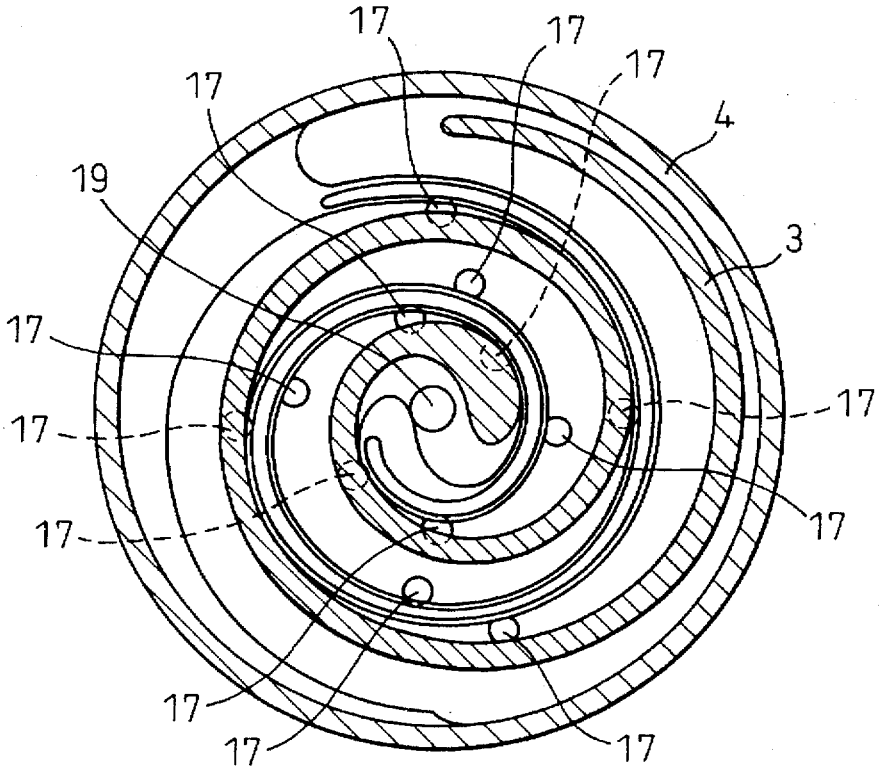
FIG. 31 is a cross-sectional view taken along the line XXXI—XXXI of FIG. 29.
Figure 32:
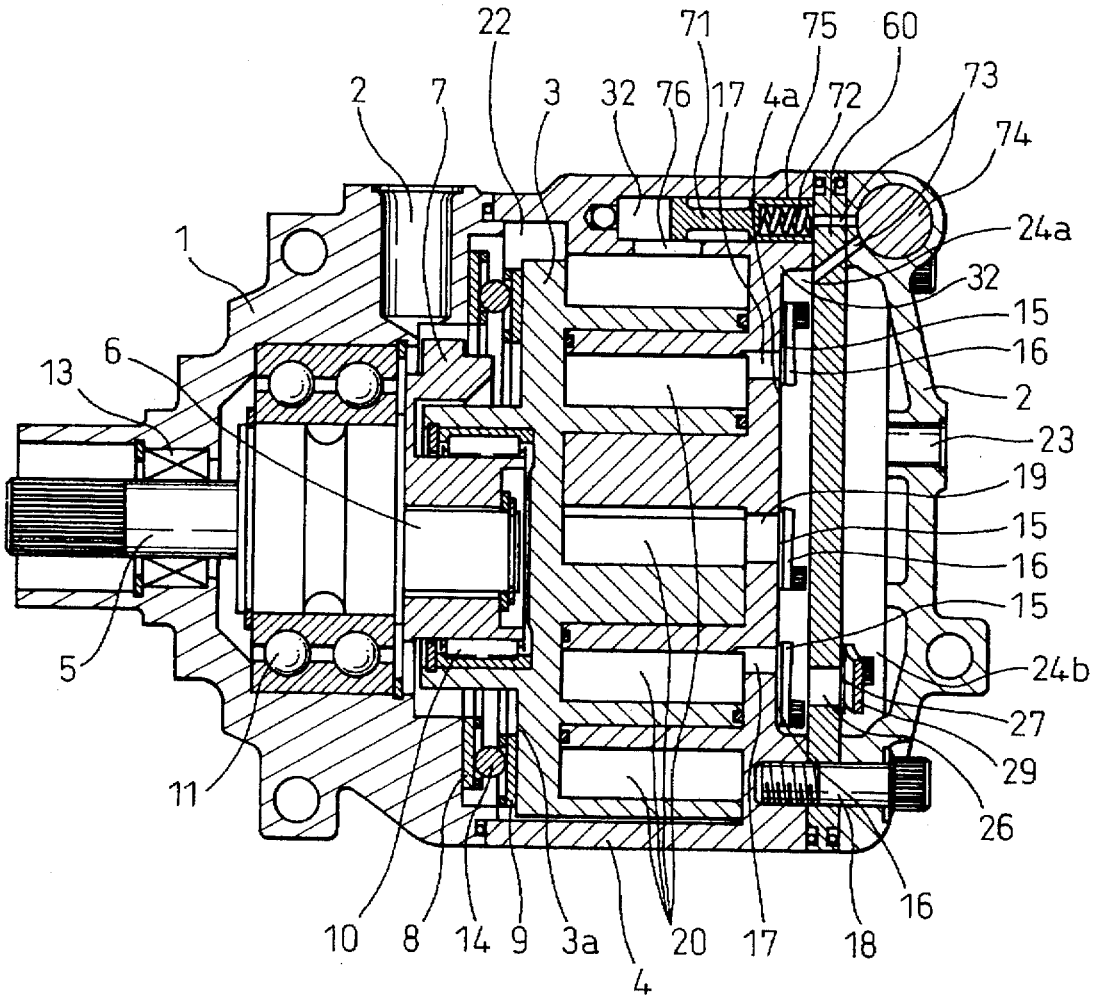
FIG. 32 is a different cross-sectional view of the compressor of the eleventh embodiment of the present invention, illustrating the 0% capacity operation thereof.
Figure 33:
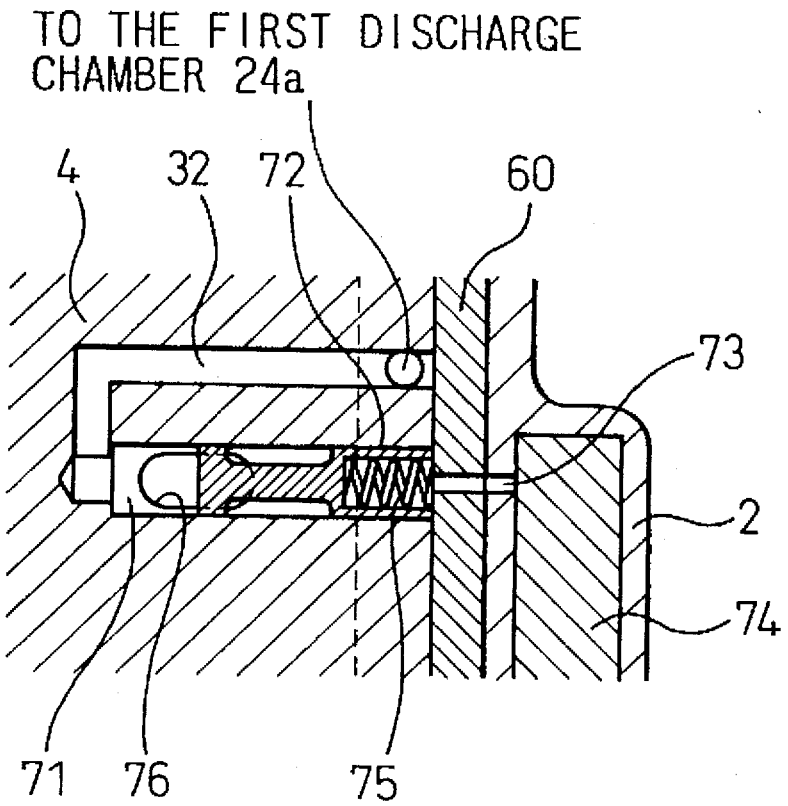
FIG. 33 is the same cross-sectional view as FIG. 30, illustrating the control unit at the 0% capacity operation of the compressor.

Referring to FIG. 31, an arrangement of a plurality of bypass ports 17 and a discharge port 19 is illustrated. Namely, the bypass ports 17 and the discharge port 19 are arranged so that the pockets 20 between the movable and stationary scroll units 3 and 4 can be communicated with the first discharge chamber 24*a* via the bypass ports 17 or the discharge port 19 during the movement of the pockets 20 from the outer portion of the stationary scroll unit 4 to the center thereof.

In the described compressor of the eleventh embodiment, when the control-pressure passageway 73 is unblocked by the solenoid valve 74, a discharge pressure acts on the opposite ends of the spool valve 71, and accordingly, the spool valve 71 is not subjected to a pressure differential. Thus, the spool valve 71 is moved by the spring force of the compression spring 75 to the position shown in FIG. 29 to close the fluid channel 32. Therefore, the compressor is operated at an ordinary 100% capacity. Since the second discharge chamber 24*b* is communicated with the condenser of the refrigerating circuit, a pressure equal to the discharge or condensing pressure prevails in the second discharge chamber 24*b*. At this stage, since the fluid channel 32 is closed, the pressure in the first discharge chamber 24*a* is increased to the condensing pressure equal to that in the second discharge chamber 24*b*. Therefore, the check valves 15 in the first discharge chamber 24*a* are pressed against the bypass ports 17 and the discharge port 19 by the high condensing pressure. Accordingly, the refrigerant in the respective pockets 20 is gradually compressed in response to the movement of the pockets 20 toward the center of the stationary scroll unit 4. Thus, when the refrigerant is sufficiently compressed in the respective pockets 20 to have a discharge pressure, it is discharged from the pockets 20 toward the first discharge chamber 24*a* and to the second discharge chamber 24*b* via the bypass ports 17 or the discharge port 19. When the refrigerant is discharged into the second discharge chamber 24*b*, it is then delivered toward the condenser of the refrigerating circuit of the automobile air-conditioning system. The refrigerant then flows through the refrigerating circuit and returns the compressor via the suction port 21. At this stage, since the amount of the refrigerant flowing through the solenoid valve 74 is small, the solenoid valve 74 can be small.

When the solenoid valve 74 blocks the control-pressure passageway 73, the refrigerant in the control pressure chamber 72 gradually leaks therefrom toward the suction chamber 22, and the pressure in the control pressure chamber 72 is reduced to the suction pressure. Thus, a pressure differential appears so as to act on the opposite ends of the spool valve 71, and the spool valve 71 is moved to the position shown in FIGS. 32 and 33, against the elastic force of the compression spring 75 to unblock the fluid channel 32. Thus, a pressure in the first discharge chamber 24*a* comes into an equilibrium with the pressure in the suction chamber 22. Nevertheless, the pressure in the second discharge chamber 24*b* is maintained at the discharge pressure, and accordingly, the check valves 27 arranged in the second discharge chamber 24*b* stay closed. Thus, the refrigerant discharged from the respective pockets 20 is sent directly toward the suction chamber 22 via the fluid channel 32. Namely, the compressor is operated at 0% capacity.

At this stage, the refrigerant flowing from the first discharge chamber 24*a* toward an opening 76 of the spool valve 71 via the fluid channel 32 loses the pressure thereof to have a lower pressure, corresponding to the suction pressure, when it passes through the above-mentioned opening 76. The amount of the pressure loss of the refrigerant while passing the opening 76 of the spool valve 71 depends on amount of movement of the spool valve 71 per se. Namely, when the amount of movement of the spool valve 71 is large, the opening 76 can be wide to result in a small pressure loss. When the amount of movement of the spool valve 71 is small, the opening 76 cannot be wide. Then, the pressure loss in the refrigerant is large.

It should be noted that the high pressure of the refrigerant, before it is subjected to the above-mentioned pressure loss, acts on the left side of the spool valve 71, and the low pressure of the refrigerant, after it is subjected to the pressure loss, acts on the right side of the spool 71 in the control pressure chamber 72. Therefore, a pressure differential corresponding to the above-mentioned pressure loss acts on the spool valve 71. Thus, the spool valve 71 is moved to a position where the pressure differential acting on the spool valve 71 is balanced with the elastic force of the compression spring 75. At this stage, if the spring constant of the compressing spring 75 is designed to be extremely small, the elastic force of the spring 75 acting on the spool valve 71 can be considered as constant. Thus, the spool valve 71 is moved so as to maintain the pressure loss at a constant irrespective of the rotation of the compressor. Namely, when the rotation of speed of the compressor increases so as to cause an increase in the amount of the refrigerant delivered from the compressor to the air-conditioning system, the spool valve 71 is automatically moved to a position where the extent of the opening 76 is large (in the right hand direction in FIG. 33), in order to maintain the constant pressure loss when the refrigerant passes through the opening 76.

On the other hand, when the rotational speed of the compressor decreases so as to cause a decrease in the amount of the refrigerant delivered from the compressor to the air-conditioning system, the spool valve 71 is moved to a different position where the extent of the opening 76 is small (in the left hand direction in FIG. 33), in order to again maintain a constant pressure loss when the refrigerant passes through the opening 76.

Figure 34A:
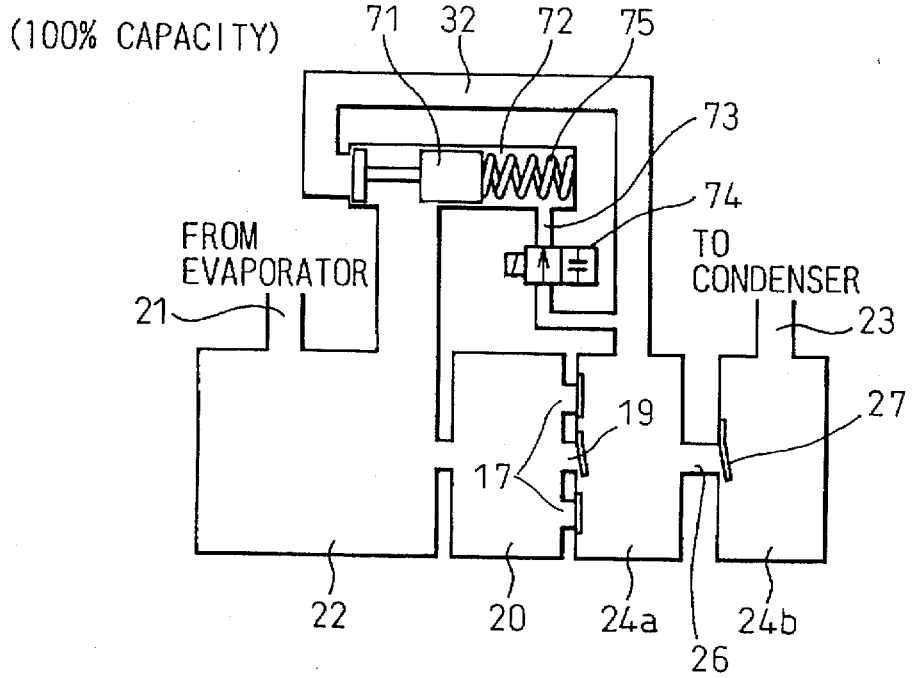
FIGS. 34A and 34B are schematic views of a capacity shifting unit accommodated in the compressor according to the eleventh embodiment of the present invention.
Figure 34B:
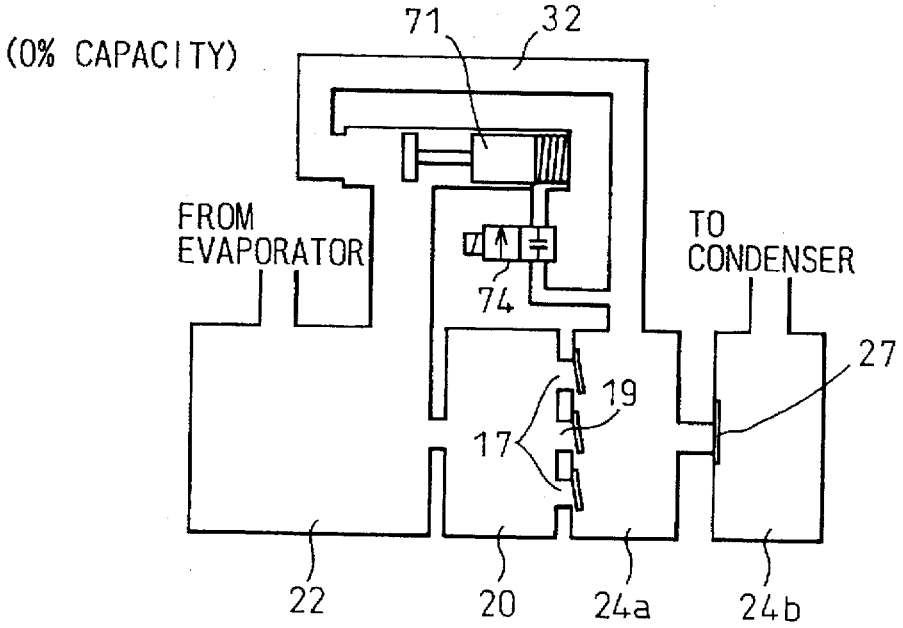

FIGS. 34A and 34B schematically illustrate how the scroll-type refrigerant compressor according to the above-mentioned eleventh embodiment is switched from 0% capacity to 100% capacity and vice versa.

It should be understood that, according to the design and construction of the compressor of the eleventh embodiment, the solenoid valve 74 can be small compared with the solenoid valve 33 used in the compressor of the first embodiment of FIGS. 1 and 2. Accordingly, the entire size and weight of the compressor of the eleventh embodiment can be smaller than those of the compressor of the first embodiment. Further, the pressure loss in the refrigerant in the operation switching system can be small.

Figure 35A:
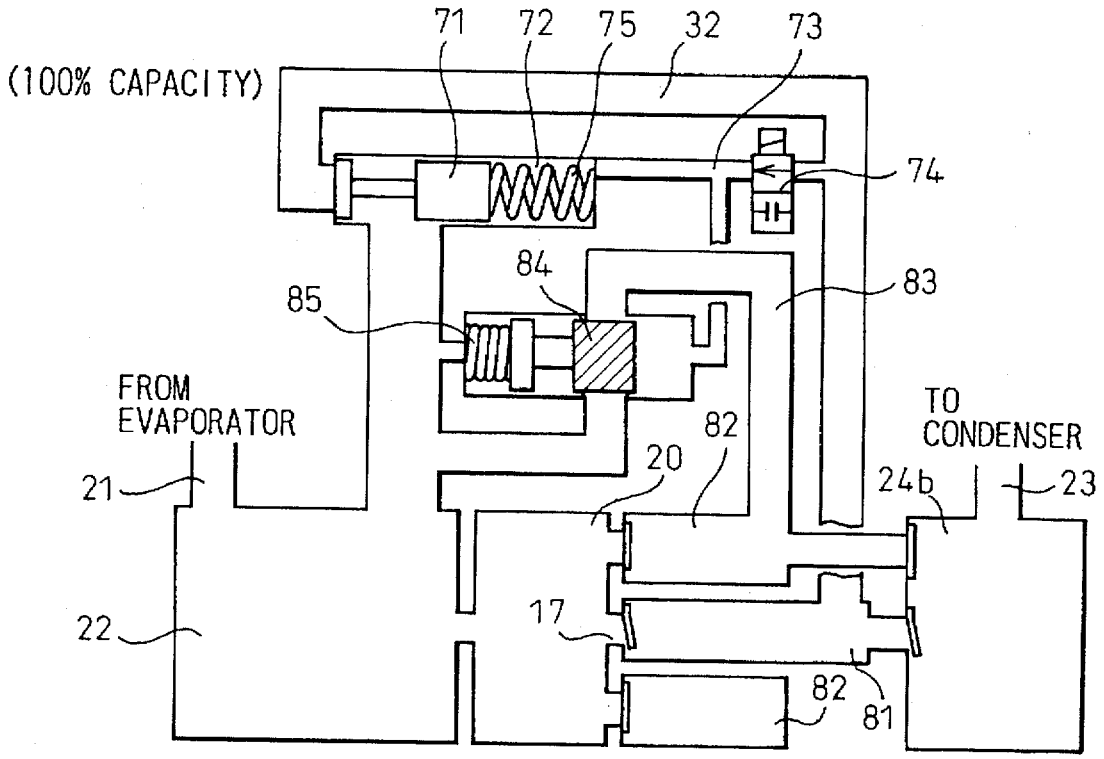
FIGS. 35A and 35B are schematic views of a scroll-type refrigerant compressor according to the twelfth embodiment of the present invention, illustrating the operation thereof.
Figure 35B:
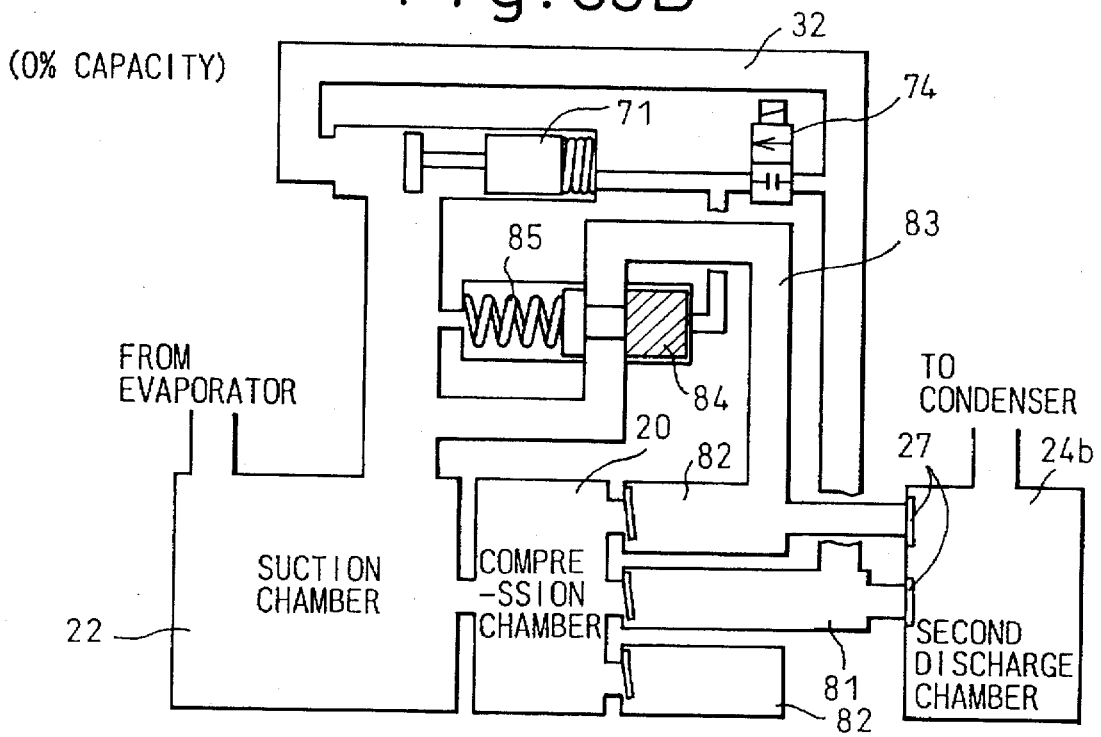

FIGS. 35A and 35B are similar to FIGS. 34A and 34B, and schematically illustrate the operation switching system of the scroll, type refrigerant compressor according to an twelfth embodiment.

The system of FIGS. 35A and 35B is different from the system of FIGS. 34A and 34B in that the first discharge chamber 24*a* of the system of FIGS. 34A and 34B is changed to two inner and outer discharge chambers 81 and 82. A spool valve 71, a compression spring 75, and a solenoid valve 74 similar to those incorporated in the compressor of the eleventh embodiment are incorporated in the inner discharge chamber 81 in which the refrigerant is discharged from the pockets 20 through one of a plurality of bypass ports 17. The refrigerant discharged into the inner discharge chamber 81 is permitted to flow toward the suction chamber 22 via the fluid channel 32. The outer discharge chamber 82 is fluidly connected to the suction chamber 22 via an additional fluid channel 83 which is blocked and unblocked by a slidable spool valve 84. The sliding movement of the spool valve 84 is controlled by the pressure of the refrigerant introduced from a control-pressure chamber 72 so as to act on an end of the valve 84, another pressure (a suction pressure) of the refrigerant introduced so as to act on the other end of the valve 84, and an elastic force applied by a compression spring 85 acting on the above-mentioned other end of the valve 84.

The operation of the scroll-type refrigerant compressor according to the twelfth embodiment is described below.

Referring to FIG. 35A, when the solenoid valve 74 is operated to open a control-pressure passageway 73, the opposite ends of the spool valve 71 are subjected to a discharge pressure of the refrigerant, and accordingly, the spool valve 71 is moved by the compression spring 75 so as to move to a position blocking the fluid channel 32. Thus, the pressure prevailing in the inner discharge chamber 81 is increased causing an increase in a pressure prevailing in the control-pressure chamber 72. Therefore, the spool 84 is moved left in FIG. 35A against the compression spring 85 to a position closing the additional fluid channel 83. Thus, the pressure in the outer discharge chamber 82 increases, so that the pressures in the inner and outer discharge chambers 81 and 82 are equal to a discharge pressure of the refrigerant in the second discharge chamber 24*b*. As a result, the discharge port 19 and the bypass ports 17 are covered by the check valves 15 receiving the discharge pressure of the refrigerant. Thus, the refrigerant compressed in the respective pockets (compression chambers) is discharged toward the second discharge chamber 24*b* from where it is delivered toward the condenser of an automobile air-conditioning system. Namely, the compressor is operated at 100% capacity.

Referring to FIG. 35B, when the solenoid valve 74 is operated to close the control-pressure passageway 73, the pressure in the control-pressure chamber 72 gradually leaks therefrom toward the suction chamber 22 to become equal to a suction pressure of the refrigerant. Therefore, a pressure differential appears between the pressures acting on the opposite ends of the spool valve 71, and the spool valve 71 is moved against the elastic force of the compression spring 75 to unblock the fluid channel 32.

The opposite ends of the spool 84 are acted on by equal pressures and, accordingly, the spool 84 is moved by the compression spring 85 in a right direction in FIG. 35B so as to open the additional fluid channel 83. Therefore, the pressures in the inner and outer discharge chambers 81 and 82 are reduced to the suction pressure of the refrigerant prevailing in the suction chamber 22. The pressure in the second discharge chamber 24*b* is maintained at a pressure equal to the discharge pressure of the refrigerant. Thus, the check valves 27 of the second discharge chamber 24*b* are closed. Therefore, the refrigerant, which is discharged from the pockets 20 toward the inner and outer discharge chambers 81 and 82 via the check valves 17 and the discharge port 19, flows through the fluid channel 32 and the additional fluid channel 83 toward the suction chamber 22. Namely, the compressor is operated at 0% capacity. The movement of the spool valve 71 is controlled in the same manner as the previous eleventh embodiment, so that the opening 76 of the spool valve 71 is always adjusted to maintain the pressure loss in the refrigerant in the fluid channel 32 constant.

The movement of the spool 84 is performed so as to unblock the additional fluid channel 83 to thereby obtain a large flow area which permits the refrigerant to flow from the outer discharge chamber 82 toward the suction chamber 22 without causing a pressure loss.

It should be understood that, in the scroll-type refrigerant compressor of the twelfth embodiment the refrigerant flowing from the inner discharge chamber 81 toward the suction chamber 22 via the fluid channel 32 is subjected to a pressure loss, and the refrigerant flowing through the additional fluid channel 83 cannot be subjected to a pressure loss due to the arrangement of the spool 84. Thus, the operation switching system of the compressor of the present embodiment can be one requiring a less drive torque compared with the operation switching system of the compressor of the eleventh embodiment.

Figure 36:
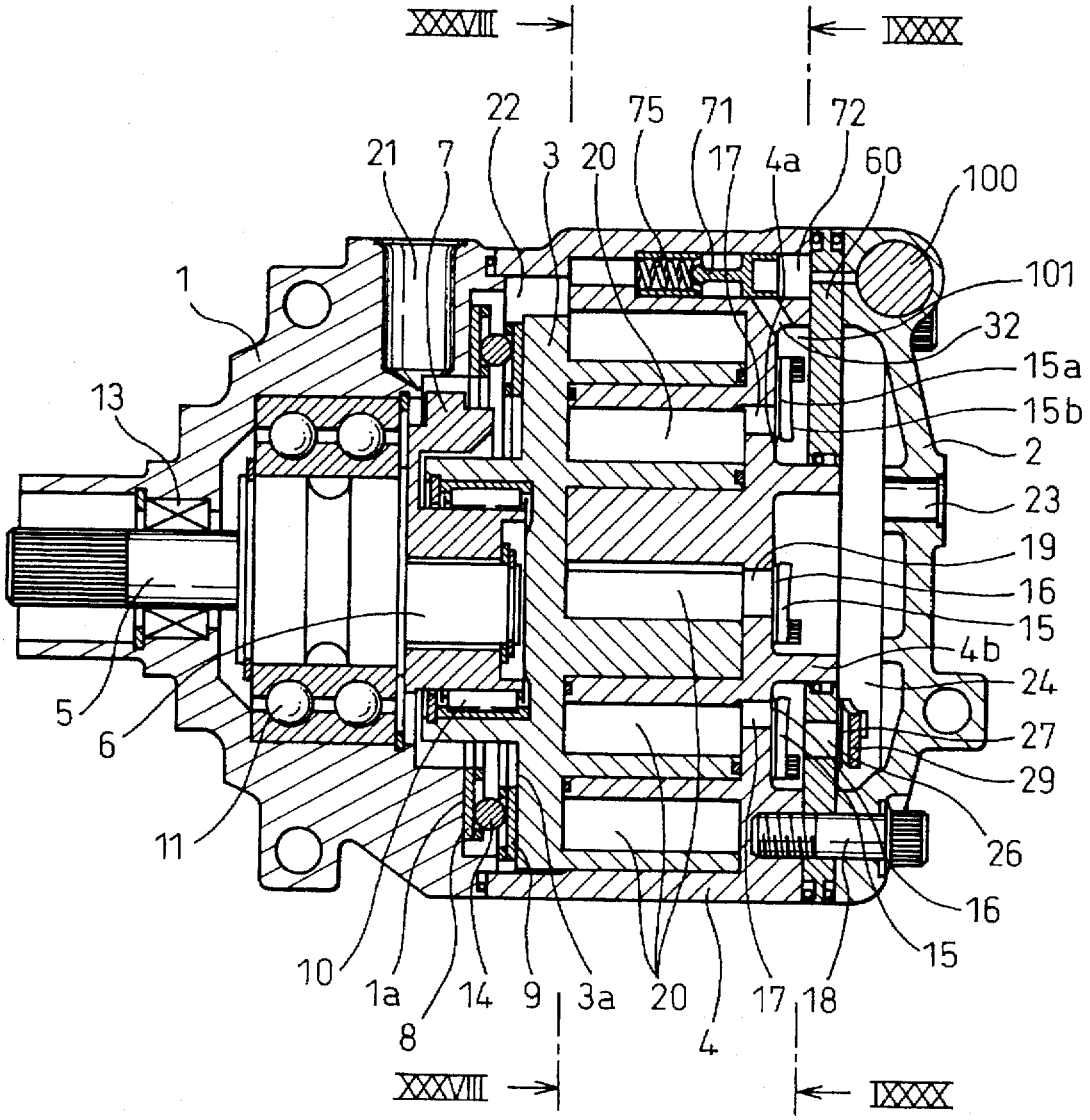
FIG. 36 is a longitudinal cross-sectional view of a scroll-type compressor according to thirteenth embodiment of the present invention.

FIG. 36 illustrates a scroll-type refrigerant compressor according to a thirteenth embodiment of the present invention. As shown in FIG. 36, the end plate 4*a* of the stationary scroll unit 4 is provided with a discharge port 19, and a plurality of bypass ports 17, bored therein. Namely, the ports 17 and 19 are arranged for providing a fluid communication between a plurality of pockets 20, a discharge chamber 24, and a bypass chamber 101. A plurality of check valves 15 and valve retainer plates 16 are also fixed to the end plate 4*a* of the stationary scroll unit 4 so as to cover the bypass ports 17 and the discharge port 19.

The above-mentioned bypass chamber 101 is defined between an intermediate plate 60 and the end plate 4*a* of the stationary scroll unit 4, and the discharge chamber 24 is defined by the intermediate plate 60, a wall portion 4*b* centrally extending from the rear face of the end plate 4*a* of the stationary scroll unit 4, and the rear housing 2. The bypass chamber 101 and the discharge chamber 24 communicate via a communication port 26 which is covered by a check valve 27 and a valve retainer plate 29.

The bypass chamber 101 is fluidly connected to a suction chamber 22 by a fluid channel 32, and a linearly movable spool valve 71 is arranged so as to control the communication between the bypass chamber 101 and the suction chamber 22. The movement of the spool valve 71 is controlled by pressure in a control-pressure chamber 72 and an elastic force of a compression spring 75, and the pressure in the control-pressure chamber 72 is adjustably changed by a control valve 100.

Figure 37:
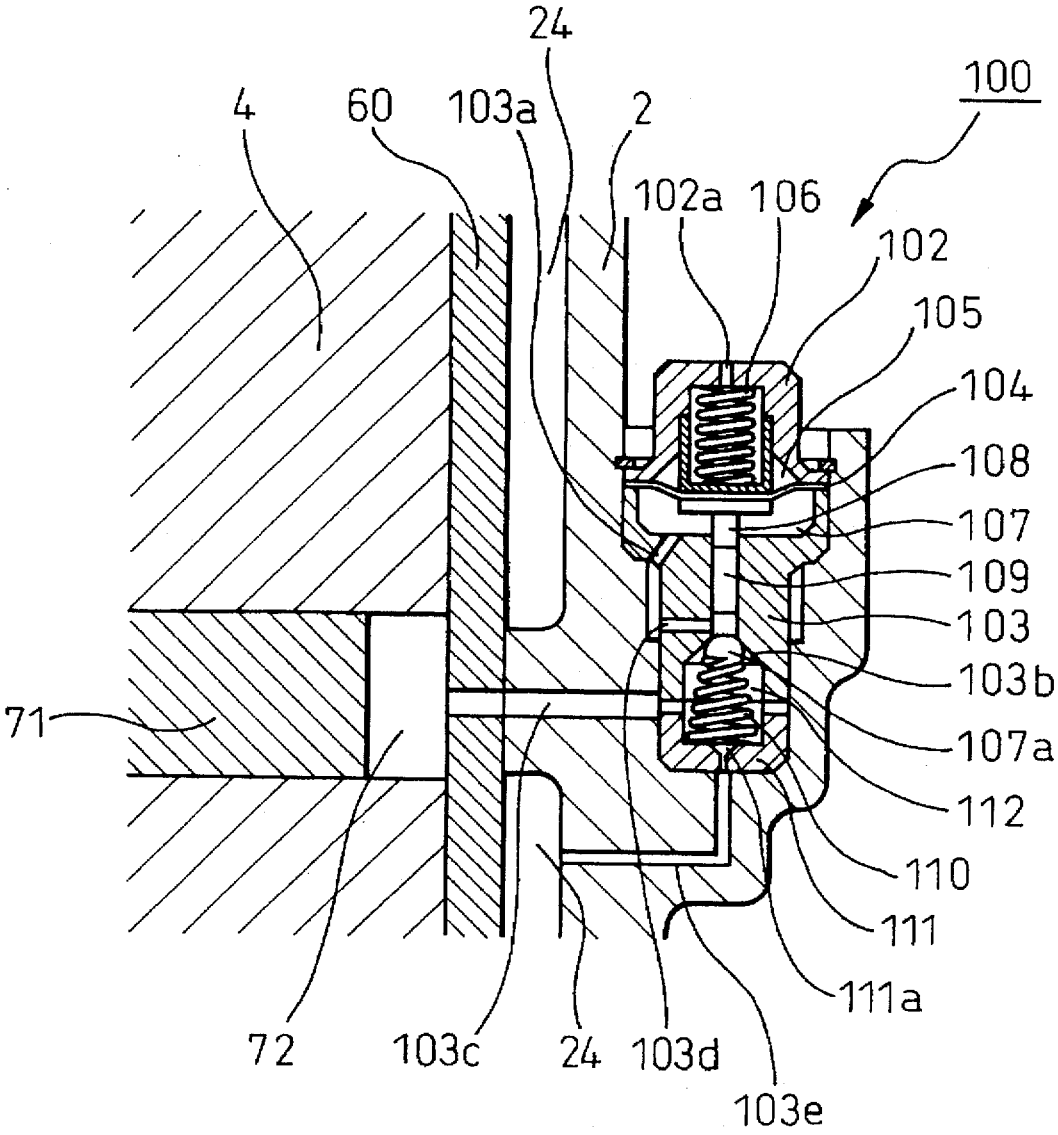
FIG. 37 is a partial cross-sectional view of a capacity control valve unit accommodated in the compressor according to the thirteenth embodiment of the present invention.

The control valve 100 is fixedly arranged in the rear housing 2 as shown in FIG. 37 and is provided with bodies 102 and 103 between which a diaphragm 104 is arranged. An atmospheric pressure chamber 105 arranged between the body 102 and the diaphragm 104 receives therein a spring 106 which applies a predetermined pressure to the diaphragm 104. The body 102 is also provided with a through-bore 102*a* through which the air is introduced from the atmosphere into the atmospheric pressure chamber 105. A suction-pressure chamber 107 is arranged between the body 103 and the diaphragm 104, and a spool 108 is arranged to linearly movably extend through the suction-pressure chamber 107, and the movement of the spool 108 causes a movement of a plunger 109 having a ball end 107*a*. The body 103 is provided with a through-bore 103*a* through which the suction pressure of the refrigerant is introduced into the suction-pressure chamber 107. The ball end 107*a* of the plunger 109 is constantly urged toward a valve seat 103*b* by the elastic force of the spring 110. The spring 110 is received in a control-pressure chamber 112 arranged between the body 103 and a bottom body 111. The control-pressure chamber 112 and a control-pressure chamber 72 of the compressor communicate with one another via control-pressure passageway 103*c*. The control-pressure chamber 112 and the discharge chamber 24 communicate with one another via a discharge-pressure passageway 103*e* and a choke 111*a* formed in the bottom body 111.

When a pressure in the suction-pressure chamber 107 is reduced, the plunger 109 is moved by the elastic force of the spring 106 so that the ball end 107*a* is moved away from the valve seat 103*b*. Thus, a pressure in the control-pressure chamber 112 is released toward the suction chamber 22 via the suction-pressure passageway 103*d*. As a result, the pressure in the control-pressure chamber 112 is reduced.

When the pressure in the suction-pressure chamber 107 is increased, the plunger 109 is moved by the elastic force of the spring 110 so that the ball end 107*a* is pressed against the valve seat 103*b*. Thus, the control-pressure chamber 112 is disconnected from the suction-pressure chamber 103*d*, and accordingly, the control pressure in the control-pressure chamber 112 increases.

The compressor of the present embodiment is connected to a condenser of a refrigerating circuit of an automobile air-conditioning system via a delivery port 23 formed in the rear housing 2.

Figure 38:
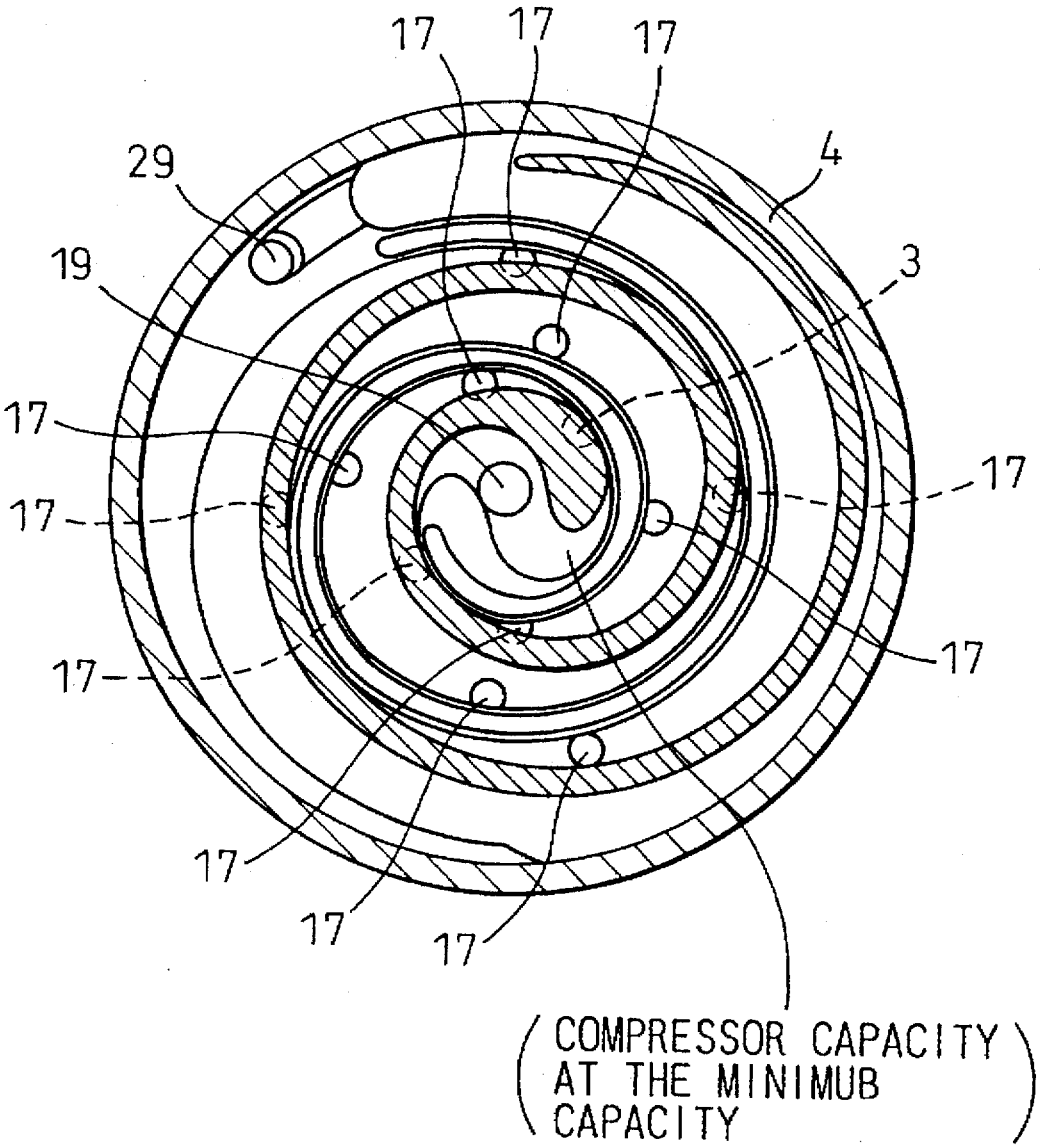
FIG. 38 is a cross-sectional view taken along the line XXXVIII—XXXVIII of FIG. 36, illustrating the engagement of the stationary and movable scroll units.

FIG. 38 illustrates an arrangement of the bypass ports 17 and the discharge port 19 formed in the end plate 4*a* of the stationary scroll unit 4. The illustrated arrangement of the bypass ports 17 and the discharge port 19 permit the pockets 20 (compression chambers) formed between the movable and stationary scroll units 3 and 4 to be by-passed into the discharge chamber 24 during the moving of the respective pockets 20 from the outer portion of the stationary scroll unit 4 toward the center of the same unit 4.

Figure 39:
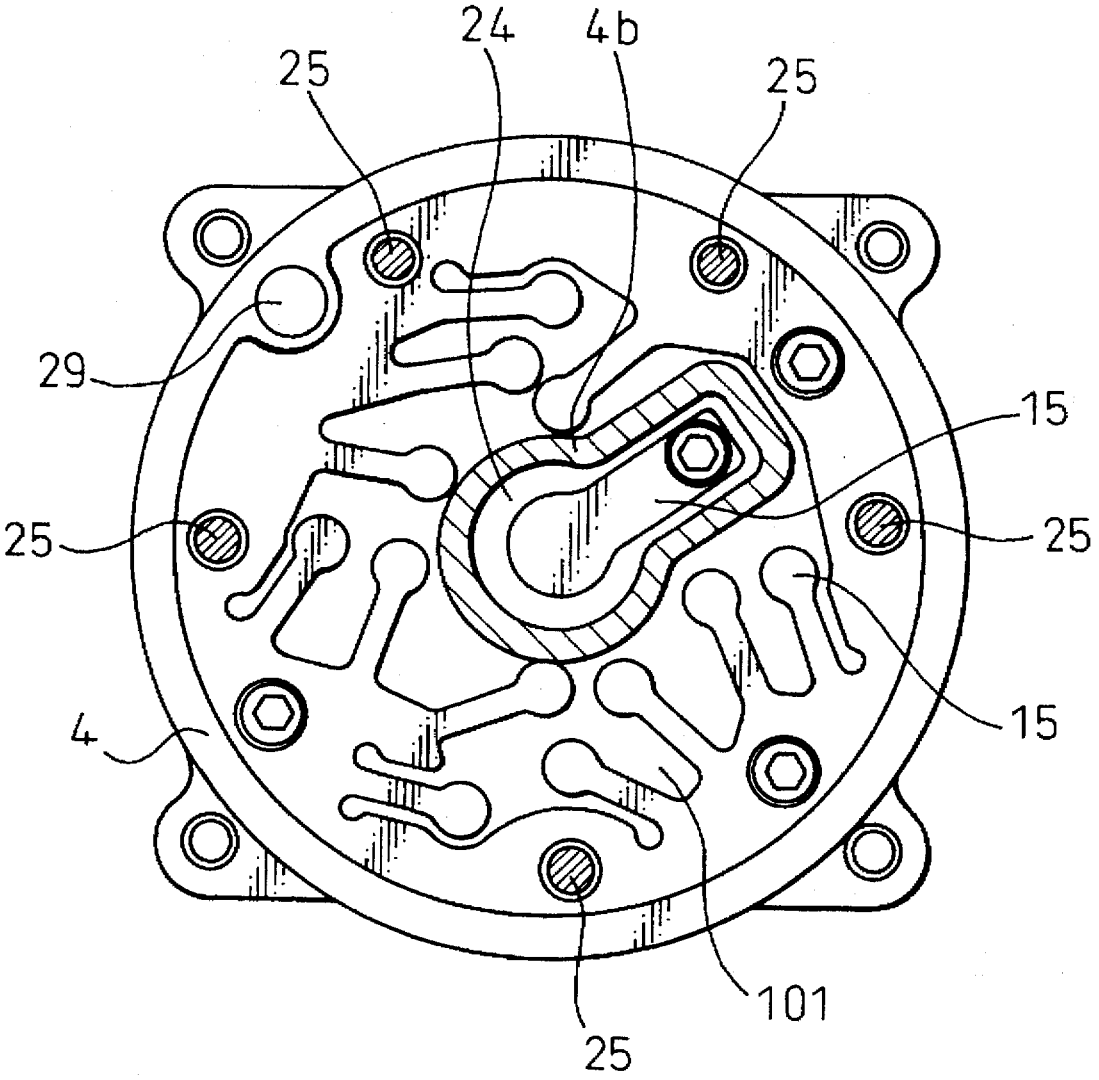
FIG. 39 is a cross-sectional view taken along the line IXXXX—IXXXX of FIG. 36, illustrating an arrangement of a check valve, a discharge chamber, and a by-passing chamber of the compressor according to thirteenth embodiment of the present invention.

FIG. 39 illustrates an arrangement of the check valves 15 covering the above-mentioned bypass ports 17 and the discharge port 19, the bypass chamber 101 and the discharge chamber 24. Reference numeral 25 designates threaded bolts fixing the check valves 15 to the end plate 4*a*.

The operation of the scroll-type refrigerant compressor according to the thirteenth embodiment of the present invention will be described below.

Referring to FIG. 36, the fluid channel 32 of the compressor is blocked by the spool 71, and therefore, the compressor is operated at a 100% capacity. The pressure of the refrigerant in the discharge chamber 24 is equal to a condensing pressure in the refrigerating circuit of the air-conditioning system. Since the fluid channel 32 is blocked, the pressure in the bypass chamber 101 increases so as to be equal to the discharge pressure in the discharge chamber 24, i.e., the above-mentioned condensing pressure. Thus, the back of the respective check valves 15 is acted on by the discharge pressure (the condensing pressure) and pressed against the respective bypass ports 17 and the discharge port 19. Therefore, the refrigerant in the pockets 20 is gradually compressed therein to eventually have a pressure corresponding to the discharge pressure, and is discharged from the pockets 20 into the discharge chamber 24 via the discharge port 19.

When the compression of the refrigerant is carried out in the pockets 20 under a condition such that a difference between the discharge and suction pressures is small, the refrigerant in the respective pockets 20 is by-passed into the by-passing chamber 101 via the bypass ports 17, and into the discharge chamber 24 via the communication port 26. The compressed refrigerant discharged into the discharge chamber 24 is then delivered therefrom toward the condenser of the refrigerating circuit of the air-conditioning system. The refrigerant flowing through the air-conditioning system returns the suction port 21 of the compressor.

Figure 40:
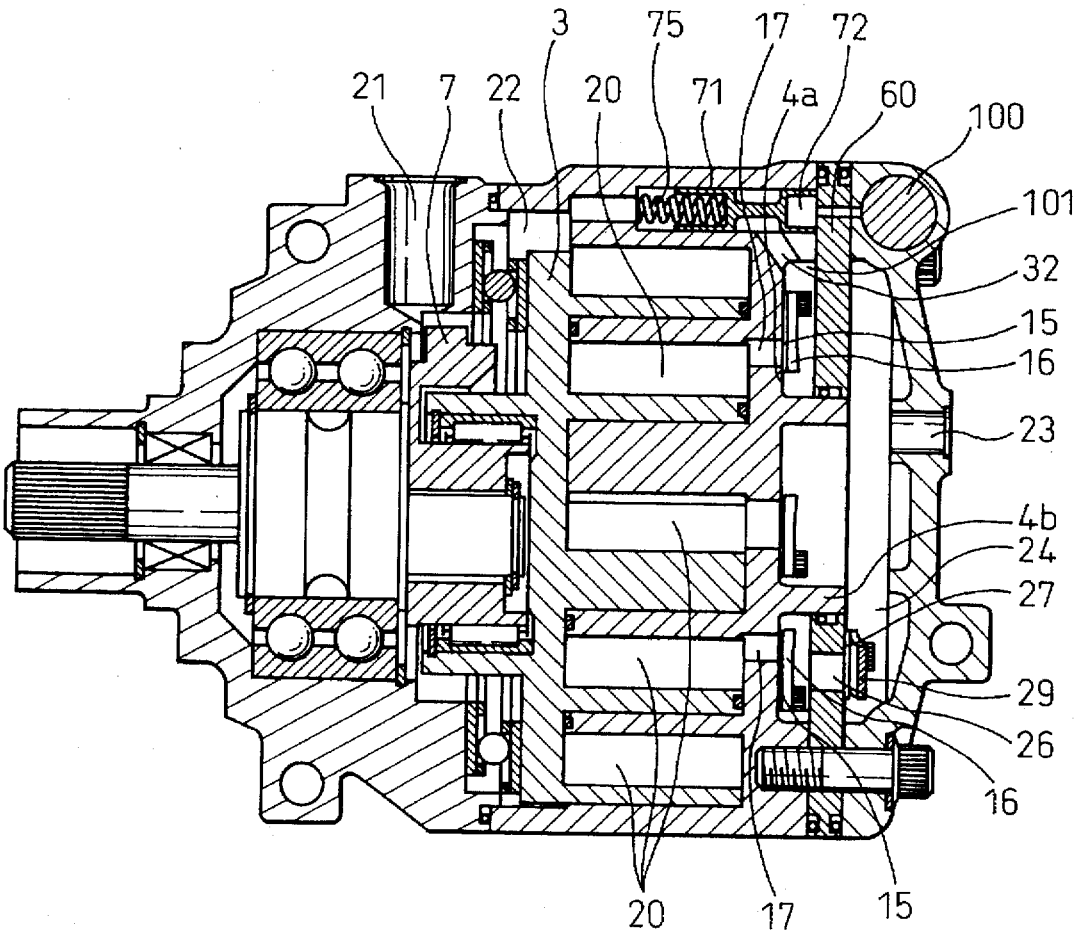
FIG. 40 is a cross-sectional view of the compressor of the thirteenth embodiment of the present invention, illustrating the operation thereof.

Referring now to FIG. 40, the fluid channel 32 of the compressor is unblocked by the spool 71, the pressure in the by-passing chamber 101 is equal to the suction pressure in the suction chamber 22. On the other hand, the discharge pressure in the discharge chamber 24 is kept equal to the condensing pressure of the refrigerating circuit. Thus, the check valve 27 in the discharge chamber 24 closes the communication port 26 under the discharge pressure. Accordingly, the refrigerant discharged from the respective pockets 20 into the by-passing chamber 101 via the bypass ports 17 directly flows toward the suction chamber 22 via the open fluid channel 32. Thus, the compressor is operated at the minimum capacity. At this stage, since the check valves 15 are subjected to the low suction pressure, the bypass ports 17 and the discharge port 19 are not tightly closed by the check valves 15, and accordingly, the refrigerant in the respective pockets 20 cannot be compressed therein, and is discharged into the by-passing chamber 101 via the ports 17.

It should be understood that, in the compressor of the thirteenth embodiment, since the movement of the spool 71 is controlled by the control valve 100 operating in response to a change in the suction pressure of the refrigerant, the switching of the operation of the compressor between the 100% capacity and the minimum capacity can be controlled in response to the change in the suction pressure of the refrigerant. Therefore, the temperature of the air supplied from the air-conditioning system can be maintained at a constant temperature level.

FIGS. 41 through 43, 45A and 45B illustrate a scroll-type refrigerant compressor according to a fourteenth embodiment of the present invention.

The compressor of the present embodiment is different from the compressor of the above-mentioned thirteenth embodiment in that the compressor is provided with two separate outer and inner by-passing chambers 101*a* and 101*b*. Namely, the by-passing chambers 101*a* and 101*b* are separated by the intermediate plate 60, and a check valve assembly consisting of a check valve 113*a* and a valve retainer plate 113*b* is arranged between the two chambers 101*a* and 101*b*.

Figure 41:
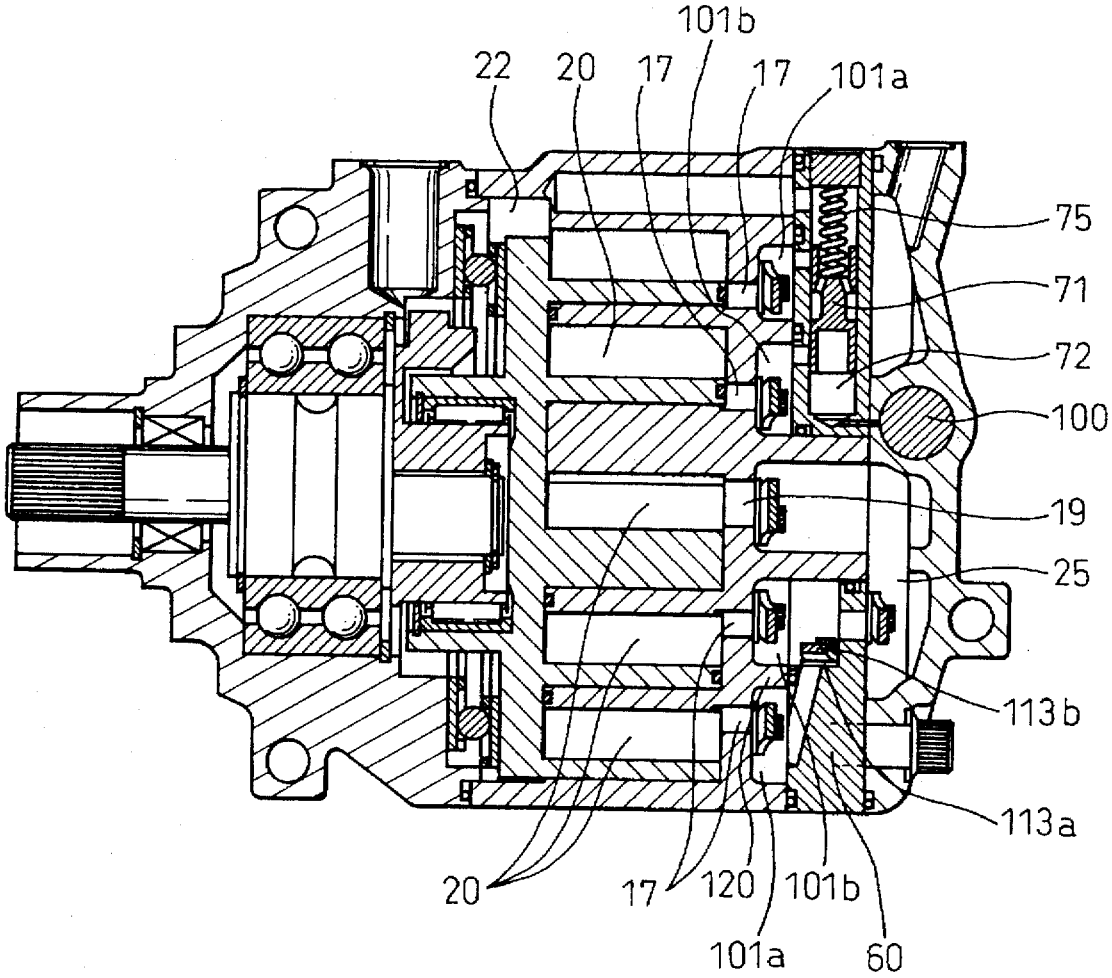
FIG. 41 is a longitudinal cross-sectional view of a scroll-type refrigerant compressor according to a fourteenth embodiment of the present invention, illustrating one operating condition thereof.
Figure 42:
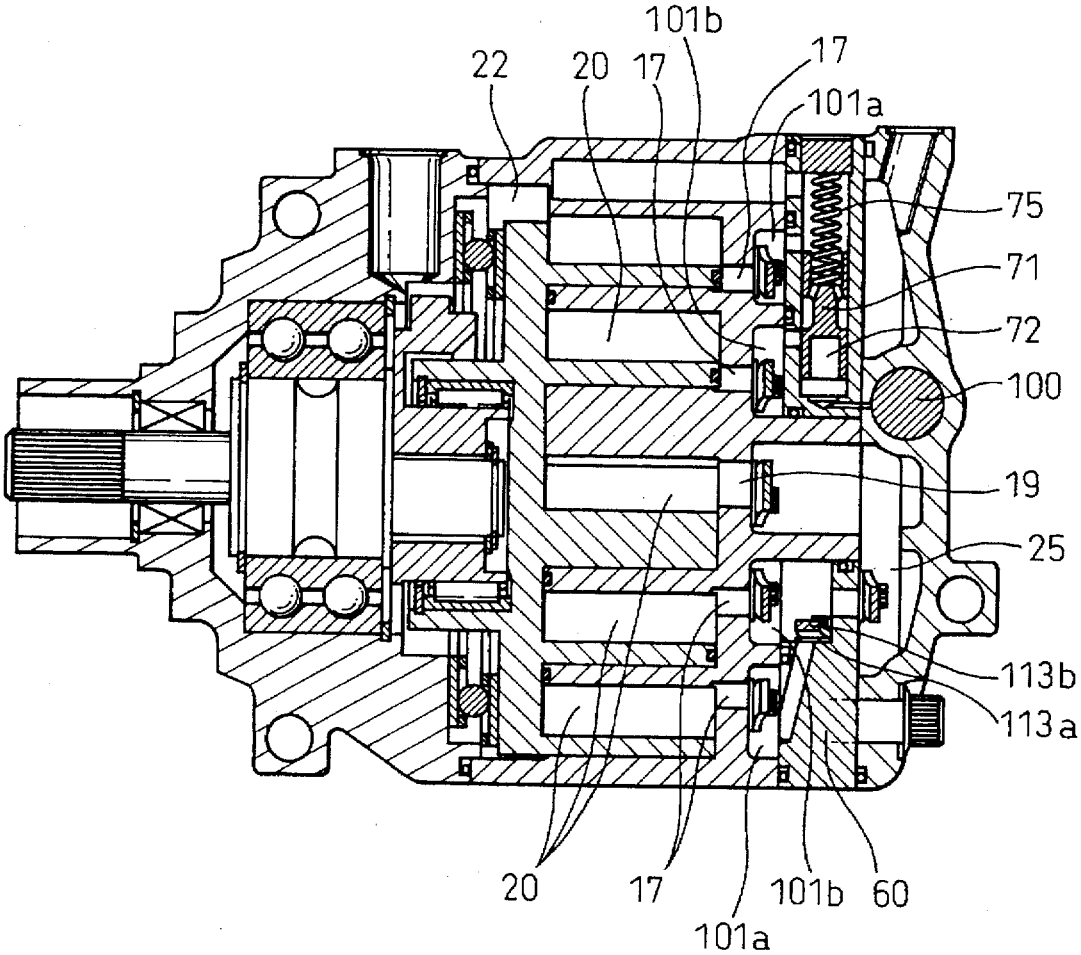
FIG. 42 is the same cross-sectional view as FIG. 41, illustrating a different operating condition of the compressor.
Figure 43:
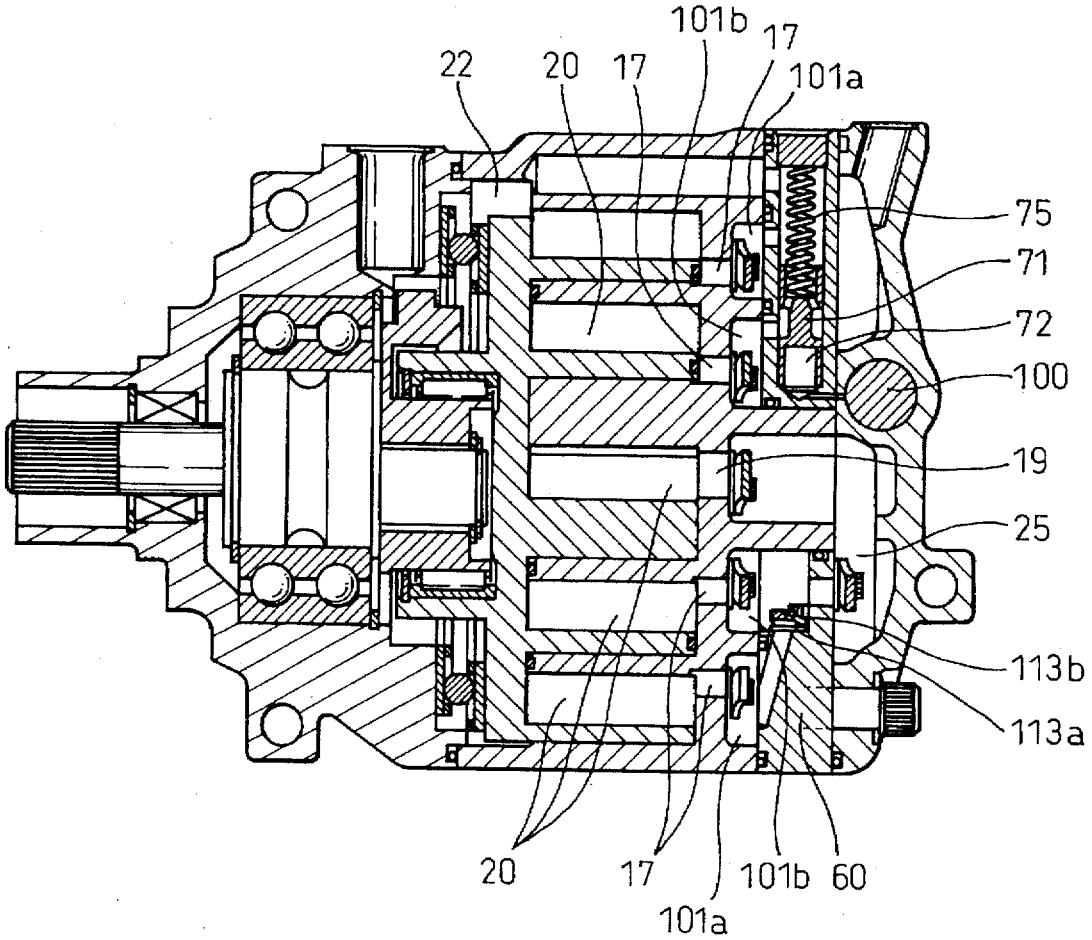
FIG. 43 is the same cross-sectional view as FIG. 41, illustrating a further different operating condition of the compressor.

Further, a spool 71 is arranged so as to be moved to a position where the outer by-passing chamber 101*a* is communicated with the suction chamber 22 as shown in FIG. 42, and to a different position where both inner and outer by-passing chambers 101*b* and 101*a* are communicated with the suction chamber 22 as shown in FIG. 43. Further, the spool 71 can be moved to a further position where both inner and outer by-passing chambers 101*b* and 101*a* are fluidly disconnected from the suction chamber 22 as shown in FIG. 41.

With the above-mentioned construction of the compressor of the fourteenth embodiment, when the compressor is operated at a 100% capacity, the spool 71 is moved down in FIG. 41 so as to disconnect both inner and outer by-passing chambers 101*b* and 101*a* from the suction chamber 22.

Figure 44B:
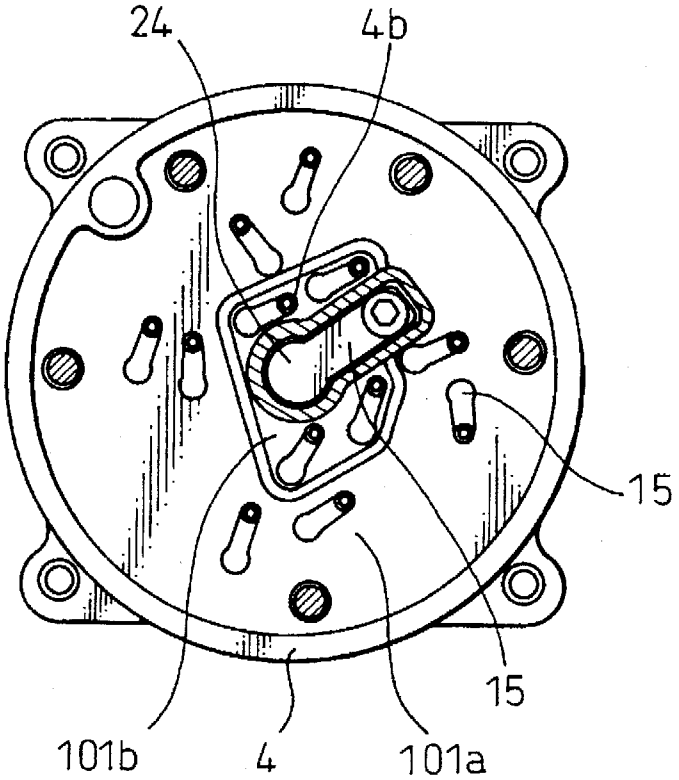
FIGS. 44A and 44B are two cross-sectional views of the compressor of fourteenth embodiment, illustrating a relationship between stationary and movable scroll units when the compressor is operated at an intermediate capacity operation, and also illustrating an assembly of check valves.
Figure 44A:
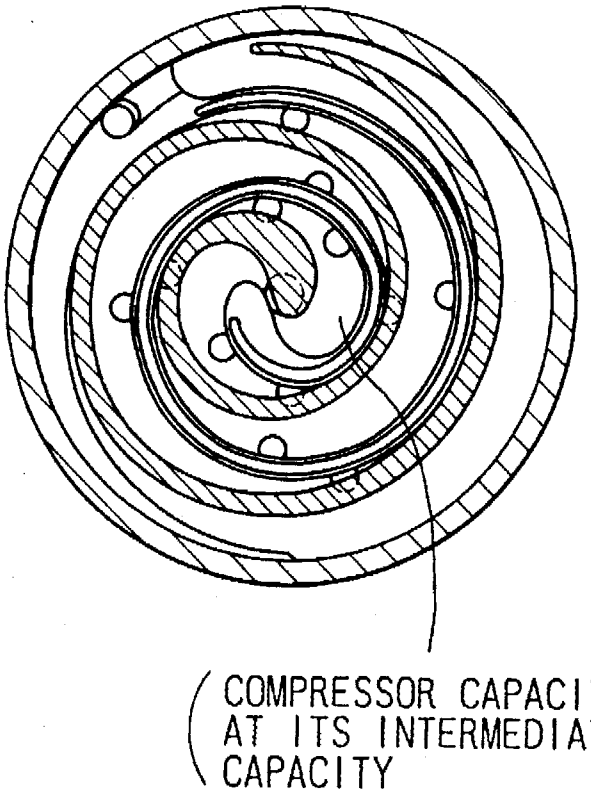
Figure 45B:
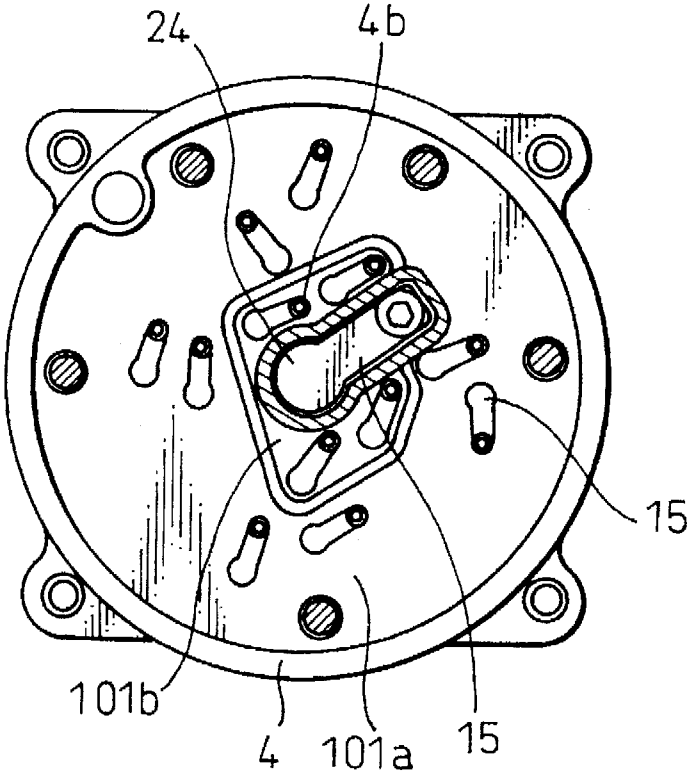
FIGS. 45A and 45B are the same views as those of FIGS. 44A and 44B, illustrating a relationship between stationary and movable scroll units when the compressor is operated at the minimum capacity operation, and also illustrating an assembly of check valves.
Figure 45A:
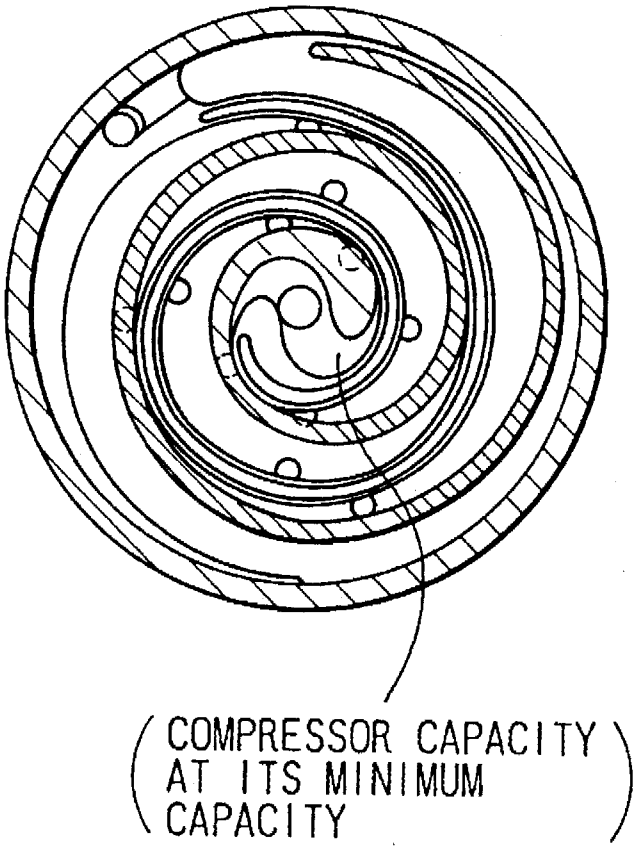

When the outer by-passing chamber 101*a* communicate with the suction chamber 22 under control of the spool 71 (FIG. 42), only a part of the refrigerant in the pockets 20 is by-passed toward the suction chamber 22. Therefore, the compressor is operated at an intermediate capacity. It should be understood that the intermediate capacity of the compressor, i.e., an intermediate amount of the compressed refrigerant, is determined by the volume of the pockets 20 which are not communicated with the bypass ports 17 opening toward the outer by-passing chamber 101*a* (see FIGS. 44A and 44B).

As shown in FIG. 43, when the outer and inner by-passing chambers 101*a* and 101*b* communicate with the suction chamber 22 under the control of the spool 71, substantially all of the refrigerant sucked into the pockets 20 is by-passed into the suction chamber 22. Thus, the compressor is operated at the minimum capacity. The amount of the refrigerant delivered from the compressor operated at the minimum capacity is determined by the volume of the pockets 20 which are not communicated with the bypass ports 17 opening toward the outer and inner by-passing chambers 101*a* and 101*b* (see FIGS. 45A and 45B).

Figure 46:
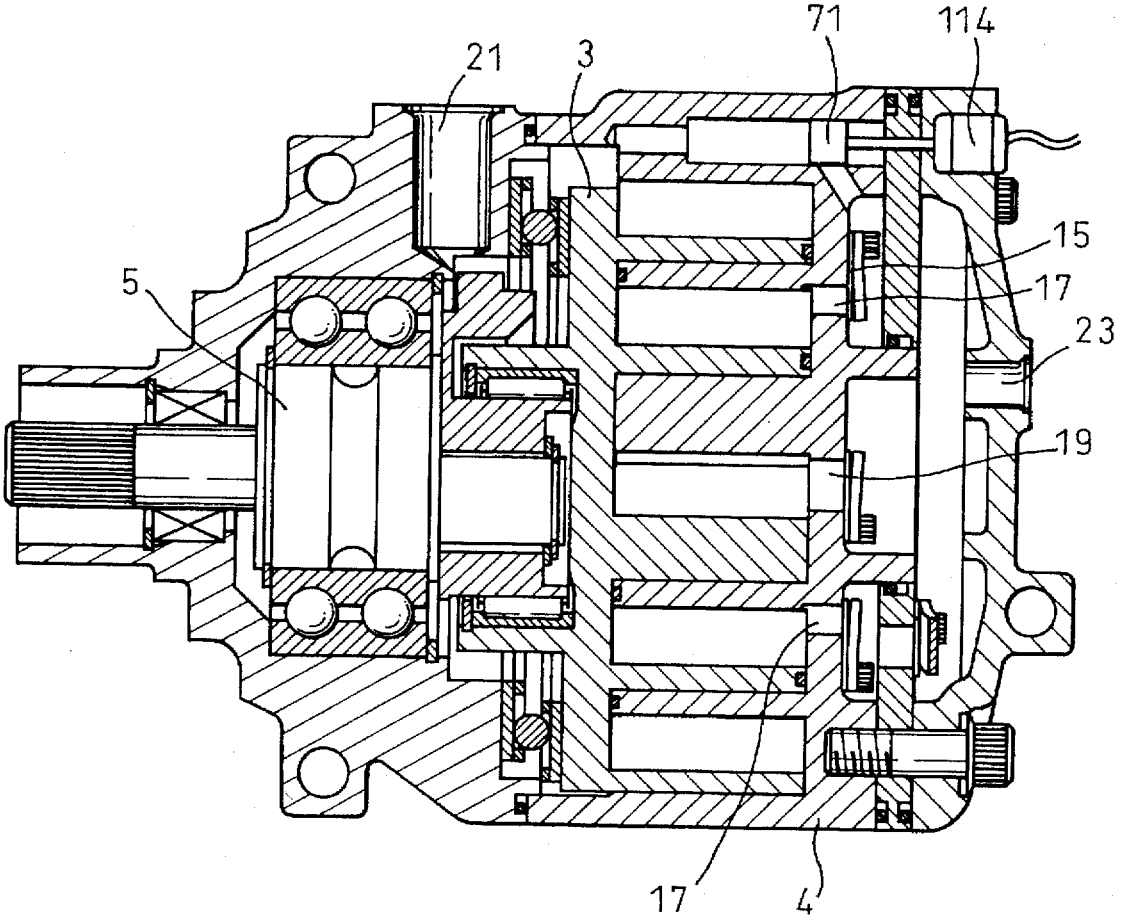
FIG. 46 is a longitudinal cross-sectional view of a scroll-type refrigerant compressor according to a fifteenth embodiment of the present invention, illustrating one operating condition thereof; and, FIG. 47 is the same cross-sectional view as that of FIG. 46, illustrating an operating condition different from that of FIG. 46.
Figure 47:
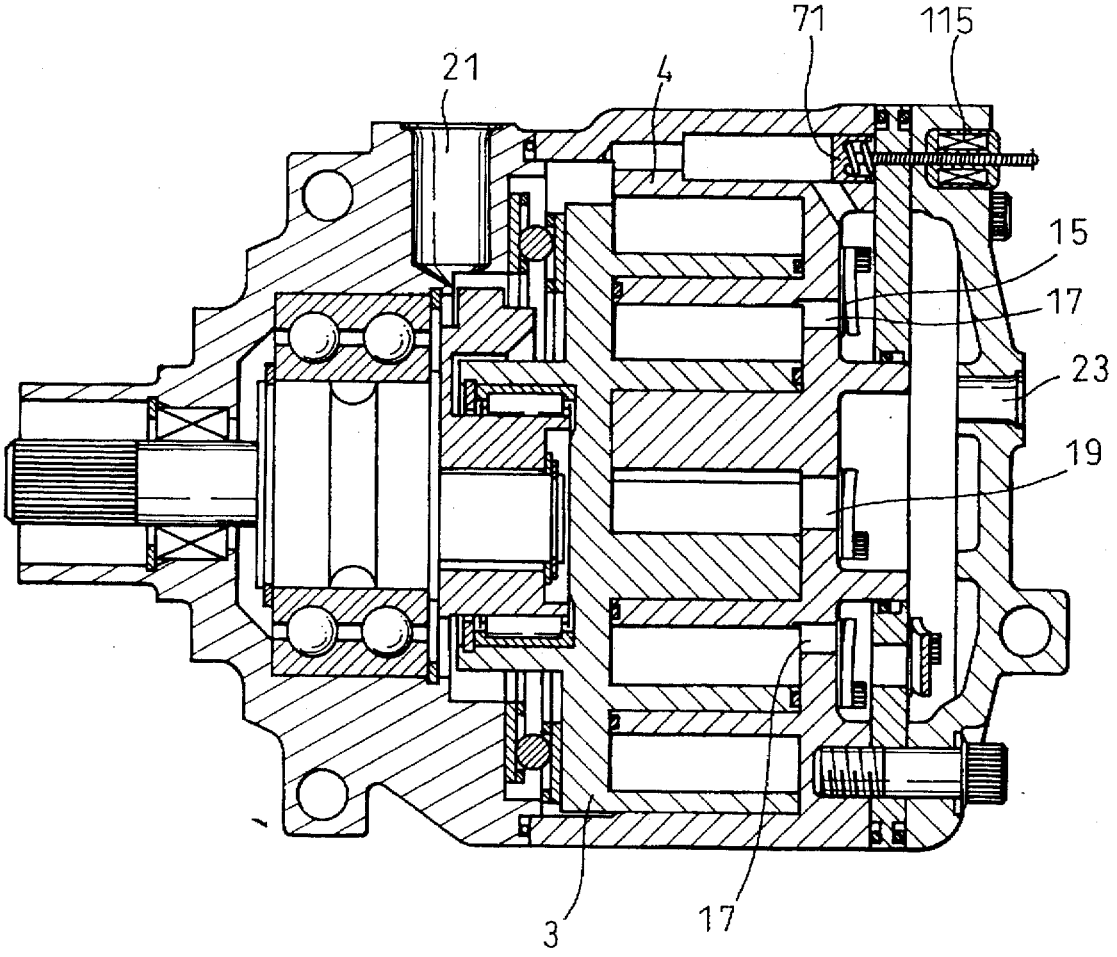

FIG. 46 illustrates a scroll-type refrigerant compressor according to a fifteenth embodiment of the present invention. The compressor of the present fifteenth embodiment is different from the compressor of the thirteenth embodiment in FIG. 36 in that the control valve 100 of the thirteenth embodiment for operating the spool 71 is replaced with an electric motor 114 such as a well known servo motor. The control valve 100 of the twelfth embodiment may also be replaced with an electromagnet unit 115 as shown in FIG. 47.

From the foregoing description of the preferred embodiments of the present invention, it will be understood that, since the scroll-type refrigerant compressor according to the present can be easily switched from the ordinary 100% capacity to the 0% capacity or the minimum capacity during continuous operation thereof driven by a drive source, i.e., an automobile engine, it is possible to omit a solenoid clutch mounted on the drive shaft (the crank shaft) from the power transmitting line between the engine and the compressor to thereby reduce the size and weight of the scroll-type compressor. Further, reduction of the manufacturing cost of the scroll-type compressor can be realized due to omission of the solenoid clutch. Moreover, the switching of the operation of the compressor from the 100% capacity to the 0% capacity and vice versa can be achieved by a small change in a load applied to the automobile engine. Thus, drivers and passengers of an automobile do not suffer from an unpleasant shock.

Many variations and modifications to the illustrated embodiments will occur to persons skilled in the art without departing from the spirit and scope of the invention as claimed in the accompanying claims.

We claim:

1. A scroll-type refrigerant compressor comprising:

a housing provided with a suction port for introducing a refrigerant to be compressed into said housing and a delivery port for delivering the refrigerant after compression;

a suction chamber defined in said housing and fluidly communicated with said suction port;

a discharge chamber defined in said housing and fluidly communicated with said delivery port;

a stationary scroll fixed to said housing and provided with an end plate and a spiral member formed on said end plate;

a movable scroll arranged so as to be eccentrically engaged with said stationary scroll and provided with an end plate and a spiral member formed on said end plate;

a drive shaft rotatably supported by said housing and providing said movable scroll with an orbital motion relative to said stationary scroll;

a rotation preventing means arranged for preventing said movable scroll from rotating during the orbital motion thereof;

a plurality of compressing chambers defined between said stationary and movable scrolls so as to move toward a center of said spiral members in response to the orbital motion of said movable scroll to thereby compress refrigerant sucked into said chambers;

a plurality of bypass ports and a discharge port formed in said end plate of said stationary scroll, said plurality of bypass ports and said discharge port being disposed so as to permit said plurality of compressing chambers to be fluidly communicated with said discharge chamber, all of said plurality of compressing chambers being constantly communicated with said plurality of bypass ports or said discharge port;

check valve means arranged in said discharge chamber at positions adjacent to said plurality of bypass ports and said discharge port so as to prevent the refrigerant after compression from returning from said discharge chamber toward said plurality of compressing chambers;

a fluid channel arranged so as to be extended between said suction chamber and said discharge chamber, for providing a fluid communication therebetween; and a fluid passage control means arranged in said fluid channel and defining open and closed positions of said fluid channel to thereby regulate the passage of the refrigerant through said fluid channel, each of said plurality of bypass ports and said discharge port defining a respective predetermined open area and said plurality of bypass ports and said discharge port being constructed and arranged so that as each respective compressing chamber moves toward said center of said spiral members to compress the refrigerant a sum of said respective predetermined open areas of communicating ports of said plurality of bypass ports and said discharge port which are in communication with said respective compressing chamber increases.

2. A scroll-type compressor according to claim 1, wherein said fluid channel means is provided by a passageway formed so as to extend through said housing means.

3. The scroll-type compressor according to claim 1, wherein said check valve means includes an individual check valve element arranged for each of said plurality of bypass ports and said discharge port.

4. The scroll-type compressor according to claim 3, wherein said check valve elements are in contact with said end plate of said stationary scroll at positions covering each of said plurality of bypass ports and said discharge port said check valve elements being able to be moved away from said end plate of said stationary scroll means to open each of said plurality of bypass ports and said discharge port.

5. The scroll-type compressor according to claim 1, wherein said fluid passage control means comprises a solenoid valve means defining open and close positions thereof and able to move from the open to closed position and vice versa in response to electric energizing signals.

6. A scroll-type compressor according to claim 1, wherein said fluid passage control means comprises a linearly movable spool valve means moved by a valve actuator means in said fluid channel means between a first position blocking said fluid channel means and a second position unblocking said fluid channel means.

7. A scroll-type compressor according to claim 1, wherein said fluid passage control means comprises a rotary valve means, rotated by a rotary actuator means in said fluid channel means, between a first position blocking said fluid channel means and a second position unblocking said fluid channel means.

8. A cross-type compressor according to claim 1, wherein said plurality of bypass ports and said discharge port are arranged in a manner such that an angle of a line passing through two respective adjacent ports of said plurality of bypass ports and said discharge port measured with respect to the center of said stationary scroll decreases when said two respective adjacent ports are arranged close to the center of said stationary scroll.

9. The scroll-type compressor according to claim 8, wherein said angle of the line passing through said two respective adjacent ports of said plurality of bypass ports and said discharge port measured with respect to the center of said stationary scroll is defined by an equation of geometric progression:

$$\Delta\theta=\theta_o\times k\ \Delta\theta_{(n-1)}$$

where $\Delta\theta$ is said angle between said two respective adjacent ports of said plurality of bypass ports and said discharge port, k is a constant, and n is the number of bypass ports.

* * * * *